US008025569B2

(12) United States Patent
Nguyen et al.

(10) Patent No.: US 8,025,569 B2
(45) Date of Patent: Sep. 27, 2011

(54) SIMULATING REAL GAMING ENVIRONMENTS WITH INTERACTIVE HOST AND PLAYERS

(75) Inventors: Binh T. Nguyen, Reno, NV (US); Lee E. Cannon, Bozeman, MT (US); Craig A. Paulsen, Reno, NV (US)

(73) Assignee: IGT, Reno, NV (US)

( * ) Notice: Subject to any disclaimer, the term of this patent is extended or adjusted under 35 U.S.C. 154(b) by 1514 days.

(21) Appl. No.: 11/447,721

(22) Filed: Jun. 5, 2006

(65) Prior Publication Data

US 2006/0258446 A1 Nov. 16, 2006

Related U.S. Application Data

(63) Continuation-in-part of application No. 11/143,345, filed on Jun. 2, 2005, now Pat. No. 7,753,790, which is a continuation of application No. 10/112,967, filed on Mar. 29, 2002, now Pat. No. 6,908,390.

(51) Int. Cl.
*A63F 9/24* (2006.01)

(52) U.S. Cl. ..... 463/30; 463/40

(58) Field of Classification Search ..... 463/25–30, 463/40–42

See application file for complete search history.

(56) References Cited

U.S. PATENT DOCUMENTS 4,339,798 A 7/1982 Hedges et al.
4,467,424 A 8/1984 Hedges et al.
4,926,327 A * 5/1990 Sidley ..... 463/13
5,083,271 A 1/1992 Thacher et al.
5,259,613 A 11/1993 Marnell, II
5,544,892 A 8/1996 Breeding
5,586,937 A 12/1996 Menashe
5,655,961 A 8/1997 Acres et al.
5,711,715 A 1/1998 Ringo et al.
5,755,621 A 5/1998 Marks et al.
5,762,552 A 6/1998 Vuong et al.
5,779,549 A 7/1998 Walker et al.
5,971,271 A 10/1999 Wynn et al.
6,039,648 A * 3/2000 Guinn et al. ..... 463/16
6,082,887 A 7/2000 Feuer et al.

(Continued)

FOREIGN PATENT DOCUMENTS

AU 2002306874 6/2006

(Continued)

OTHER PUBLICATIONS

Examination Report from Foreign Application No. GB0616868.6, Jan. 19, 2007, 2 pages.

(Continued)

*Primary Examiner* — Masud Ahmed

(74) *Attorney, Agent, or Firm* — Weaver Austin Villeneuve & Sampson LLP

(57) ABSTRACT

Techniques for simulating real (or live) gaming environments are disclosed. A virtual gaming environment effectively connects a number of people together by connecting a number of computing devices (e.g., personal computers, gaming machines). The virtual gaming environment provides a view of a virtual gaming area (e.g., a virtual gaming table) where a number of individuals (or players) and a person acting as the host are effectively represented. In this virtual gaming area, the players and host can interact with each other via audio and/or video input/output devices. As a result, a live gaming environment where players can see, hear, and converse with each other, as well as a live host (e.g., a dealer) is effectively simulated.

40 Claims, 34 Drawing Sheets

U.S. PATENT DOCUMENTS

| | | | | |
|---|---|---|---|---|
| 6,224,486 | B1 | 5/2001 | Walker et al. | |
| 6,280,325 | B1 | 8/2001 | Fisk | |
| 6,287,202 | B1 * | 9/2001 | Pascal et al. | 463/42 |
| 6,508,709 | B1 * | 1/2003 | Karmarkar | 463/42 |
| 6,672,589 | B1 * | 1/2004 | Lemke et al. | 273/236 |
| 6,712,689 | B2 | 3/2004 | Clarkson et al. | |
| 6,817,948 | B2 | 11/2004 | Pascal et al. | |
| 6,908,387 | B2 | 6/2005 | Hedrick et al. | |
| 6,908,390 | B2 | 6/2005 | Nguyen et al. | |
| 7,018,291 | B1 * | 3/2006 | Lemke et al. | 463/12 |
| 7,445,549 | B1 * | 11/2008 | Best | 463/32 |
| 7,753,790 | B2 | 7/2010 | Nguyen et al. | |
| 2001/0019965 | A1 * | 9/2001 | Ochi | 463/25 |
| 2001/0036865 | A1 | 11/2001 | Neal | |
| 2002/0034980 | A1 * | 3/2002 | Lemmons et al. | 463/40 |
| 2002/0094869 | A1 * | 7/2002 | Harkham | 463/42 |
| 2002/0137562 | A1 * | 9/2002 | Malone | 463/19 |
| 2003/0027631 | A1 | 2/2003 | Hedrick et al. | |
| 2003/0032479 | A1 * | 2/2003 | LeMay et al. | 463/32 |
| 2003/0054868 | A1 | 3/2003 | Paulsen et al. | |
| 2003/0186745 | A1 | 10/2003 | Nguyen et al. | |
| 2005/0040601 | A1 * | 2/2005 | Yoseloff et al. | 273/292 |
| 2005/0043088 | A1 | 2/2005 | Nguyen et al. | |
| 2005/0075167 | A1 * | 4/2005 | Beaulieu et al. | 463/32 |
| 2005/0221882 | A1 | 10/2005 | Nguyen et al. | |
| 2005/0233799 | A1 * | 10/2005 | LeMay et al. | 463/20 |
| 2006/0258446 | A1 | 11/2006 | Nguyen et al. | |
| 2007/0218968 | A1 * | 9/2007 | Snow et al. | 463/13 |

FOREIGN PATENT DOCUMENTS

| | | | |
|---|---|---|---|
| AU | 2006208418 | | 11/2008 |
| CA | 2351799 | | 12/2001 |
| CN | 1655852 | A | 8/2005 |
| CN | 101681539 | A | 3/2010 |
| EP | 0 291 705 | | 4/1988 |
| EP | 2030178 | | 3/2009 |
| GB | 2401063 | B | 10/2006 |
| GB | 2427149 | | 3/2007 |
| KR | 20000018155 | | 4/2000 |
| KR | 20010070770 | | 7/2001 |
| KR | 20010096091 | | 11/2001 |
| KR | 20020036440 | | 5/2002 |
| WO | WO00/29084 | | 5/2000 |
| WO | WO00/64545 | | 11/2000 |
| WO | WO00/71218 | | 11/2000 |
| WO | WO01/54041 | | 7/2001 |
| WO | WO 02/13932 | | 2/2002 |
| WO | WO03/083796 | | 10/2003 |
| WO | 2004/050201 | | 6/2004 |
| WO | WO2007/143575 | | 12/2007 |

OTHER PUBLICATIONS

Report of Telephone Conversation between Agent and Examiner from Foreign Application No. GB0616868.6, Jan. 24, 2007, 2 pages.
Combined Search and Examination Report from Foreign Application No. GB0616868.6, Oct. 12, 2006, 4 pages.
International Search Report and Written Opinion dated Feb. 15, 2008 from International application No. PCT/US2007/070255, 10 pages.
Examination Report from Australian Patent Application No. 2006208418, dated Jan. 9, 2008, 2 pages.
Declaration of Jeffrey Lindo dated Jul. 2000 and filed in Patent Office in connection with U.S. Patent No. 4,575,622.
Roulabette Booklet, pp. 1-42, 1979 (prior art).
International Search Report dated Dec. 11, 2002, from corresponding PCT application PCT/US02/09228 (4 pages).
Examination Reports dated Mar. 24, 2005, from related GB application GB0419052.6, 1 page.
Examination Reports dated Oct. 28, 2005, from related GB application GB0419052.6, 2 pages.
Examination Reports dated Jan. 27, 2006, from related GB application GB0419052.6, 1 page.
"PokerPro," Aristocrat Technologies Europe Ltd., 4 pages.
U.S. Office Action mailed Jan. 22, 2009 in U.S. Appl. No. 11/143,345.
U.S. Office Action mailed Aug. 5, 2009 in U.S. Appl. No. 11/143,345.
First Chinese Office Action mailed Mar. 6, 2009 in Application No. 200780028095.6.
Australian Statement of Grounds and Particulars rcv'd May 4, 2009 in relation to Patent Application No. 2006208418.
Second Chinese Office Action mailed Jun. 19, 2009 in Application No. 200780028095.6.
Third Chinese Office Action mailed Oct. 2, 2009 in Application No. 200780028095.6.
International Search Report dated Dec. 11, 2002 from Application No. PCT/US02/09228, 4 pgs.
U.S. Advisory Action mailed Nov. 4, 2004 in U.S. Appl. No. 10/112,967.
U.S. Examiner Interview Summary mailed May 7, 2004 in U.S. Appl. No. 10/112,967.
U.S. Interview Summary Record mailed Apr. 5, 2005 in U.S. Appl. No. 10/112,967.
U.S. Notice of Allowance mailed Jan. 26, 2005 in U.S. Appl. No. 10/112,967.
U.S. Office Action mailed Aug. 24, 2004 in U.S. Appl. No. 10/112,967.
U.S. Office Action mailed Jan. 14, 2004 in U.S. Appl. No. 10/112,967.
Australian Examiner's First Report mailed Feb. 15, 2006 in Application No. 2002306874.
Chinese Office Action mailed Sep. 20, 2010, in Application No. 200780028095.6.
Chinese Office Action mailed Feb. 25, 2011, in Application No. 200780028095.6.
International Preliminary Examination Report dated Jan. 21, 2004, from Application No. PCT/US02/09228.
International Preliminary Report on Patentability dated Dec. 10, 2008, from Application No. PCT/US2007/070255.

* cited by examiner

1292

1294

SILVER STAR CASINO TOURNAMENT VOUCHER

TOURNAMENT DATE / TIME: 04/15/02 / 11:00 PM
CASINO TOURNAMENT LOCATION: GOLD ROOM
TOURNAMENT NAME: MEGA MONEY
GAME TYPE: REEL
TRANSACTION DATE / TIME: 04/12/02 / 11:17:42

TOURNAMENT FEE PAID: $100.00
PLAYER ID: 5678
FLOAT MODE: CHOOSE ANY MACHINE
SESSION ID: 2368

1293

Figure 16C

1295

TOWERING CASINO TOURNAMENT VOUCHER

TOURNAMENT DATE / TIME: 12/12/02 / 1:00 PM
CASINO TOURNAMENT LOCATION: BLUE ROOM
TOURNAMENT NAME: LOTS OF CASH
GAME TYPE: REEL
TRANSACTION DATE / TIME: 12/11/02 / 10:13:22

TOURNAMENT FEE PAID: $40.00
PLAYER ID: JOE SMITH
FLOAT MODE: CHOOSE ANY MACHINE
SESSION ID: 4751

Figure 16D

SIMULATING REAL GAMING ENVIRONMENTS WITH INTERACTIVE HOST AND PLAYERS

CROSS-REFERENCE TO RELATED APPLICATIONS

This application is a continuation in part of and claims priority from U.S. patent application Ser. No. 11/143,345, filed Jun. 2, 2005 now U.S. Pat. 7,753,790, which is a continuation and claims priority from U.S. patent application Ser. No. 10/112,967, filed Mar. 29, 2002, now U.S. Pat. No. 6,908,390, each of which is commonly assigned, and each of which is hereby incorporated by reference herein in its entirety and for all purposes.

BACKGROUND OF THE INVENTION

The U.S. Pat. No. 6,908,390 describes a gaming environment configured to allow a "gaming tournament" (or tournament) to be conducted by a person acting as a host for a tournament between a number of individuals and/or one or more groups of individuals (or players). By way of example, each player can use (or interface with) a computing system (e.g., via gaming unit or machine located on a casino floor) to effectively listen and/or see a person acting as the host of the gaming tournament. The host can also interface with a computing system (e.g., via a server or host computer) to input audio, visual, or text. The input received from the host can be provided to the players in a "live" manner as they engage in the tournament. The host can, for example, provide live commentary and additional rewards or incentives for the players as they play the tournament. By way of example, each player can use a gaming machine (or unit) located on a casino floor to sign up (or enroll) as an individual or sign up a number of individuals as a group for participatation in a gaming tournament. Players or groups of players can compete by playing one or more games that can be individually played on a gaming machine (e.g., slots, video poker, video blackjack). As the players compete in the tournament, they can see an image of the host and hear the voice of the host, for example, via video and audio output (e.g., displays, speakers) configured for the gaming machines on the casino floor. In this situation, the host can interact with the players both visually and aurally to effectively conduct the tournament as a real host would in a real live gaming environment such as when a number of players and a host gather at the same location and compete in a game or tournament conducted by a person acting as the host.

SUMMARY OF THE INVENTION

Broadly speaking, the invention relates to techniques for simulating real (or live) gaming environments. It will be appreciated that the techniques can be used to effectively implement a virtual gaming environment that simulates a real (or live) gaming environment where players can see, hear, and interact with each other as well as a host that conducts a game (e.g., poker, blackjack). The virtual gaming environment effectively connects a number of people together by connecting a number of computing devices (e.g., personal computers, gaming machines, PDAs, mobile phones, interactive TV). Each person participating in the game can use the computing device to input (as input) or receive (as output) audio, video, or text via various input/out devices (e.g., microphone, speaker, camera, display, keyboards).

In one embodiment, the virtual gaming environment provides a view of a virtual gaming area (e.g., a virtual gaming table) where a number of individuals (or persons) participating in the game (participants) and host are effectively represented. In this virtual gaming area, each person participating in the game can, for example, be represented by an image (e.g., a "live" video-feed of a person, an icon, or a caricature). An image representing a participant can, for example, be displayed in the virtual gaming area while the person represented by the image is participating in the game. Each participant of the game can, for example, participate in the game actively (e.g., as a player), passively (e.g., as a back-bettor placing bets), or as an observer that merely observes the game. Similar, to a real gaming environment, each participant can stop participating or change how they participate in the game. By way of example, an active player can become a passive player, an observer can become an active player, a participant can leave the game, a new participant can join the game as an active player or observer, and so on. Generally, a participant can participate in a game anonymously (i.e., without revealing their true identify, image, or voice). However, to more closely simulate a real gaming environment, gaming room, or game table used for playing certain games (e.g., a poker game), each participant may be required to provide real audio and video feeds. In any case, a view of a virtual gaming area can be effectively displayed for each of the participants. Further, audio and video input received from each computing system associated with a participant can be forwarded to one or more selected participants.

In one embodiment, audio input received from each participant is effectively forwarded to all other participants in a "full-duplex" audio mode that more closely simulates a live gaming environment where people can talk at the same time (e.g., talk over each other). In another embodiment, a virtual camera pans the gaming environment as the game progresses (e.g., from one active participant to the next as they take turn to bet in a poker game). The virtual camera can effectively zoom or focus on the image of a participant to provide a relatively larger image for the participants. In another embodiment, a participant can zoom or focus to the image of other participants at will, despite the default panning or zooming action (or motion) of the virtual camera.

The invention can be implemented in numerous ways, including a method, an apparatus, a computer readable medium, a computer system, a gaming machine (or unit), or a signal embodied in a carrier wave. Several embodiments of the invention are discussed below.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which:

FIG. 16C is an exemplary tournament voucher ticket that may be used by an anonymous group player enrolled in a gaming tournament while located at a suitable gaming unit of choice during performance of the main routine.

FIG. 16D is an exemplary tournament voucher ticket that may be used by a non-anonymous group player enrolled in a gaming tournament while located at a suitable gaming unit of choice during performance of the main routine.

DETAILED DESCRIPTION OF THE INVENTION

Figure 1:
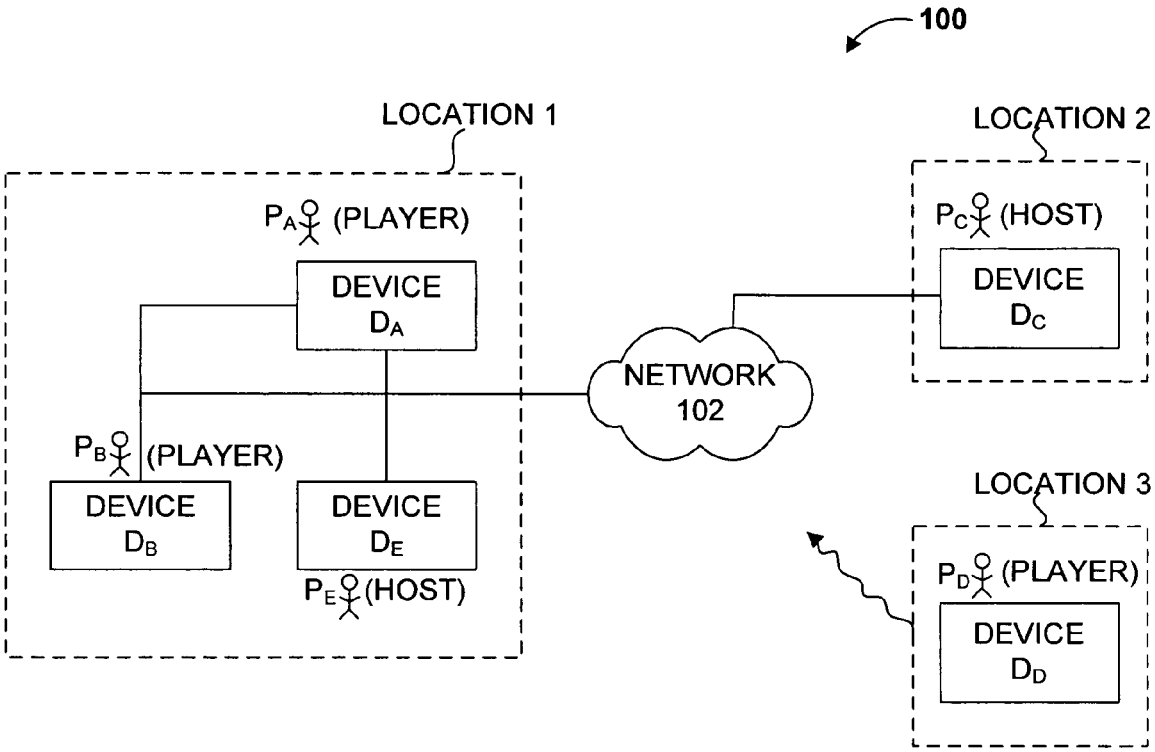
FIG. 1 depicts a number of individuals or persons ($P_A$, $P_B$, $P_C$, $P_D$ and $P_E$) interfacing with a number of computing devices ($D_A$, $D_B$, $D_C$, $D_D$, and $D_E$) in accordance with one embodiment of the invention.

As noted in the background section, the gaming environment described by the U.S. Pat. No. 6,909,390 is highly useful because, among other things, it can simulate a live gaming environment where a live host conducts a game or tournament between a number of individuals or groups (players). The players can use various computing systems in order to participate in a game or tournament effectively hosted by a live person. More generally, techniques for simulating real gaming environments would be highly useful. In a real gaming environment, typically, a number of individuals (or players) come together in person to participate (or play) in a game (e.g., poker, blackjack) at a particular location (e.g., casino, home of a player, public place). The players can see, hear, and interact with each other. Often, at a table game (e.g., poker, blackjack) played in a casino, a person acting as the host (e.g., a dealer) conducts the game for the players. Given that modern computing and communication systems allow people in remote locations to communicate with each other, it is highly desirable to allow people in distant locations to play games in a manner that more closely resembles a real gaming environment where players and host(s) interact with each other visually and aurally.

Accordingly, the present invention pertains to techniques for simulating real (or live) gaming environments. It will be appreciated that the techniques can be used to effectively implement a virtual gaming environment that simulates a real (or live) gaming environment where players can see, hear, and interact with each other as well as a host that conducts a game (e.g., poker, blackjack). The virtual gaming environment effectively connects a number of people together by connecting a number of computing devices (e.g., personal computers, gaming machines, PDAs, mobile phones, interactive TV). Each person participating in the game can use the computing device to input (as input) or receive (as output) audio, video, or text via various input/out devices (e.g., microphone, speaker, camera, display, keyboards).

In one embodiment, the virtual gaming environment provides a view of a virtual gaming area (e.g., a virtual gaming table) where a number of individuals (or persons) participating in the game (participants) and host are effectively represented. In this virtual gaming area, each person participating in the game can, for example, be represented by an image (e.g., a "live" video-feed of a person, an icon, or a caricature). An image representing for a participant can, for example, be displayed in the virtual gaming area while the person represented by the image is participating in the game. Each participant of the game can, for example, participate in the game actively (e.g., as a player), passively (e.g., a back-bettor placing bets), or as an observer that merely observes the game. Similar, to a real gaming environment, each participant can stop participating or change how they participate in the game. By way of example, an active player can become a passive player, an observer can become an active player, a participant can leave the game, a new participant can join the game as an active player or observer, and so on. Generally, a participant can participate in a game anonymously (i.e., without revealing their true identify, image, or voice). However, to more closely simulate a real gaming environment, gaming room, or game table used for playing certain games (e.g., a poker game), each participant may be required to provide real audio and video feeds. In any case, a view of a virtual gaming area can be effectively displayed for each of the participants. Further, audio and video input received from each computing system associated with a participant can be forwarded to one or more selected participants.

In one embodiment, audio input received from each participant is effectively forwarded to all other participants in a "full-duplex" audio mode that more closely simulates a live gaming environment where people can talk at the same time (e.g., talk over to each other, several people can talk at the same time). In another embodiment, a virtual camera pans the gaming environment as the game progresses (e.g., from one active participant to the next as they take turn to bet in a poker game). The virtual camera can effectively zoom or focus on the image of a participant to provide a relatively larger image for the participants. It will be appreciated that the virtual camera can, for example, focus or zoom on a three-dimensional (3-D) image (or scene) that has been generated based on a 3-D imagining (or graphics) model (or world) using 3-D image (or graphics) processing techniques known in the art. In addition, a participant can zoom or focus to the image of other participants at will, despite the default panning or zooming action (or motion) of the virtual camera.

Embodiments of these aspects of the invention are discussed below with reference to FIGS. 1-27. However, those skilled in the art will readily appreciate that the detailed description given herein with respect to these figures is for explanatory purposes as the invention extends beyond these limited embodiments.

FIG. 1 depicts a number of individuals or persons ($P_A$, $P_B$, $P_C$, $P_D$ and $P_E$) interfacing with a number of computing devices ($D_A$, $D_B$, $D_C$, $D_D$, and $D_E$) in accordance with one embodiment of the invention. As suggested by FIG. 1, these persons can be in different geographical locations (Location 1, Location 2, and Location 3), but can effectively communicate by interfacing with the computing devices ($D_A$, $D_B$, $D_C$, $D_D$ and $D_E$) via a network 102. More particularly, persons $P_A$, $P_B$ and $P_E$ can be located in the same location (e.g., a casino floor in Las Vegas) but may not necessarily be in visual or aurally contact with each other in person. Person $P_C$ in location 3 can, for example, be in a location that is several hundred miles away (e.g., another city or country) with respect to either or both locations 1 and 2. Similarly, person $P_D$ at location 3 can, for example, be in a different city or town. However, person $P_D$ can connect or be connected to the network 102 wirelessly using a mobile wireless device (e.g., mobile phone, laptop). Note that in each example provided here, additional players beyond those illustrated may be present/participate. Actual examples are simplified for illustration. For example, FIG. 1 may involve hundreds or thousands of players. Further, a poker game may include 10 players or more. It should also be noted that one or more of the individuals or persons ($P_A$, $P_B$, $P_C$, $P_D$ and $P_E$) can be effectively replaced, for example, by a software agent. In general, computer program code can be used to simulate a participant, as will be appreciated by those skilled in the art. However, for simplicity, individuals or persons are used to demonstrate various embodiments of the invention below.

It will be appreciated that a real (or live) gaming environment can be simulated and effectively provided for individuals or persons depicted in FIG. 1 ($P_A$, $P_B$, $P_C$, $P_D$ and $P_E$) even though they may not be in visual or aurally contact with each other and located thousands of miles away from each other. In this simulated gaming environment, they can participate in a game as if they were gathered in the same location (e.g., a gaming table in a casino, or a casino floor, or home of person $P_A$). Moreover, similar to a real (or live) gaming environment where a number of people come together, for example, at a poker table to play, the persons depicted in FIG. 1 can communicate with each other via audio and video transmitted via network 102, thereby allowing them to effectively see and hear each other in a "live" manner. Furthermore, it will be appreciated that similar to a real (or live) gaming environment of a casino, the person $P_C$ can act as the host (e.g., dealer for poker or blackjack) and conduct the game. The host (person $P_C$) can also provide live commentary and additional rewards incentives. It should be noted that host $P_C$ can be a virtual host effectively provided by a software agent. The virtual host can, for example, communicate by recorded messages that are provided based on the logic implemented by computer program code. In general, the host can make the game feel more like a game played in a real (or live) gaming environment. The players ($P_A$, $P_B$ and $P_D$) can also interact with the host and each other in order to more closely simulate a live gaming environment where people gather together, for example, at a casino to actively or passively participate in a game or just observe a game being played. In addition to the commentary and incentives provided by the host, sounds of a real gaming environment can be provided to simulate the sounds (e.g., the background sound) of a real gaming environment (e.g., a casino). These sounds can be effectively transmitted in real time (or live) as they occur in a real gaming environment (e.g., a casino) or prerecorded sounds, or a combination of live and prerecorded sounds.

Figure 2:
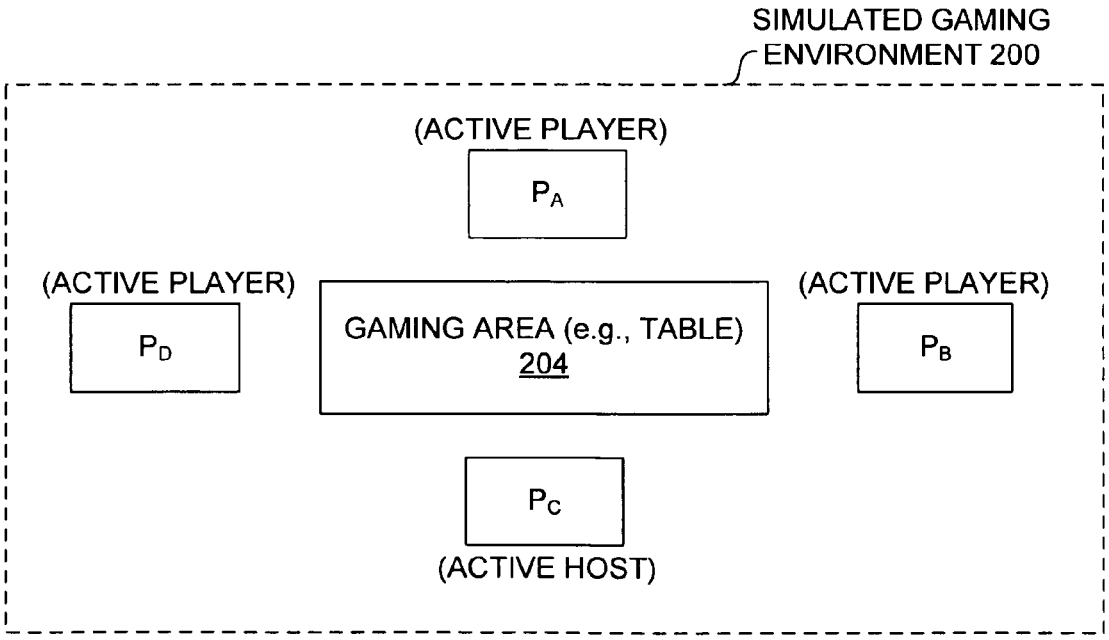
FIG. 2 depicts a simulated gaming environment 200 provided for a number of the individuals (or persons) (also depicted in FIG. 1) in accordance with one embodiment of the invention.

To further elaborate, FIG. 2 depicts a simulated gaming environment 200 provided for a number of the individuals (or persons) (also depicted in FIG. 1) in accordance with one embodiment of the invention. In the gaming environment 200, persons $P_A$, $P_8$, $P_C$, and $P_D$ (also shown in FIG. 1) participate in a game as active players situated in a virtual gaming area 204 (e.g., a table for a blackjack or poker game). In this example, person $P_A$, $P_B$, and $P_D$ are active players. Person $P_C$ also participates actively in the game as a host (e.g., dealer in a blackjack or a poker game). In effect, each person represented at the gaming area 204 ($P_A$, $P_B$, $P_C$, or $P_D$) can be presented with a view of the gaming area 204. This view can, for example, represent the view that a player or host would have if actually situated at a real gaming table.

Figure 3:
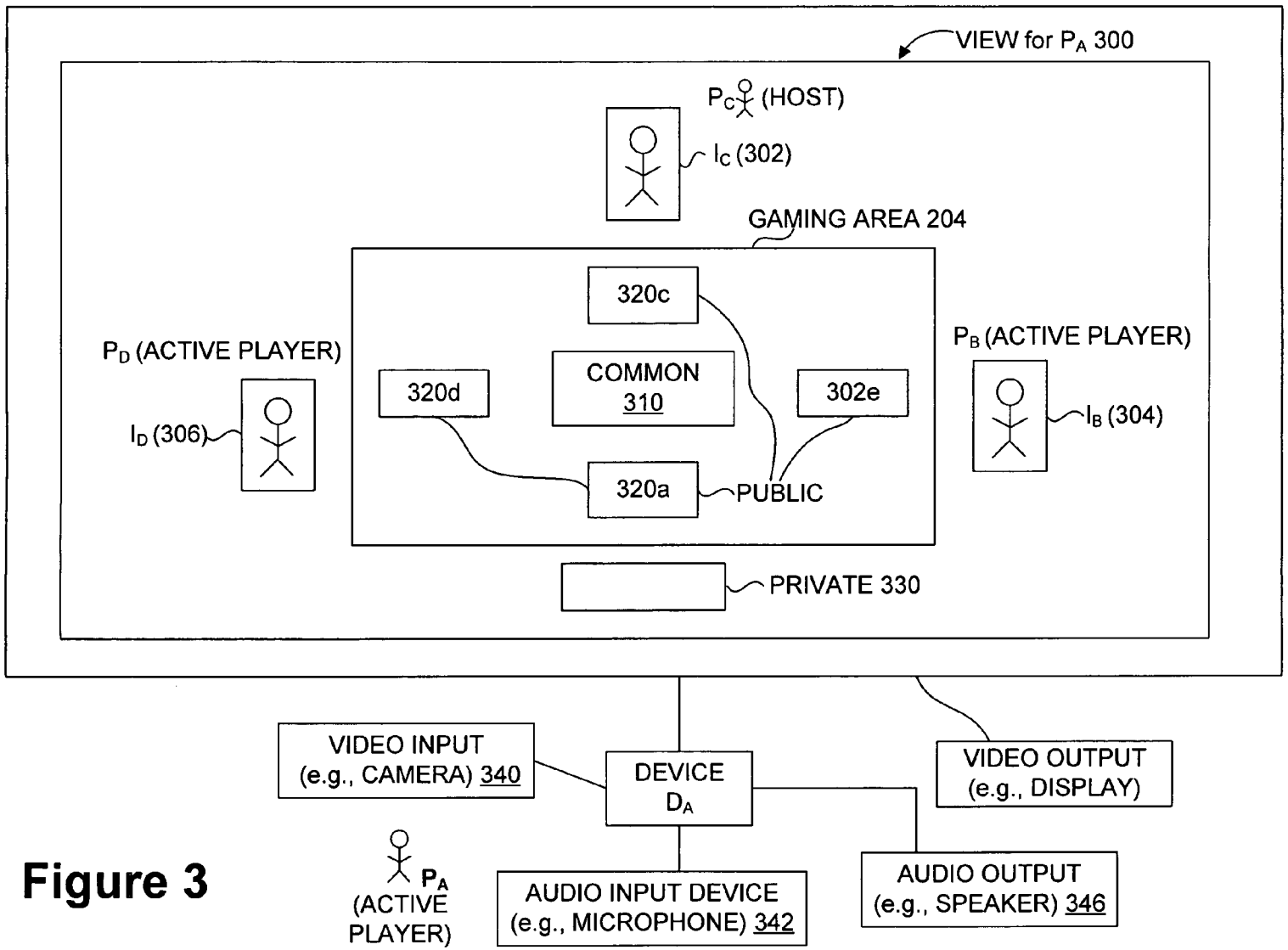
FIG. 3 depicts a view (or perspective) that can be provided for a participant of a game in accordance with one embodiment of the invention.

To further illustrate, FIG. 3 depicts a view (or perspective) 300 that can be provided for a participant of a game in accordance with one embodiment of the invention. Referring to FIG. 3, the view 300 is depicted for an active player, namely, person $P_A$ (also depicted in FIG. 2 as an active player in the simulated gaming environment 202). As shown in FIG. 3, each of the other participants of the game, namely, persons $P_B$, $P_C$, and $P_D$ are represented by an image ($I_B$, $I_C$ and $I_D$). It will be appreciated that each of the images $I_C$ (302), $I_B$ (304) and $I_D$ (306) can, for example, be a live video feed, a still picture, a graphical symbol, or a caricature representing a person. In general, a graphical representation of a first participant can be provided in the view 300 and displayed on a display for viewing of a second participant. The display can, for example, be part of a gaming machine, or provided by or configured for a wireless device. Referring back to FIG. 3, it should be noted that the gaming area 204 can include a common area 310 where information or common objects (e.g., community cards, dice) can be effectively displayed for all the participants. Further, the view 300 can additionally include public areas (320) for displaying information or objects pertaining to individual players that are viewable by all (e.g., cards that have been faced up). It should also be noted that the view 300 can also include a private area 330 for displaying private information (e.g., down cards held by a player) for only the person $P_A$.

Generally, a simulated (or virtual) gaming table represents a gaming table used to play a table game. Examples of gaming table include without limitation: a poker game, a blackjack game, a roulette game, and a craps game. In general, a table game is any game that can be played using a table (gaming table) by a number of players. Additional exemplary simulated gaming tables depicted in accordance with various embodiments of the invention will be discussed below. However, referring now to FIG. 3, it should be noted that a similar view can be provided for other participants of the game (persons $P_B$, $P_C$, and $P_D$). In other words, a representation of the person $P_A$ can be provided in a view depicting the gaming area 204 for persons $P_B$, $P_C$, or $P_D$. In cases where a live feed or still picture is required, a video input 340 which can be video or still mages (e.g., camera or other image capture device) can receive video input from the person $P_A$. This video input (or feed) can then be presented to other participants $P_B$, $P_C$ and $P_D$ in their view of the gaming area 204. Similarly, audio input can be received via an audio input (e.g., microphone) 342 connected to or provided by the device $D_A$ used by person $P_A$. Audio can be output using an audio output device 346 (e.g., speaker, headphones). Other input/output devices can be provided to facilitate communication with other participants and/or connection to a simulated (or virtual) gaming environment. Accordingly, a real (or live) gaming environment can be effectively simulated in a virtual gaming environment where one participant can interact with other participants. It should also be noted that a person $P_C$ acting as the host conducting the game can also interact with other participants (players) via input and output devices similar to that depicted in FIG. 3 for person $P_A$. As such, a real and often exciting gaming environment can be effectively simulated for people that may be thousands of miles away from each other.

Figure 4:
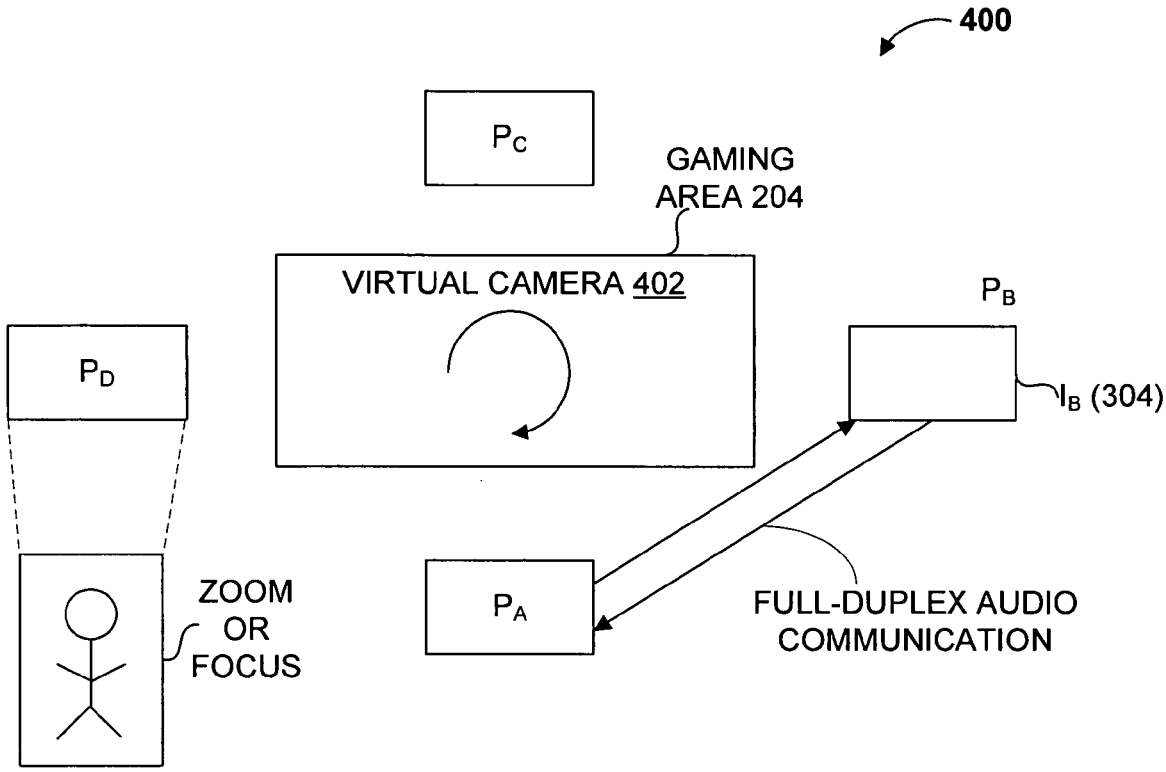
FIG. 4 depicts a simulated gaming environment in accordance with one embodiment of the invention.

FIG. 4 depicts a simulated gaming environment 400 in accordance with one embodiment of the invention. Referring to FIG. 4, a virtual camera 402 can effectively pan or scan the gaming area 204. The virtual camera 402 can also focus or zoom on a particular participant, for example, person $P_D$. By way of example, the virtual camera can focus or zoom on a card player in a game of poker when it is that card player's turn to act (e.g., call, bet, raise or fold). In other words, the virtual camera 402 can effectively zoom or focus on the image of person $P_D$ in order to display a relatively larger image of a participant for the other participants of the game. The panning or scanning of the virtual camera can, for example, be implemented as a default action, or it can be controlled by the host conducting the game where the host effectively zooms or focuses the virtual camera 402 on various participants of the game as deemed appropriate.

In one embodiment, participants can override the default or host controlled action of the virtual camera 402. By way of example, a person $P_B$ can effectively zoom or focus the virtual camera 402 onto a person $P_A$ even though another person $P_D$ would be in focus by default and/or host controlled action. In general, a participant can effectively zoom or focus on another participant's image by selecting (e.g., clicking) on the image representing another participant in simulated gaming environment.

It should be noted that audio communication can be provided in a "full-duplex" mode in accordance with one embodiment of the invention. Similar to a real gaming environment where people can talk over each other, audio feeds can be blended together and presented to each of the persons participating in the game as the "sounds" of the gaming area in order to give an even more realistic feel for the game. Additionally, the presence of a person acting as the host of the game can further enhance the gaming experience as the participants (e.g., active players) can also speak with the host in a "full-duplex" audio feed.

It will be appreciated that the virtual gaming area 204 (shown in FIGS. 2, 3 and 4) can also accommodate non-active (passive) participants (e.g., people who place bets on active players, or back-bettor), as well as observers that may be allowed to view a gaming area (e.g., a public gaming area) and/or move around various gaming areas similar to what would be allowed on a real casino floor.

Figure 5A:
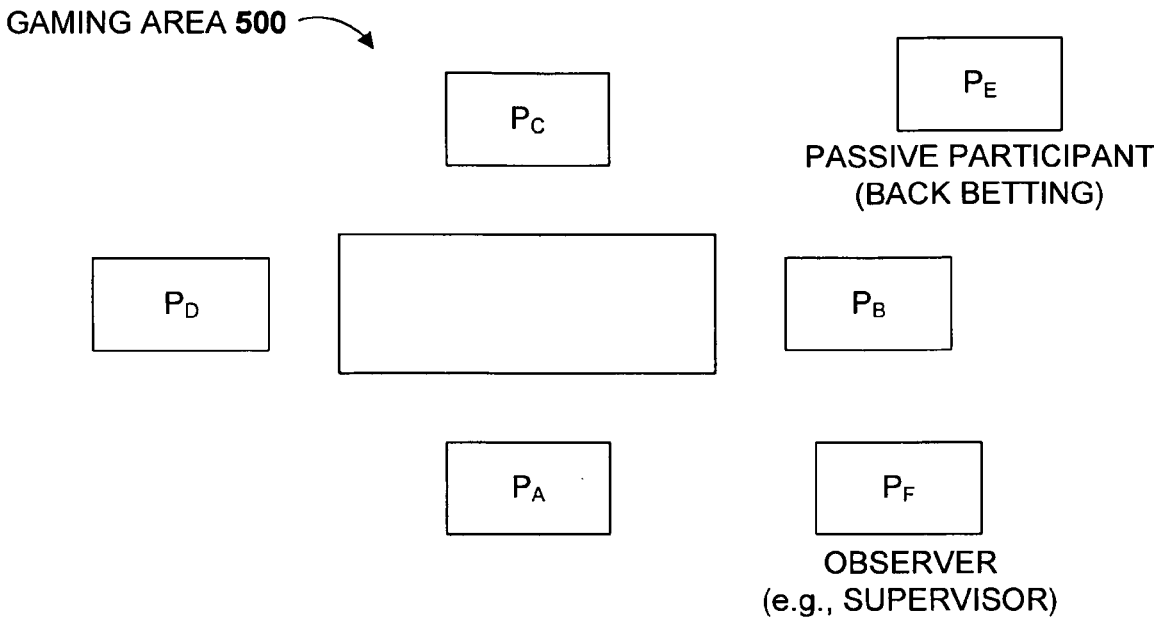
FIG. 5A depicts a gaming area where a passive participant and an observer passively participate in a simulated (or virtual) gaming area.

FIG. 5A depicts a gaming area 500 where a passive participant $P_E$ and an observer $P_F$ passively participate in a simulated (or virtual) gaming area 500. In other words, audio and video feeds can be effectively received from and sent to the persons $P_E$ and $P_F$ in a similar way as discussed above for the active participants $P_A$, $P_B$, $P_C$ and $P_D$.

Figure 5B:
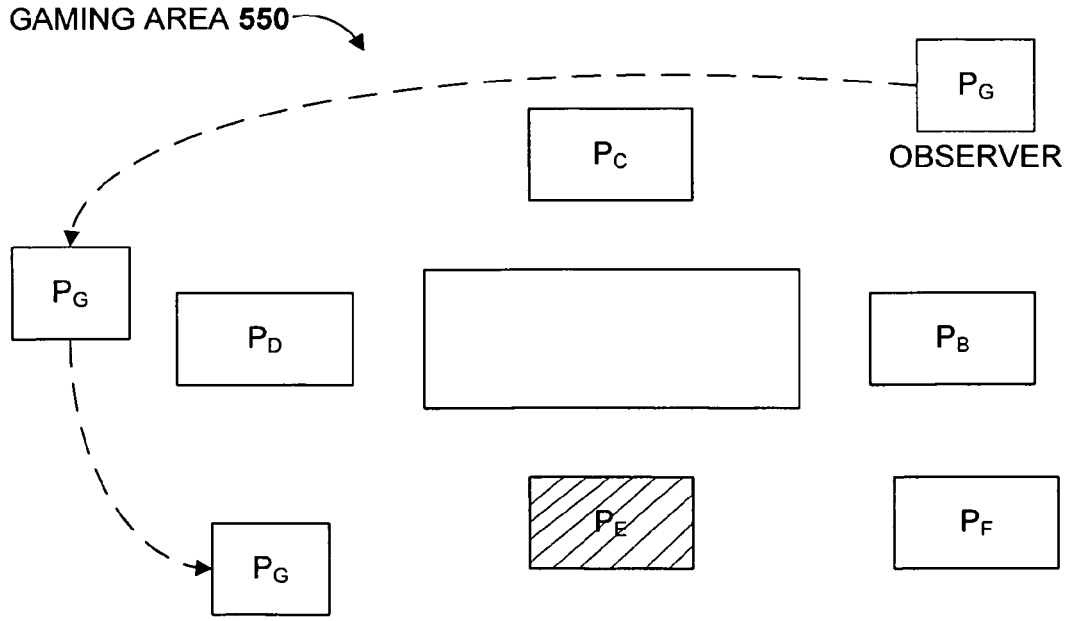
FIG. 5B depicts a view of a gaming area representing the gaming area of FIG. 5A after a person has left and another person has joined the game as an active player.

It will be appreciated that similar to a real gaming area (e.g., gaming table in a casino), passive participants or observers may become active participants of the game (e.g., join a game at a virtual gaming table). Referring now to FIG. 5B, a gaming area 550 represents the gaming area 500 (shown in FIG. 5A) after a person ($P_A$) has left and another person ($P_E$) has joined the game as an active player (e.g., joined a gaming table). It should also be noted that an observer $P_G$ has also become a participant in the gaming area 550. Similar to a live gaming area, the observer (person $P_G$) may be allowed to "walk" around the virtual gaming area. As the observer ($P_G$) "moves" around the virtual gaming environment, the view presented to the observer may be changed accordingly.

It should be noted that a participant can choose to remain anonymous if the gaming regulations or requirements allow. In such cases, the person who wishes to remain anonymous may choose text and/or a graphical representation (e.g., user name, icon, caricature) to present himself or herself to other participants. It will be appreciated that various virtual gaming areas can be designated in accordance with different requirements or recommendations as to anonymity of the participants (e.g., private area, public area with video or audio feed required, private area with video feed optional).

Figure 6:
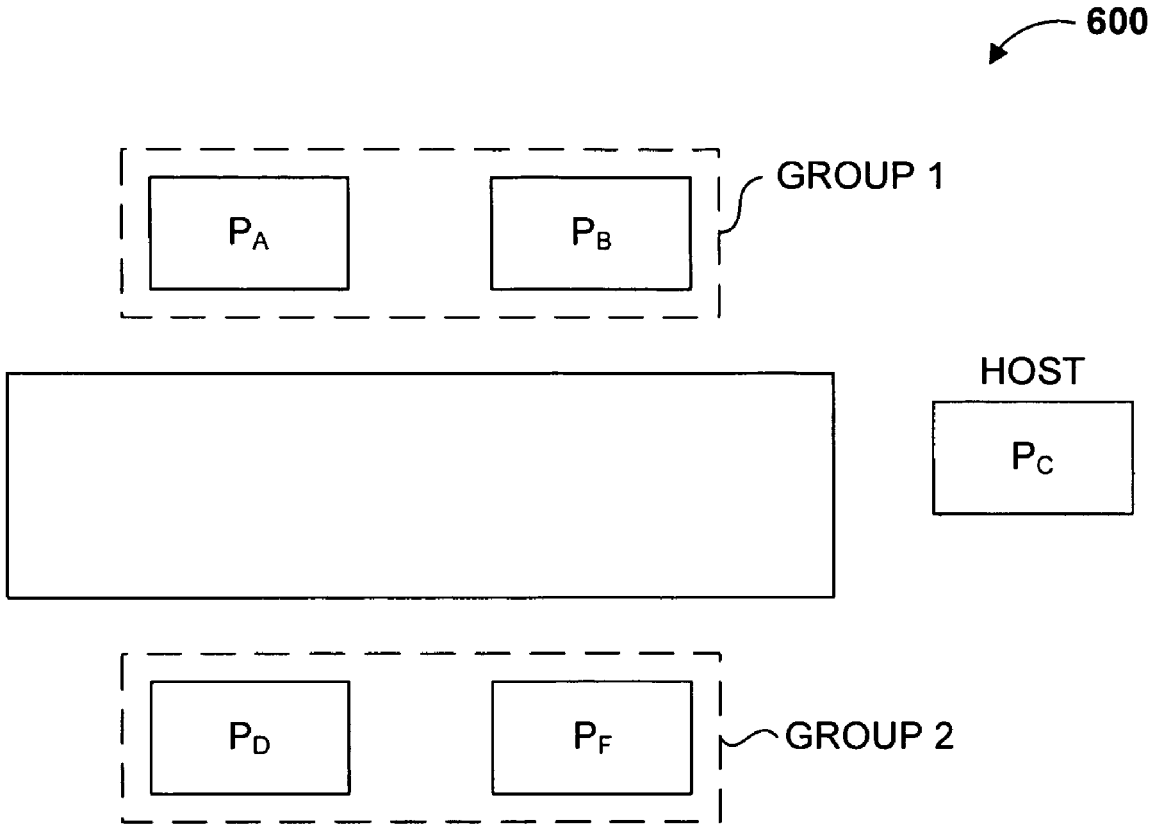
FIG. 6 depicts a virtual gaming area that supports a tournament game in accordance with one embodiment of the invention.

It should further be noted that the gaming area 204 (shown in FIGS. 2, 3 and 4) can also be used to support a "tournament" game where, for example, a group of players compete with another group of players. Referring to FIG. 6, a virtual gaming area 600 that supports a tournament is depicted in accordance with one embodiment of the invention. As shown in FIG. 6, persons $P_A$ and $P_B$ can, for example, be grouped in a group 1, and persons $P_D$ and $P_F$ can be grouped in a group 2. As such, group 1 and group 2, can compete with each other in tournament where they, for example, play against a person $P_C$ acting as a host (e.g., a blackjack dealer) and/or play against each other (e.g., in a card game against each other). By way of example, group 1 and 2 can play blackjack and the winner can be determined based on the score (or money earned) after a number of hands have been played. In general, one or more players can compete with one or more players in a "tournament" mode similar to that described by U.S. Pat. No. 6,908,390.

Figure 7A:
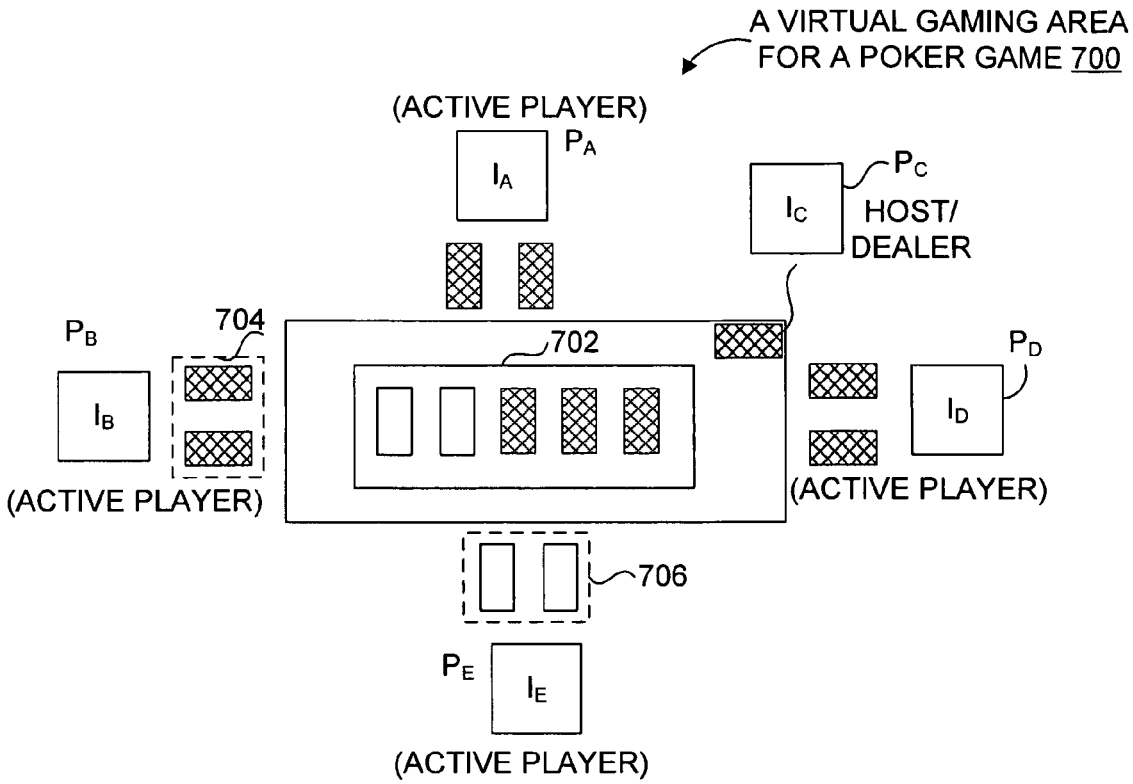
FIG. 7A depicts a virtual gaming area in accordance with one embodiment of the invention.

FIG. 7A depicts a virtual gaming area in accordance with one embodiment of the invention. More particularly, FIG. 7A represents a view 700 of gaming table for a poker game. The view 700 is a view depicted for a person $P_E$ participating as an active participant in a poker game. The poker game is between person $P_E$ and other active participants, namely, persons $P_A$, $P_B$ and $P_D$. It should be noted that a host/dealer, namely person $P_C$, also participates in the poker game. Note again the more players are possible. Each of the participants (including the host/dealer $P_C$) is represented by an Image I ($I_A$, $I_B$, $I_C$, $I_D$ and $I_E$). As noted above, each image can, for example, be a video feed, icon, or caricature at a given time. Also, a virtual camera (not shown) with a focus (or zoom) can be provided in a similar manner as noted above. Referring to FIG. 7A, community cards can be displayed in an area 702. Individual cards that a participant (or player) holds can be displayed in proximity of the image of the participant. For example, cards that person (or player) $P_B$ is holding can be represented in an area 704 as two cards that are faced down. It should be noted that in a view presented to a player ($P_E$), the cards for the player $P_E$ can be displayed faced up in the area 706 so that the person $P_E$ can see them.

Figure 7B:
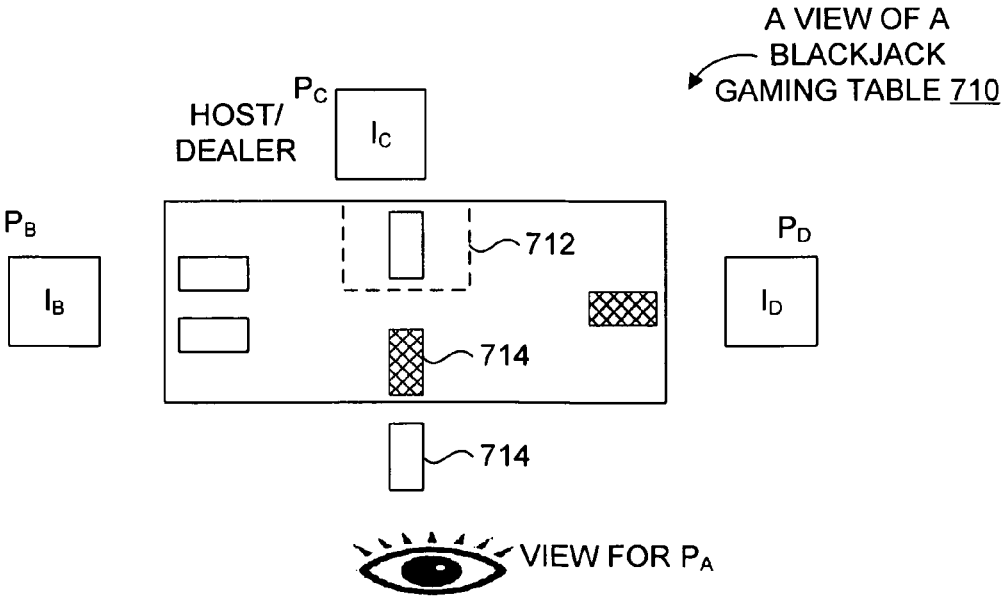
FIGS. 7B-7E depict views for virtual gaming tables (e.g., blackjack, roulette and/or craps) in accordance with one embodiment of the invention.

FIG. 7B depicts a view 710 for a virtual blackjack gaming table in accordance with one embodiment of the invention. View 710 is a view that can be presented, for example, to an active participant (or player) $P_A$. It should be noted that a host/dealer $P_C$ is also an active participant of the game of blackjack. The cards that the host/dealer $P_C$ plays or holds are displayed in an area 712 in proximity to an image $I_C$ provided to represent the host/dealer in the virtual gaming table 710. Other active participants, namely, persons $P_B$ and $P_D$ are respectively represented by images $I_B$ and $I_D$. A card 714 associated with a person $P_A$ may be shown effectively face down for players $P_B$ and $P_D$. However, the card 714 may be shown faced up in the view 710 for the person $P_A$.

Figure 7C:
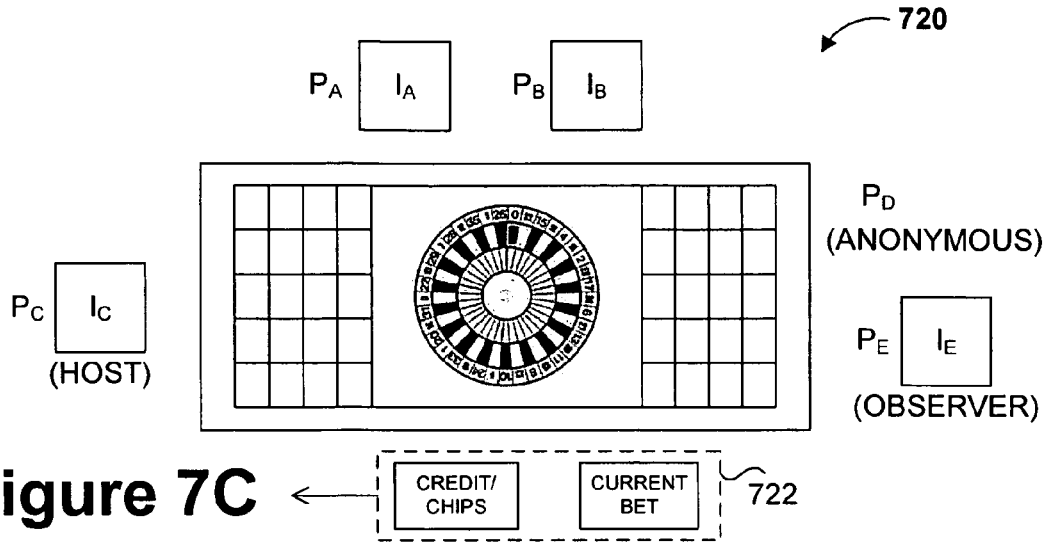

FIG. 7C represents a view of virtual roulette gaming table 720 in accordance with one embodiment of the invention. Referring to FIG. 7C, images $I_A$, $I_B$ and $I_C$ are respectively provided for active participants (or players) $P_A$ and $P_B$, and the person $P_C$ acting as the host of the roulette game. As shown in FIG. 7C, an image of an observer $I_E$ may also be shown in the view 720 and presented to active participants $P_A$ and $P_B$. Information (e.g., current bet, credit, chips) is displayed in an area 722 in the view provided for the player. It should be noted that person $P_D$ may play in an anonymous mode where a true image is not shown. Instead, the player $P_E$ can, for example, be represented by an icon or caricature.

Figure 7D:
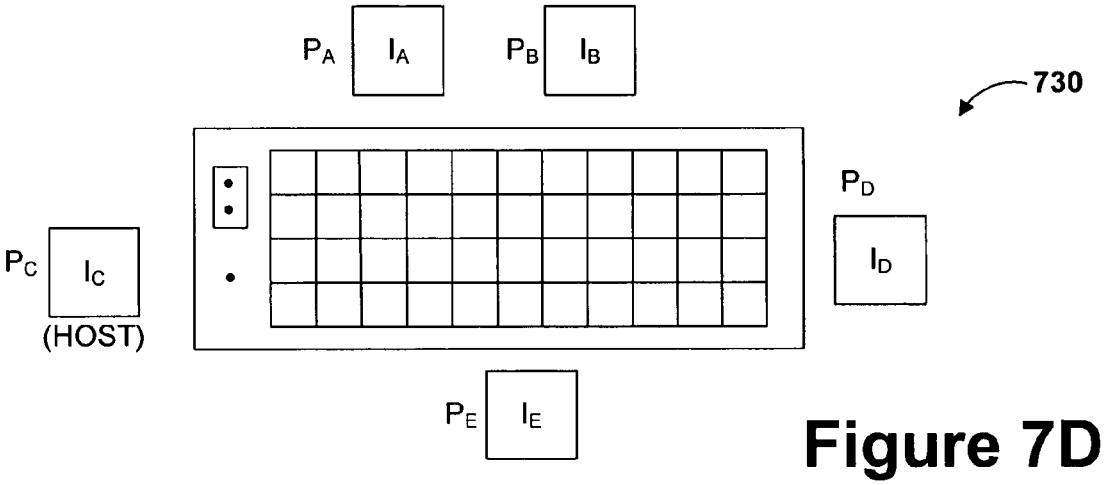
Figure 7E:
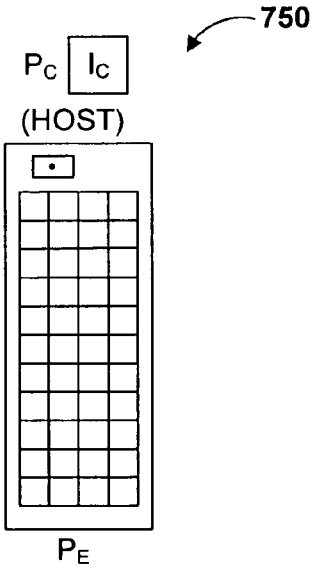

FIG. 7D depicts a view 730 of a virtual gaming table for a game that can be played with dice. As suggested by FIG. 7D, a person $P_E$ can have the option to see his or her image as presented to others in the view 730. Referring now to FIG. 7E, the view 750 represents the view 730 (shown in FIG. 7D) after a rotation has been made in the view provided for person $P_E$. This rotation can, for example, be made when it is the person's ($P_D$'S) turn to throw the dice.

In view of the few simplified examples provided above, it will be appreciated that a virtual gaming environment can effectively simulate any game played in a real (or live) gaming environment in accordance with the invention.

Figure 8A:
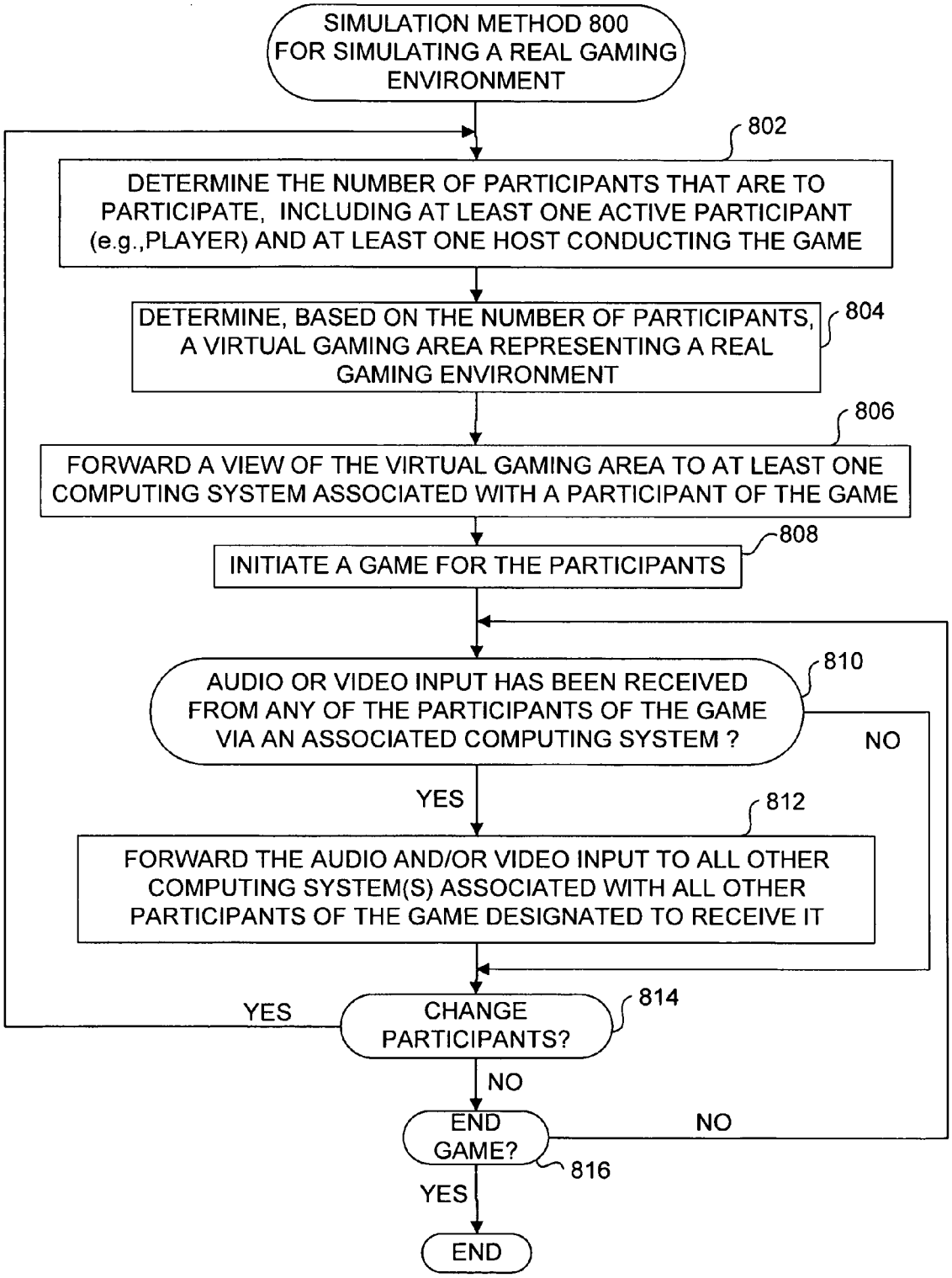
FIG. 8A depicts a simulation method for simulating a real gaming environment in accordance with one embodiment of the invention.

FIG. 8A depicts a simulation method 800 for simulating a real gaming environment in accordance with one embodiment of the invention. The simulation method 800 can, for example, be used by a computing system that acts as a server (or host) to a number of other computing systems acting as clients. Initially, the number of participants that are to participate in playing the game is determined (802). Each participant can interface with a computing system that, for example, acts as a client requesting services provided by a server. Typically, the participants include at least one active participant (e.g., player) and at least another person acting as the host conducting the game. It should be noted that the participants can, for example, also include persons that do not actively participate (e.g., a back-bettor placing back-bets) and/or observers that merely observe the game.

Next, a virtual gaming area (e.g., gaming table) is determined (804). Typically, the gaming area is determined, based on the number of participants in the game. Thereafter, a view of the virtual gaming area is forwarded (806) to at least one computing system associated with a participant of the game, allowing the participant to view the gaming area.

Figure 8B:
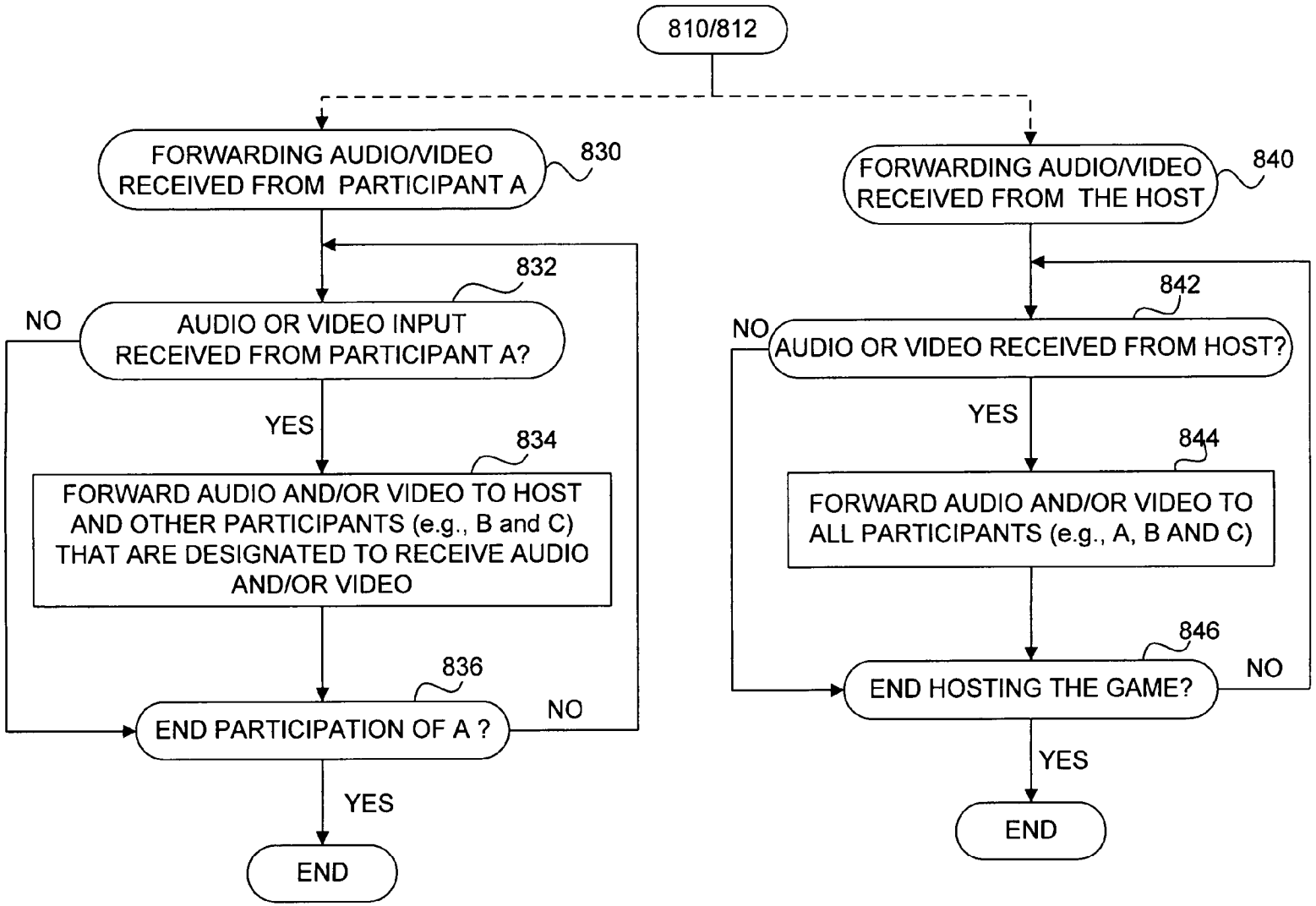
FIG. 8B depicts a method for determining whether audio and/or video input has been received from any of the participants of the game and forwarding of the input in accordance with one embodiment of the invention.

After the view of the gaming area has been forwarded (806), the game can be initiated (808) for the participants. Next, it is determined (810) whether audio and/or video input has been received from any of the participants. Audio or video input can be received via a computing system used by a participant. Again, it should be noted that the participants include a person acting as the host of the game. As such, in addition to the players, audio/video input can also be received from the host. In any case, if it is determined (810) that input has been received from a participant of the game (e.g., an active participant, a host, non-active or passive participant, an observer), the audio and/or video input is forwarded (812) to all other computing systems associated with all other participants of the game that are designated to receive it. FIG. 8B depicts in greater detail determining (810) whether audio or video input has been received from any of the participants of the game and forwarding (812) of any input. However, referring back to FIG. 8A, after input has been forwarded (812), it is determined whether to change the participants (e.g., a new participant is to join, an active participant is to leave the game). Accordingly, if it is determined (814) to change the participants, the number of the participants can be determined (802) and the simulation method 800 proceeds in a similar manner. However, if it is determined not to change the participants, it is determined (816) whether to end the game. If it is determined (816) not to end the game, it is determined (810) whether audio or video input has been received from any of the participants. In effect, the simulation method 800 can forward (812) audio and/or video input received from a first participant to all other designated participants of the game until it is determined (816) to end the game. The simulation method 800 ends when it is determined (816) to end the game.

Referring back to FIG. 8A, it will be appreciated that the audio and/or video can be forwarded (812) in a "full duplex" mode where audio and/or video received from each of a plurality of participants, including a host, is forwarded to all other participants of the game in a manner that simulates a live conversation.

Referring now to FIG. 8B, audio and/or video received from a participant A and a host are forwarded independently (e.g., in "full-duplex" mode). Although FIG. 8B only depicts forwarding audio/video input received from a participant A (830) and a host (840), it will be appreciated that audio and/or video can be received from other participants (e.g., B and C) and forwarded independently. Referring back to FIG. 8B, if it is determined (832) that audio or video input is received from a participant, namely, participant A, the audio/video input is forwarded (832) to the host and all other participants that are specifically designated to receive audio and/or video input from the participant A, or any participant in general. Next, it is determined (836) whether to end participation of the participant A. If it is determined (836) to end participation of the participant A, the forwarding (830) of the audio/video input received from the participant A ends. However, if it is determined (836) not to end participation of the participant A, it is determined (832) whether audio or video input is received from the participant A. In effect, as long as the participant A participates in the game, any audio and/or video input received from the participant A is forwarded to the host and/or other participants designated to receive audio and/or video input from the participant A. If the participant A ends participation, forwarding (830) of the audio/video input ends.

FIG. 8B also depicts forwarding (840) audio/video input received from the person acting as the host to other participants that are designated to receive audio and/or video input from the host. Similar to forwarding audio/video input received from the participant A (830), it is determined (842) whether audio or video input has been received from the host, so that it can be forwarded (844) to other participants designated to receive audio/video input from the host of the game. In effect, audio and/or video received from the host is forwarded (844) to all participants that are to receive audio and/or video input from the host, until it is determined (846) to end hosting the game. Forwarding of the audio/video input received from the host (840) ends when it is determined (846) to end hosting the game.

FIGS. 8A and 8B depict forwarding audio or video received as input (e.g., a video feed, or still picture) from a computing system associated with a person. However, more generally, a graphical image representing a participant can be forwarded to other participants. Further, the graphical image can be selected for a participant without requiring the participant to select an image or provide any input in that regard. As such, a graphical representation representing a participant can, for example, be a caricature, icon, selected by, or selected for, a participant. In general, a graphical representation may be in any form, including multiple video streams, animations using 2 or 3 dimensional graphics. Furthermore, the image may vary widely, for example, in terms its resolution, or of the frames per second (e.g., vary from less than 1 frame to 30 frames or more per second). Also, the quality of the images may vary for various features and/or at various times (e.g., the image and/or face of one person may be presented with at higher frame rates and/or resolutions when it his or her turn to make a bet). To further illustrate, the following example uses still images and a video feed (or stream) to demonstrate a method 900 for displaying an image of a participant in a virtual gaming area. However, it will be understood that numerous other forms and combinations can be used to represent an image.

Figure 9:
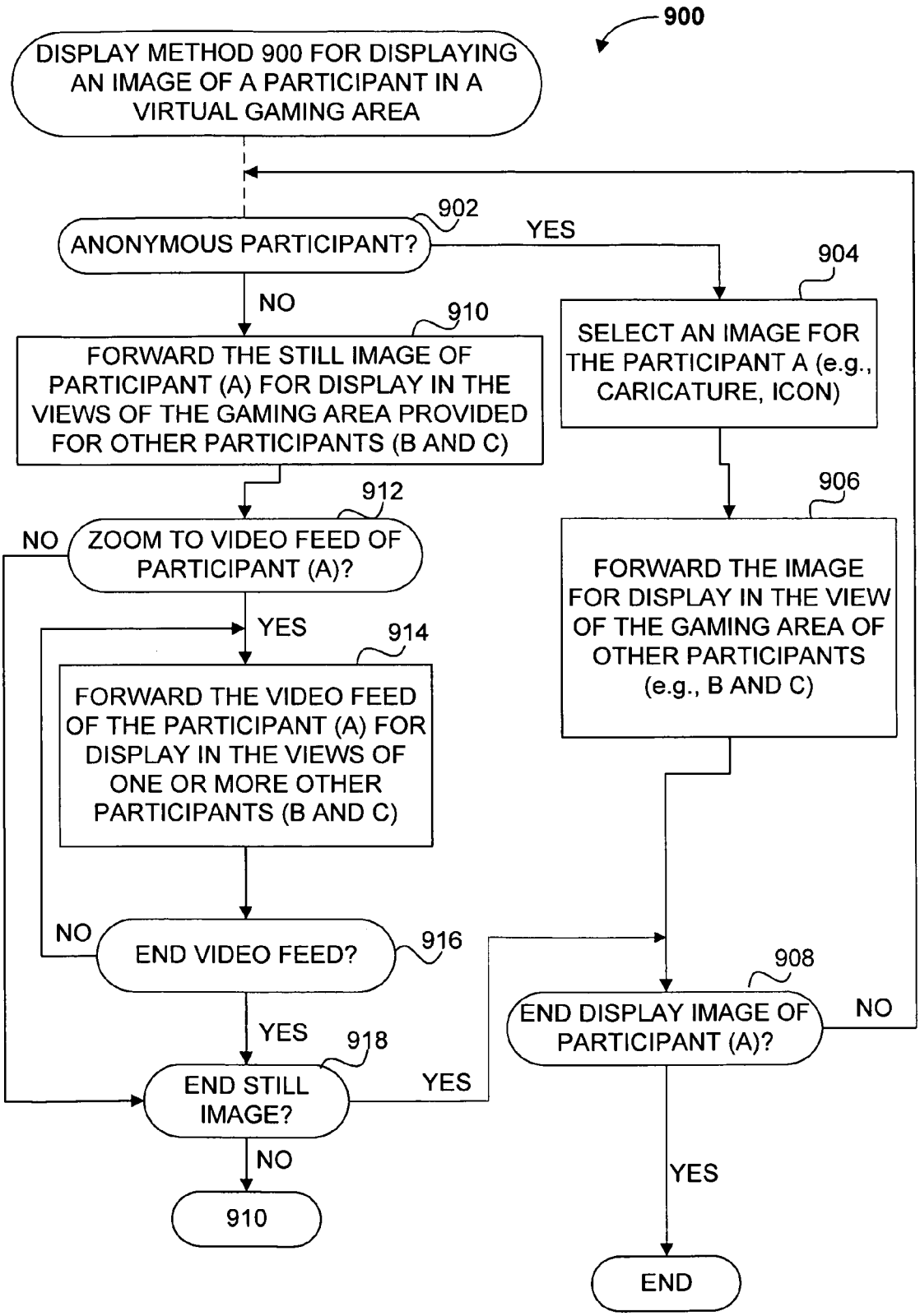
FIG. 9 depicts an exemplary method for displaying an image of a participant in a virtual gaming area in accordance with one embodiment of the invention.

FIG. 9 depicts an exemplary method 900 for displaying an image of a participant in a virtual gaming area in accordance with one embodiment of the invention. Initially, it is determined (902) whether the participant is an anonymous participant. Accordingly, an image representing the participant (e.g., caricature, icon) can be selected (904) and forwarded (906) for display in the view of the virtual gaming area of other participants (e.g., B and C). Thereafter, it is determined (908) whether to end the display of the image of the participant (A), and the display of the image of the participant (900) can accordingly end. However, if it is determined not to end the display of the image of the participant (A), it is effectively determined (902) whether the participant is still to remain anonymous.

On the other hand, if it is determined (902) that the participant is not (or is not to remain) anonymous, a still image of the participant (A) is forwarded (910) for display in views presented to other participants (e.g., B and C). Next, it is determined (912) whether to zoom to a video feed of the participant (A). By way of example, another participant (e.g., B) can effectively request to zoom into a larger image of the participant (A) which can be provided as a live video feed. In any case, if it is determined (912) to zoom to the video feed of the participant (A), the video feed of the participant (A) is forwarded (914) for display in the views provided for one or more other participants (e.g., B and C). Subsequently, it is determined (916) whether to end the video feed. In effect, the video feed can continue until it is determined (916) to end the video feed. If it is determined (916) to end the video feed, it is determined (918) whether to end displaying the still image. In effect, the display of the still image can continue until it is determined (918) to end display of the still image or it is determined (912) to zoom to a video feed that can, for example, provide a live video of the participant (A). If it is determined to end display of the still image of the participant (A), it is determined (908) whether to end displaying the image of the participant (A). If it is determined (908) not to end displaying the image of the participant (A), it is determined (902) whether the participant is anonymous. In other words, it can be determined (902) whether a participant is to be, remain, or become anonymous. Thereafter, the image of the participant (A) can be displayed in a similar manner as discussed above.

It should be noted that the determination (908) of whether to end displaying of the image of the participant (A) can, for example, be made based on whether the participant (A) has ended his or her participation, or based on a request or input received from the participant requesting to end the display of his or her image. In general, a determination can also be made based on one or more criteria (e.g., a programmable condition or event). Similarly, it should also be noted that the determination (902) of whether the participant (A) is an anonymous participant can, for example, be made based on a request or input received from a participant, or other criteria such as the type of the gaming area (e.g., gaming table for face to face poker would require audio and video feeds). The displaying of the image of the participant (A) in a virtual gaming area (900) can end following a determination (908) to end the display or it is determined (902) whether the participant is to be anonymous. The method 900 ends when it is determined (908) to end display of the image of the participant (e.g., when it determined that the participation of the participant has ended).

As noted above, a participant can, for example, choose to display a video feed, a still picture, or a representation of himself or herself in a virtual gaming area (e.g., virtual gaming table). More generally, each participant can, for example, choose an image and/or audio (e.g., voice of the participant) for presentation in the virtual gaming environment. Typically, the image and/or audio represents the participant in a virtual gaming environment. Further, a virtual gaming environment can be configured to allow each participant to decline or effectively turn off the image and/or audio presentation of other participants. Typically, audio provided is the actual voice of the participants in order to more closely simulate a real gaming environment where people gather around a gaming area and interact with each other. However, it is possible to provide audio in an anonymous manner (e.g., selected sound bytes, or recorded messages, such as, "call," "fold"). Audio can be provided in a similar manner as depicted in FIG. 9 with respect to displaying an image (900), for example, sound byte, or recorded message can be played for other participants when a participant (A) participates anonymously. Also, it is possible to configure a virtual gaming environment so that a first participant can effectively focus on the voice of a second participant. By way of example, live audio feed of a participant (A) can be provided in higher volumes relative to other participants, or audio of other players may be effectively turned off or lowered for a participant (B) who has chosen to focus on what participant (A) has to say. However, if close simulation of a live gaming environment is the goal, the audio feed of a participant (A) is provided to all other participants as would be in a real (or live) gaming environment. As such, the relative distance of the participants as situated in a virtual gaming area can be considered so that, for example, audio feed of a participant (A) is provided in higher volumes to those participants that are situated closer than others.

As also noted above, one or more persons can participate as individuals or as a group in a tournament (or competition) between individuals or groups of participants. Typically, the virtual gaming environment simulates a game that can be played when participants gather in a gaming area (e.g., poker table, blackjack table). However, it should be noted that the techniques described above can also be used to provide a virtual gaming environment that allows group participation in games that are typically played by a single person individually. One example is a gaming machine conventionally used by a single person to play a game individually. The gaming machine allows an individual to play a variety of games (e.g., poker, blackjack, slots, keno, bingo). As noted above, a gaming tournament can be conducted by a live host. The gaming tournament can, for example, be between several participants that each use a gaming unit (or machine) configured for tournament play. U.S. Pat. No. 6,908,390 describes enrollment processes for allowing players (or participants) to enroll in a tournament using various modes (e.g., an anonymous mode), and similar methods can be used to enroll a participant for a game played in a virtual gaming area (or environment) described above. In accordance with one embodiment of the invention, a gaming machine (or unit) can be used by a person to participate in playing a game in a virtual gaming environment. It will be appreciated that this gives the person the choice to either engage in various games individually or participate in playing a game or tournament with other persons using the same gaming machine (or unit) which can be provided in a casino.

Figure 10:
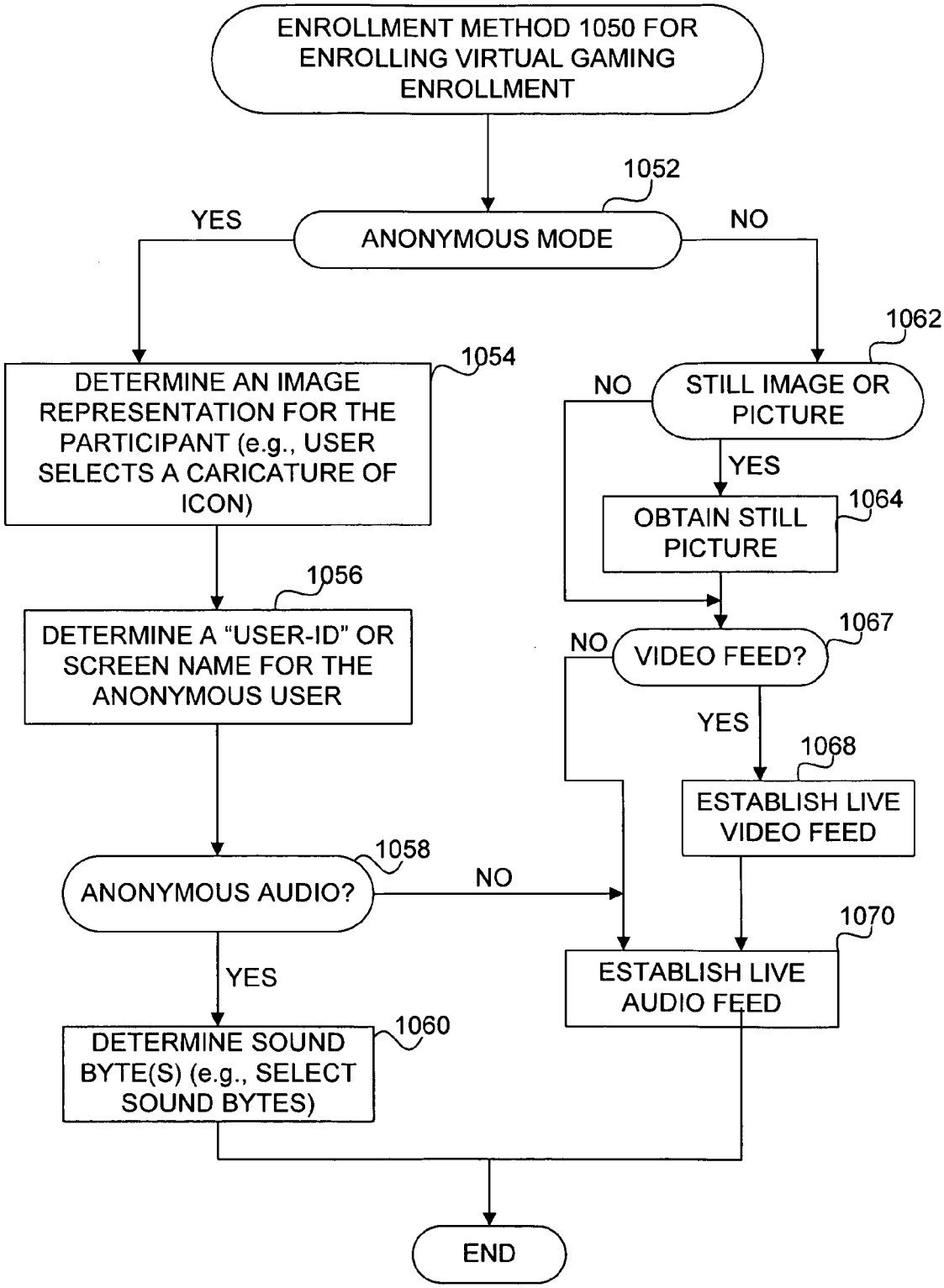
FIG. 10 depicts a method for enrolling a player in a virtual gaming environment in accordance with one embodiment of the invention.

FIG. 10 depicts an enrollment method 1050 for enrolling a person (or group) in a virtual gaming environment in accordance with one embodiment of the invention. Enrolling method 1050 can, for example, be used to enroll a person as a participant to play a game in a virtual gaming area. Initially, it is determined (1052) whether to enroll a participant in a anonymous mode. This determination (1052) can, for example, be made based on user input or governing gaming requirement or regulation. If it is determined (1052) to enroll in the anonymous mode, an image representation is determined (1054) for the participant. The image representation can, for example, be determined based on input or selection made by a person. In addition, a user identification (or user-ID) is determined (1056) for the anonymous user. It should be noted that the user-ID can be used for an admission ticket provided to the user. Thereafter, it is determined (1058) whether audio is anonymous. Accordingly, sound bytes or pre-recorded messages can be determined. Similar to determination (1054) of the image, sound bytes can, for example, be selected by the person from a selection of sound bytes that are provided for the participants (e.g., "I am all in"). The enrollment method 1000 ends following the determination (1060) of the sound bytes or recorded messages.

However, if it is determined (1052) not to enroll a participant in the anonymous mode, it is effectively determined (1062 and 1067) whether to obtain a still picture and/or a video feed of the participant. This determination can, for example, be made based on user input or a particular governing gaming requirement or regulation. Accordingly, a still picture can be obtained (1064) and/or a live video feed can be established (1058). Thereafter, a live audio feed can be established (1070). It should be noted that a live audio feed can also be established (1070) for a participant that is represented with an image and a user-ID, if it is determined (1058) not to enroll the participant with an anonymous audio option. More generally, in view of the examples above, it will be appreciated that various participants can be enrolled in accordance with numerous combination of audio and video settings (e.g., real video with anonymous audio, real audio only, real video only) as well as text and voice interpretation options. Voice interpretation can generate text based on audio input received from a participant in accordance with one embodiment of the invention. In addition, a participant in a virtual gaming environment can be given the option to turn off the audio associated with one or more participants and/or view text representing audio input associated with one or more of the participants.

Figure 11:
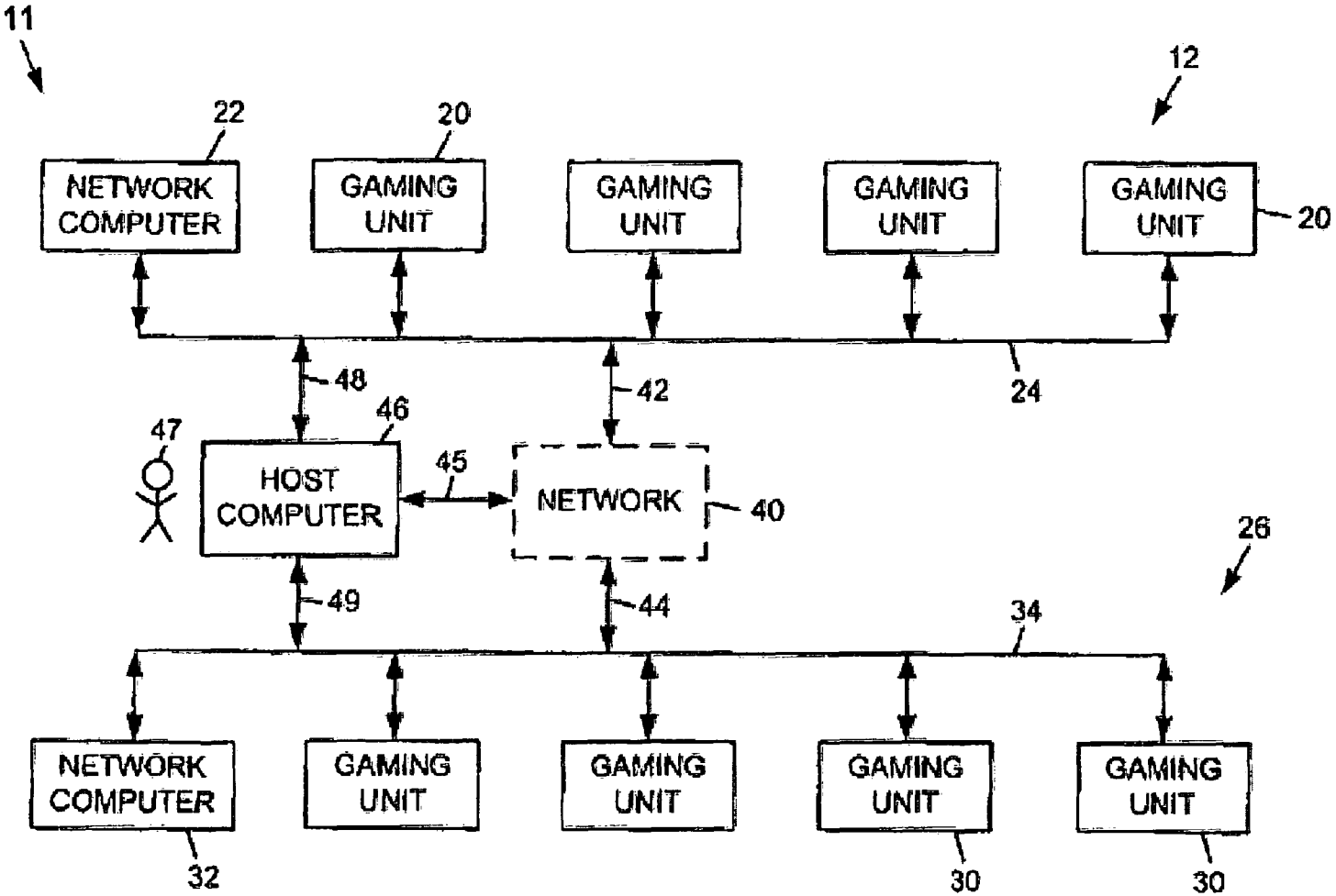
FIG. 11 is a block diagram of an embodiment of a gaming system in accordance with the invention.

FIG. 11 illustrates one possible embodiment of a casino gaming system 10 in accordance with the invention. Referring to FIG. 11, the casino gaming system 10 may include a first group or network 12 of casino gaming units 20 operatively coupled to a network computer 22 via a network data link or bus 24. The casino gaming system 10 may include a second group or network 26 of casino gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 42 and a second network link 44.

The casino gaming system further includes a host computer 46 which may be utilized by a person acting as a host during a gaming tournament, herein referred to as a tournament host 47, to allow real-time interaction with tournament players that may be located locally or in other areas. The host computer 46 may be operatively coupled via a first host link 48 and a second host link 49 to the network computers 22, 32 and/or one or more gaming units 20, 30, depending on the gaming tournament being played and the number of tournament players participating. In the alternate, the host computer 46 may also be directly coupled to the network 40 via a host network link 45.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol. Where the network 40 comprises a wireless network, data communication may take place over the communication links 42, 44 via a wireless data protocol such as CDMA2000 or W-CDMA. Similarly, where the first host link 48, the second host link 49, and the host network link 45 comprise the internet, data, voice and video communication may take place via an Internet communication protocol, and where the first host link 48, the second host link 49, and the host network link 45 comprise a wireless connection, data, voice, and video communication may take place via a wireless protocol.

The network computer 22 may be a server computer and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and may be used to perform the same or different functions in relation to the gaming units 30 as the network computer 22 described above.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links.

A player selecting to play a casino game such as poker, keno, blackjack, slots, bingo, pachinko, card games, or any games of chance and the like, may chose individual play or tournament play. Tournament play may include various tournament modes such as single player mode or multiplayer mode, or teams. Tournament play may also include various tournament games, for example, games of chance such as slots, poker, blackjack, etc., games of skills such as trivia games, or combinations of games of chance and skill such as user-controlled reel-stop slot games, bonus games such as Family Feud®, Jeopardy®, Wheel-of-Fortune®, etc. Tournament play may also include a progressive type jackpot where tournament the prize amounts are proportional to the number of tournament players, the type of game, whether the prize is awarded as one large jackpot or smaller secondary jackpots, etc. In addition, tournament play may include multi-site tournaments where each site is made up of one or more teams. The teams may compete with each other in a round-robin type elimination until there is one remaining winning team. Thus, a team located in New Jersey can compete against teams in Las Vegas and Australia. In any event, if a player selects to participate in a gaming tournament, the casino gaming system 10 described above will enable the tournament host 47 to interact with tournament players, regardless of the proximity of the tournament players to the tournament host 47.

Host Computer Electronics

Figure 11A:
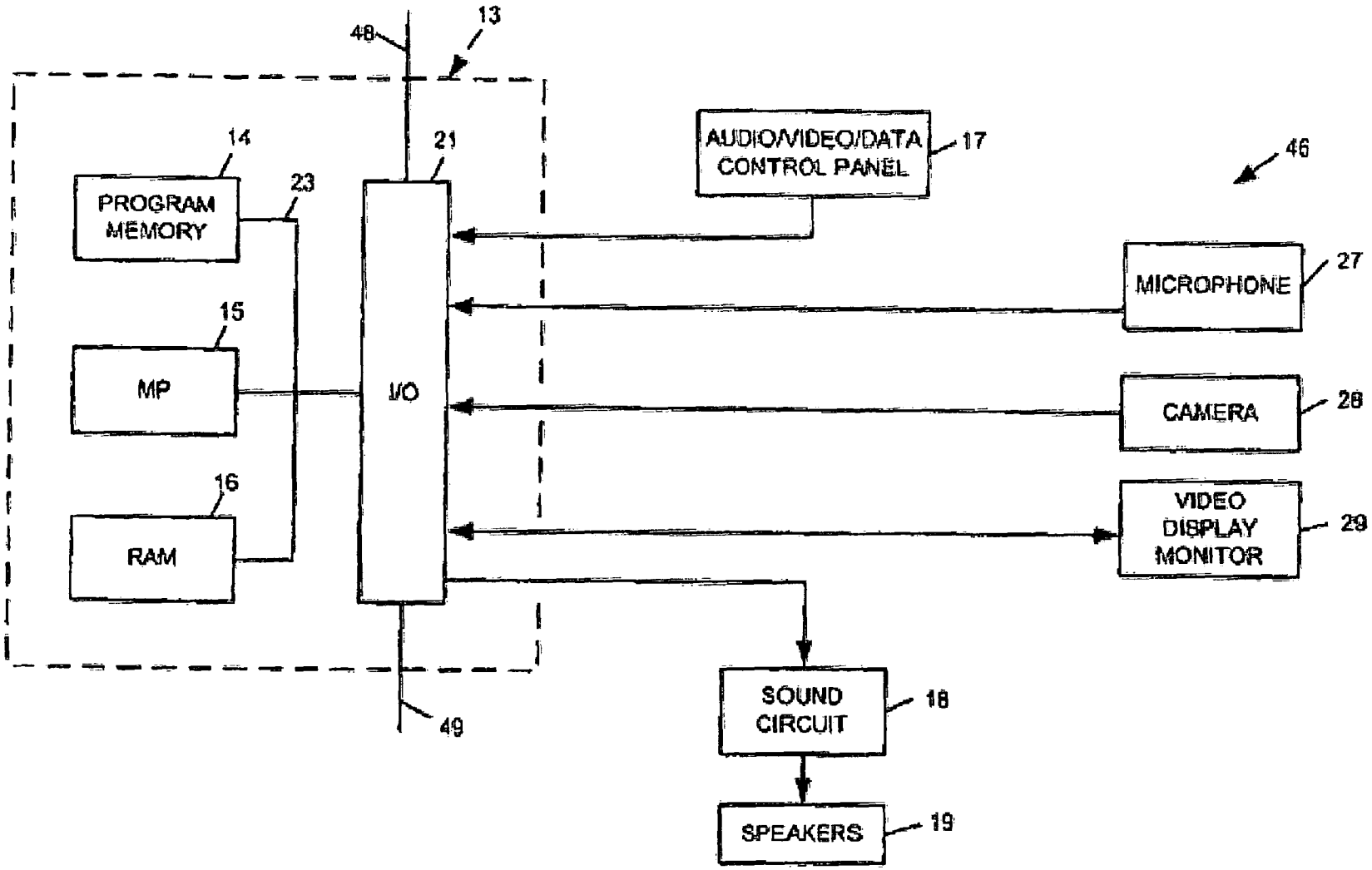
FIG. 11A is a block diagram of the electronic components of the host computer of FIG. 11.

FIG. 11A is a block diagram of the electronic components that may be incorporated in the host computer 46. Referring to FIG. 1A, the host computer 46 may include a host controller 13 that may comprise a program memory 14, a microcontroller or microprocessor (MP) 15, a random-access memory (RAM) 16 and an input/output (I/O) circuit 21, all of which may be interconnected via an address/data bus 23. It should be appreciated that although only one microprocessor 15 is shown, the host controller 13 may include multiple microprocessors 15. Similarly, the memory of the host controller 13 may include multiple RAMs 16 and multiple program memories 14. Although the I/O circuit 21 is shown as a single block, it should be appreciated that the I/O circuit 21 may include a number of different types of I/O circuits. The RAM(s) 16 and program memories 14 may be implemented as semiconductor memories, magnetically readable memories, and/or optically readable memories, for example.

FIG. 11A illustrates that an audio/visual/data control panel 17, a host microphone 27, a digital imaging device 28, for example, a camera, and a video display monitor 29 may be operatively coupled to the I/O circuit 21, each of those components being so coupled by either a unidirectional or bidirectional, single-line or multiple-line data link, which may depend on the design of the component that is used. A host speaker(s) 19 may be operatively coupled to a sound circuit 18, that may comprise a voice- and sound-synthesis circuit or that may comprise a driver circuit. The sound-generating circuit 18 may be coupled to the I/O circuit 21.

As shown in FIG. 11A, the components 27, 28, 29, 17, 18 may be connected to the I/O circuit 21 via a respective direct line or conductor. Different connection schemes could be used. For example, one or more of the components shown in FIG. 1A may be connected to the I/O circuit 21 via a common bus or other data link that is shared by a number of components. Furthermore, some of the components may be directly connected to the microprocessor 15 without passing through the I/O circuit 21.

FIG. 1B is an exemplary illustration of an embodiment block of the audio/video/data control panel 17 that may be incorporated in the host computer 46. The audio/video/data control panel 17 may include a number of input ports and output ports configured to allow the host 47 to interconnect selected inputs to selected outputs. The inputs may be selected by the host 47 from among many inputs including, inter alia, the host camera 28, the host microphone 27, numerous floor cameras placed strategically in the areas of the tournaments, gaming unit cameras such as the gaming unit camera 63, the gaming unit microphone 57, data generated by the gaming unit, and the outputs may include, inter alia, gaming unit display screens such as the display monitor 61 or the display unit 70, speakers such as the gaming unit speaker(s) 62, and the ticket printer 56.

Figure 11B:
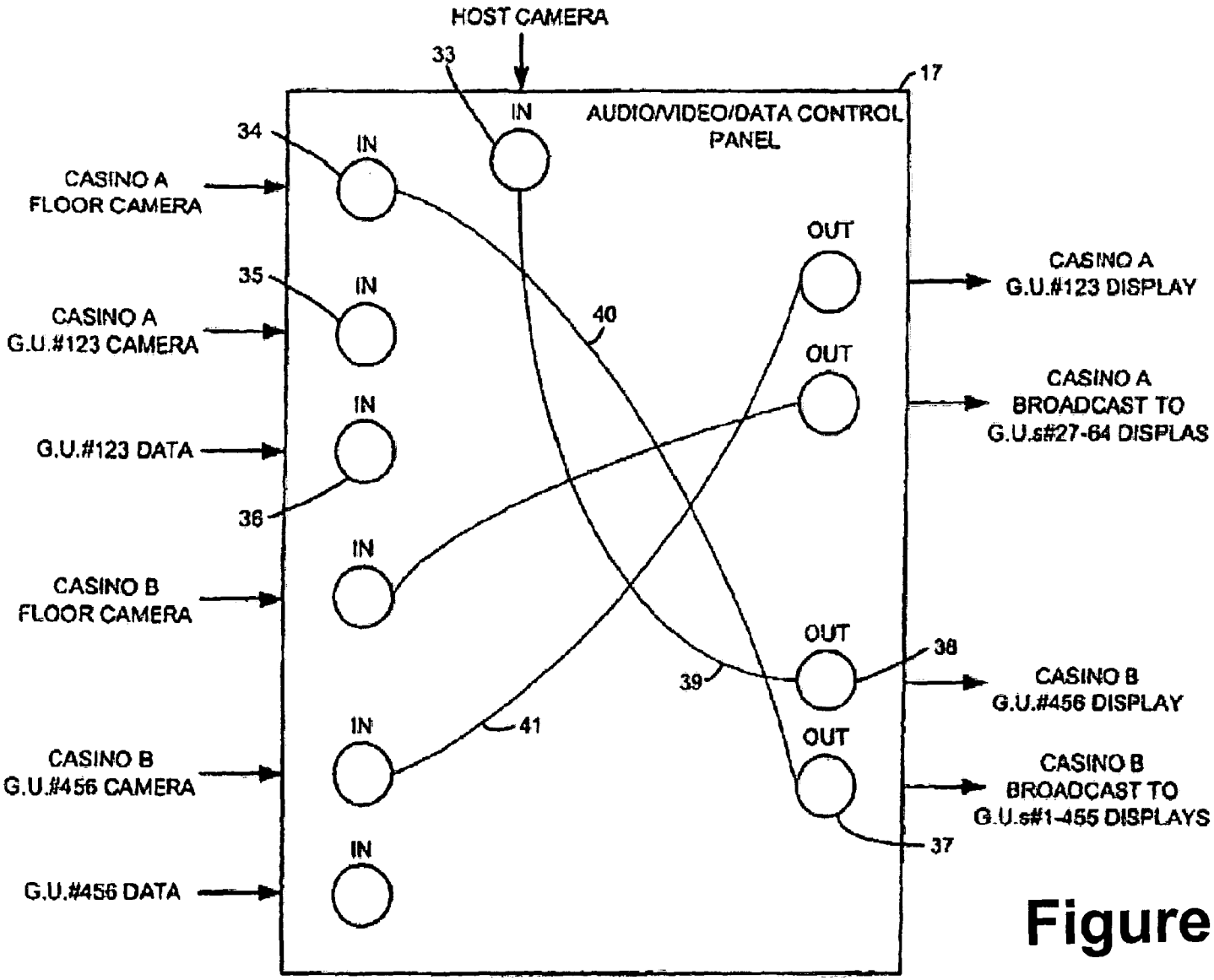
FIG. 11B is an exemplary illustration of an audio/video/data control panel that may be incorporated in the host computer.

Referring to FIG. 11B, the audio/video/data control panel 17 may include a host camera input 33, a Casino A floor camera input 34, a gaming unit #123 camera input 35, and a gaming unit #123 data input 36. Similarly, the audio/video/data control panel 17 may include a Casino B floor camera input, a gaming unit #456 camera input, and a gaming unit #456 data input. The audio/video/data control panel 17 may also include a series of gaming unit display monitors 37 corresponding to a series of gaming units numbered 1-455 located at a Casino B, and a single gaming unit display monitor 38 corresponding to a gaming unit numbered 456 located at the Casino B.

A number of closed circuit monitors (not shown) configured to display visual and/or audio signals from the host and the players may be located in close proximity to the tournament host 47 to allow the tournament host 47 to chose from among the various inputs. For example, if selected by the host 47, images captured by the host camera 28, as viewed on a closed circuit monitor by the host, may be routed to the video display monitor of the gaming unit identified as #456 via a host-to-player link 39. Similarly, images captured by a casino A floor camera, may be routed, via a broadcast link 40, to the display monitors of all of the gaming units participating in a particular gaming tournament, and images captured by a camera of the gaming unit identified as #456 may be routed, via a player-to-player link 41, to the display monitor of the gaming unit identified as #456.

Gaming Unit

Figure 12:
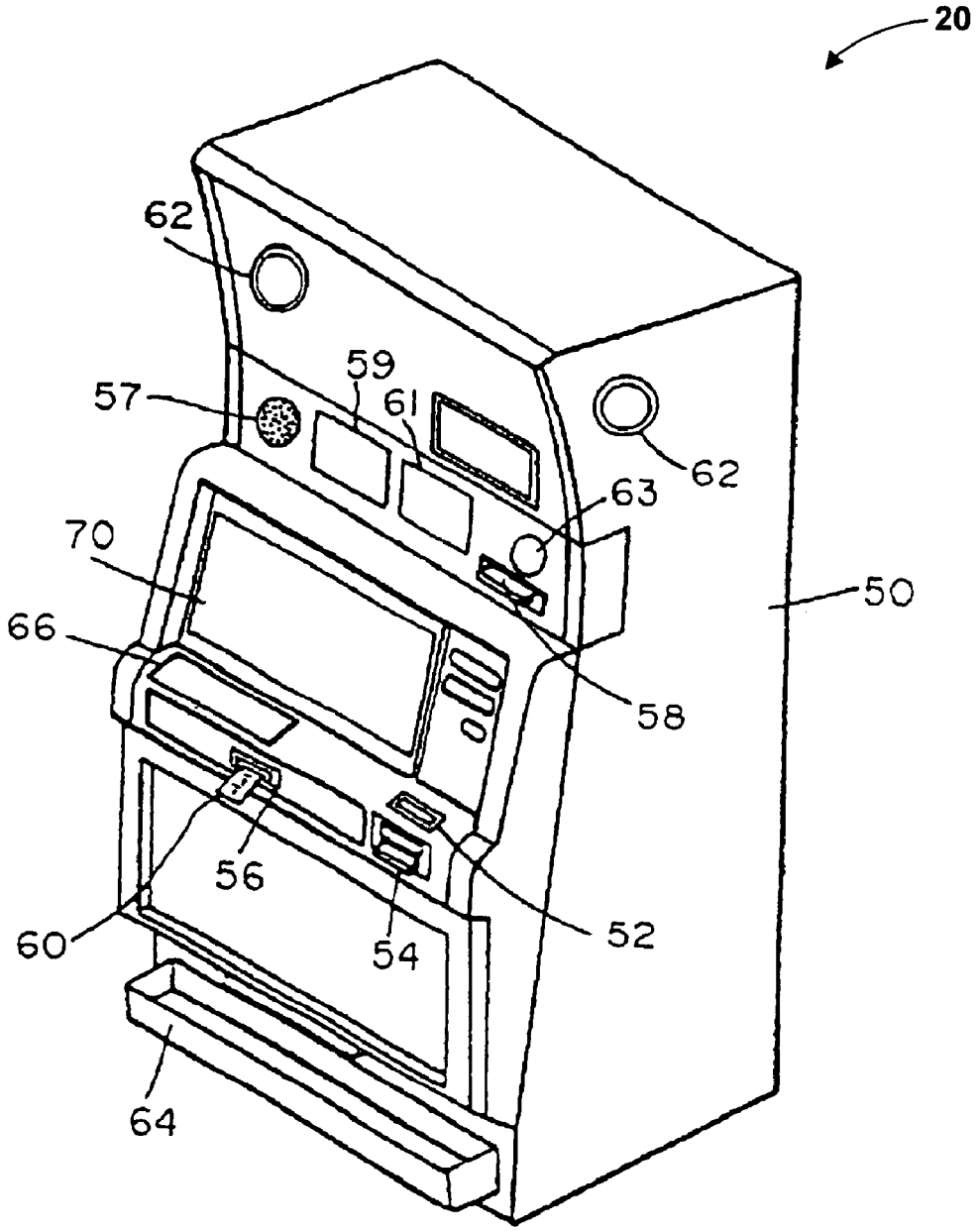
FIG. 12 is a perspective view of an embodiment of one of the gaming units shown schematically in FIG. 11.

FIG. 12 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaming unit and may have various different structures and methods of operation. For exemplary purposes, various designs of the gaming units 20 are described below, but it should be understood that numerous other designs may be utilized.

Referring to FIG. 12, the casino gaming unit 20 may include a housing or cabinet 50 and one or more input devices, which may include a coin slot or acceptor 52, a paper currency acceptor 54, a ticket reader/printer 56 and a card reader 58, which may be used to input value to the gaming unit 20. A value input device may include any device that can accept value from a customer. As used herein, the term "value" may encompass gaming tokens, coins, paper currency, ticket vouchers, credit or debit cards, smart cards, and any other object representative of value.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print vouchers such as ticket voucher 60, which could then be used by a player in other gaming units 20 that have ticket readers 56.

If provided, the card reader 58 may include any type of card reading device, such as a magnetic card reader or an optical card reader, and may be used to read data from a card offered by a player, such as a credit card or a player tracking card. If provided for player tracking purposes, the card reader 58 may be used to read data from, and/or write data to, player tracking cards that are capable of storing data representing the identity of a player, the identity of a casino, the player's gaming habits, etc.

The gaming unit 20 may include one or more audio speakers 62, a coin payout tray 64, an input control panel 66, and a color video display unit 70 for displaying images relating to the game or games provided by the gaming unit 20. The color video display unit 70 may also be configured with touch screen capability allowing a player to make selection. The audio speakers 62 may generate audio representing sounds such as the noise of spinning slot machine reels, a dealer's voice, music, announcements or any other audio related to a casino game. The input control panel 66 may be provided with a plurality of pushbuttons or touch-sensitive areas that may be pressed by a player to select games, make wagers, make gaming decisions, etc.

In addition, the casino gaming unit 20 may additional devices if it is not equipped with a computer-compatible built-in video screen, a digital imaging device, an audio input device, etc., capable of facilitating player/host event-driven interaction during a gaming tournament. The additional devices may include a microphone assembly 57, a touch screen display 59, video display monitor 61, a camera 63 or other type of digital imaging device, as well as other peripheral devices such as biometric devices capable of identifying a player. Although shown as separate components, the touch screen display 59 may be overlaid on the video display monitor 61 or the video display unit 70, thereby yielding a display monitor with touch sensor capability in addition to video display capability.

Figure 13:
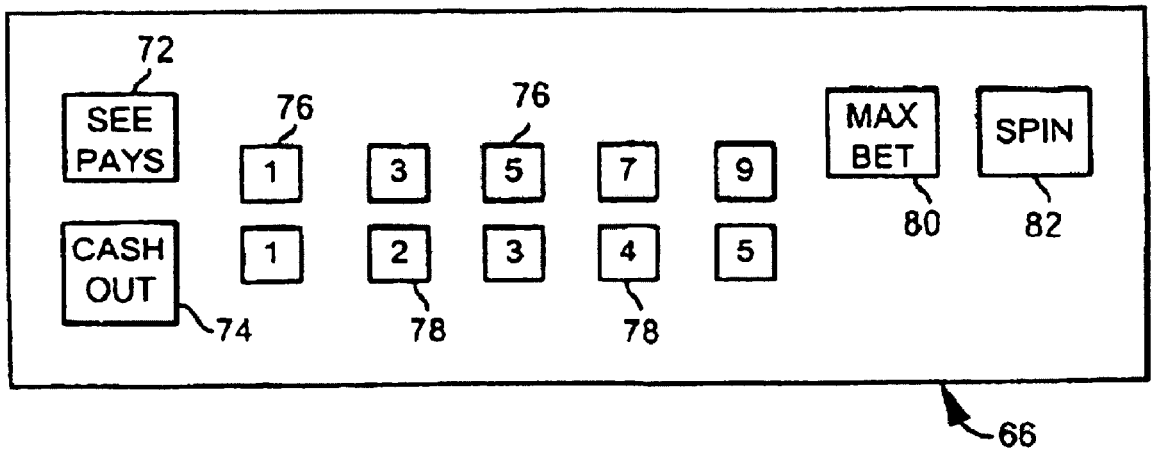
FIG. 13 illustrates an embodiment of a control panel for a gaming unit.

FIG. 13 illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the color video display unit 70 to generate one or more display screens showing the odds or payout information for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the payout tray 64.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines.

If the gaming unit 20 provides a slot game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 13, a rectangle is shown around the buttons 72, 74, 76, 78, 80, and 82. It should be understood that that rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the color video display unit 70, it should be understood that the control panel 66 could be generated by the color video display unit 70. In that case, each of the buttons of the control panel 66 could be a colored area generated by the color video display unit 70, and some type of mechanism may be associated with the color video display unit 70 to detect when each of the buttons was touched, such as a touch-sensitive screen.

Gaming Unit Electronics

Figure 14:
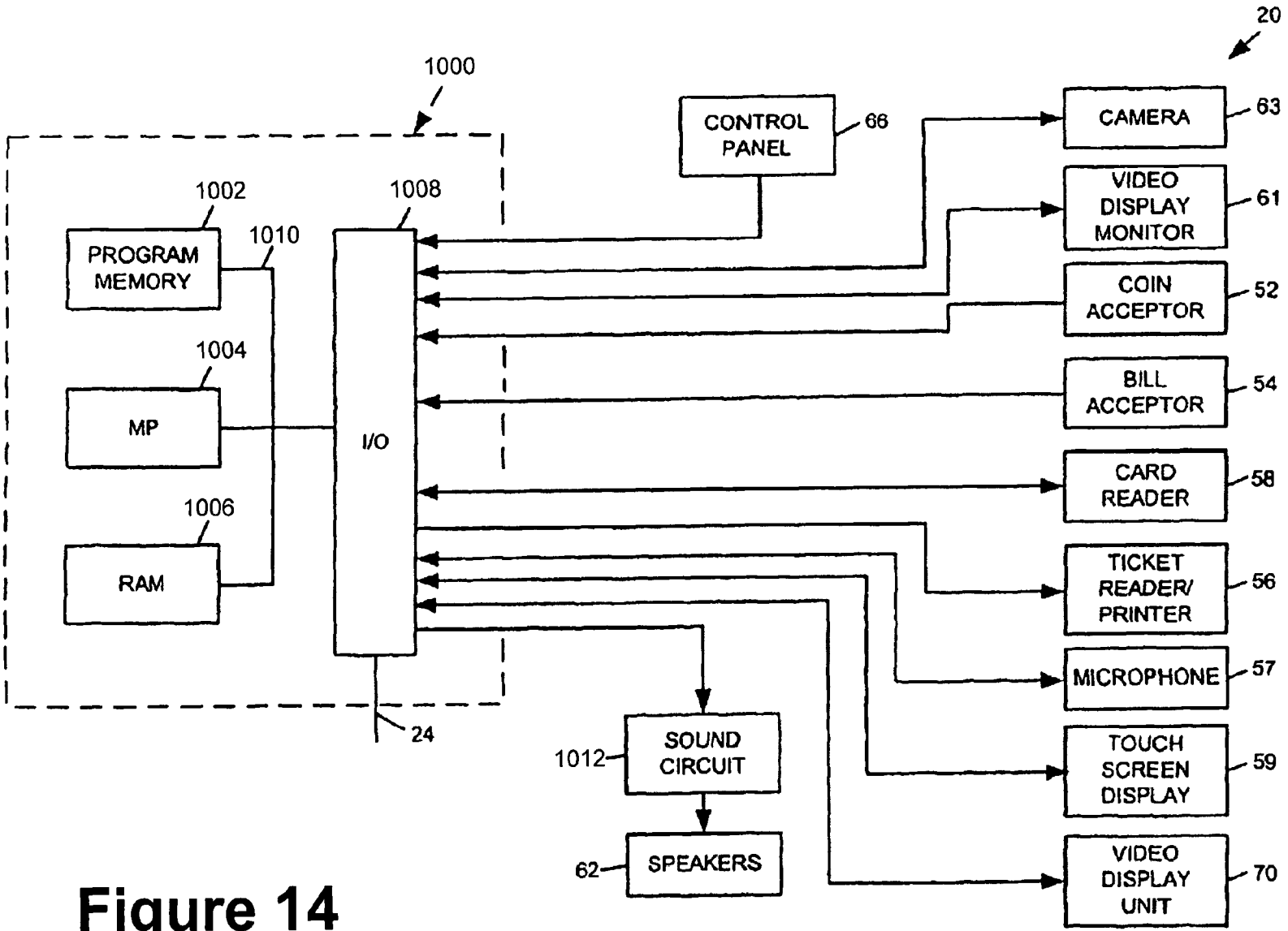
FIG. 14 is a block diagram of the electronic components of the gaming unit of FIG. 13.

FIG. 14 is a block diagram of a number of components that may be incorporated in the gaming unit 20. Referring to FIG. 14, the gaming unit 20 may include a controller 1000 that may comprise a program memory 1002, a microcontroller or microprocessor (MP) 1004, a random-access memory (RAM) 1006 and an input/output (I/O) circuit 1008, all of which may be interconnected via an address/data bus 1010. It should be appreciated that although only one microprocessor 1004 is shown, the controller 1000 may include multiple microprocessors 1004. Similarly, the memory of the controller 1000 may include multiple RAMs 1006 and multiple program memories 1002. Although the I/O circuit 1008 is shown as a single block, it should be appreciated that the I/O circuit 1008 may include a number of different types of I/O circuits. The RAM(s) 1004 and program memories 1002 may be implemented as semiconductor memories, magnetically readable memories, and/or optically readable memories, for example.

FIG. 14 illustrates that the control panel 66, the video display unit 70, the coin acceptor 52, the bill acceptor 54, the card reader 58 and the ticket reader/printer 56, the microphone 57, the touch screen display 59, the video display monitor 61, the video display unit, and the camera 63 may be operatively coupled to the I/O circuit 1008, each of those components being so coupled by either a unidirectional or bidirectional, single-line or multiple-line data link, which may depend on the design of the component that is used. The speaker(s) 62 may be operatively coupled to a sound circuit 1012, that may comprise a voice- and sound-synthesis circuit or that may comprise a driver circuit. The sound-generating circuit 1012 may be coupled to the I/O circuit 1008.

As shown in FIG. 14, the components 52, 54, 56, 57, 58, 59, 61, 63, 66, 70, 1012 may be connected to the I/O circuit 1008 via a respective direct line or conductor. Different connection schemes could be used. For example, one or more of the components shown in FIG. 14 may be connected to the I/O circuit 1008 via a common bus or other data link that is shared by a number of components. Furthermore, some of the components may be directly connected to the microprocessor 1004 without passing through the I/O circuit 108.

Tournament Operation

The tournament host 47 may interact with a tournament player(s) via the audio/visual/data control panel 17, the host speaker(s) 19, the host microphone 27, the host camera 28, and/or the host video display monitor 29 of the host computer 46. Tournament host to tournament player interaction (host/player) may include, for example, coordinating the gaming tournament among the players, instructing the tournament players, broadcasting conversations to tournament players, edited or not, between the host and other tournament players, broadcasting an audio and/or video feed showing a tournament player's elation in order to increase a level of excitement among the tournament players. In addition, the host/player interaction may include the host providing a selection of audio and/or visual video feed to other tournament players or hosts. The selection may include, for example, tournament players interacting with the host during the gaming tournament, tournament players interacting with each other, as well as a variety of other tournament scenarios. The tournament players may then select to view one or more video feeds from among numerous video feeds. Similarly, other tournament hosts may select to broadcast one or more of the audio and/or video feeds, and may, if desired, add their own commentary to the audio and/or video feeds. Further, the tournament host 47 can broadcast real-time tournament player information during the gaming tournament. The information may include, but is not limited to, general player information such as where a player is from, player performance statistics such as a player in New Jersey is winning the slot tournament by 5000 points, etc.

The host microphone 27 may be configured to capture audio input from the tournament host 47 located at the host computer 46. The host controller 13 may then convert the audio input to "host data," suitable for transmission to the gaming unit 20. Upon receipt, the gaming unit controller 1000 may then convert the host data to sounds, broadcast to the tournament player(s) by the speakers 62 mounted on the gaming unit 20. Conversely, the host speaker(s) 19 are configured to enable the tournament host 47 to hear projected sounds aurally conveyed to him from the tournament players during the gaming tournament.

Similarly, the host video display monitor 29 may be configured to allow the tournament host 47 to view a number of images including live and recorded images. For example, via the audio/visual/data control panel 17 discussed in connection with FIG. 11B, the host video display monitor 29 may allow the tournament host 47 to switch to, and view live images of the tournament player(s) playing the gaming tournament. The live images may include, for example, images of the tournament player(s) receiving instructions from the tournament host 47, images of the tournament player(s) asking questions of the tournament host 47, or simply images of the facial expressions of tournament player(s) during the gaming tournament. In another example, the host video display monitor 29 may allow the tournament host to review video feed and then select, via the use of the audio/visual/data control panel 17, to broadcast the video feed to tournament players. The video feed may include video images of tournament players playing the gaming tournament, for example, an instant replay of a tournament winner's expression, and/or video images of intermingling between one or more tournament players and the tournament host 47 during the gaming tournament. In addition, other types of images may also be contemplated for display on the host display monitor 29. Moreover, the tournament host 47 may also select to superimpose text on the video feed using the audio/visual/data control panel 17. For example, the tournament host 47 may superimpose the scores of the tournament players, reward points, the time, etc. on video feeds broadcast during the tournament. Accordingly, the tournament host 47 may switch among the various images to be displayed on the host display monitor 29 via the audio/visual/data control panel 17.

The host camera 28 or other digital imaging device may be configured to capture visual images of the tournament host 47 located at the host computer 46. The host controller 13 may then convert the visual image to host data which is transmitted to the one or more tournament players located at the gaming units participating in the gaming tournament. The gaming unit controller 1000 may then convert the host data to a visual image suitable for viewing by the tournament player(s) on the video display monitor 61. The host camera 28 may also be configured to allow visual images of live host/player interaction to be captured and transmitted to the video display monitor 61 of gaming unit 20. Typically, the visual images will be accompanied by corresponding audio feed and data feed such as a score, a time, a list of top players, etc.

The tournament player(s) may interact with the tournament host 47 via the control panel 66, the microphone assembly 57, the touch screen display 59 or the color video display unit 70 with touch screen capability, the video display monitor 61, the camera 63 or other type of digital imaging device, as well as other peripheral devices such as biometric devices capable of identifying a player. As mentioned above, the microphone assembly 57, the touch screen display 59, the video display monitor 61, and the camera 63 may be attached to the gaming unit 20 in any suitable fashion, or may be built into the gaming unit 20. In addition, the video display monitor 61 and the color video display unit 70 may be combined into one display unit housed in the gaming unit 20. Similarly, the touchscreen display 59 may also be combined with the color video display unit 70 in the gaming unit 20, or may be combined with the video display monitor 61.

The microphone assembly 57 may be configured to capture audio input from a tournament player(s) located at the gaming machine 20. The gaming unit controller 1000 may then convert the audio input to "player data," suitable for transmission to the host computer 46. Upon receipt, the host controller 18 may then convert the player data to sounds, broadcast to the tournament host 47 by the host speakers 19 mounted in the host computer 46. The tournament host 47 may then record the sounds, associated with the player's audio input, for playback to other players or may simply use the sounds to monitor the tournament player's enjoyment of the gaming tournament. The tournament host 47 may also place players "calling in" in a queue, much like a radio talk show. Conversely, the speaker(s) 62 is configured to enable a tournament player to hear projected sounds aurally conveyed to him, including, for example, real-time voice instructions and updates from the tournament host during the gaming tournament, audio recordings of other tournament players, and audio recordings of conversations between one or more tournament players and the tournament host 47.

Similarly, the video display monitor 61 may be configured to allow a player to view a number of images including real-time and recorded images. For example, the video display monitor 61 may allow a player to view live, as in real-time, images of the tournament host 47 hosting the gaming tournament. The live images of the tournament host 47 may include, for example, images of the tournament host 47 giving tournament playing instructions to the players or simply images of the tournament host cheering for a particular tournament player. In another example, the video display monitor 61 may allow a player to view video feed, coordinated and provided by the tournament host 47 located at the host computer 46. The video feed may include video images of other tournament players playing the gaming tournament, for example, an instant replay of a tournament winner's expression, and/or video images of intermingling between one or more tournament players and the tournament host 47 during the gaming tournament. In addition, other types of images may also be contemplated for display on the video display monitor 61. Accordingly, the tournament host 47 may switch among the various images to be displayed on the video display monitor 61, depending on the tournament circumstances, location of players, etc.

For exemplary purposes, both the color video display unit 70 suitable for generating video images of games, and the video display monitor 61 suitable for generating images of the tournament host 47 as well as images and video feed of other tournament related images, are shown in FIG. 12. It should be understood, however, that the gaming unit 20 may be configured with one video display unit that is capable of generating both the video images of games as well as tournament host images and other tournament related images via any number of well known means. For example, the video display unit 70 may be configured with picture-in-picture capability that allows a tournament player to concurrently view two or more image screens.

The camera 63 or other digital imaging device may be configured to capture visual images of a tournament player(s) located at the gaming machine 20. The gaming unit controller 1000 may then convert the visual image to player data which is transmitted to the host computer 46. The host controller 13 may then convert the player data to a visual image suitable for viewing by the tournament host 47 on the host display monitor 29. The host controller 13 may also convert the player data to a recorded visual image. The recorded visual image may then be viewed by the tournament host 47 on the host display monitor 29 and/or a tournament player(s) on the video display monitor 61. Similarly, if player(s) and the tournament host 47 are co-located, the camera 63 may also be configured to allow images of host/player interaction to be captured and transmitted to the host computer 46. The images of both the individual tournament players, and the images of tournament player/host interaction may them be provided by the tournament host 47 to other tournament players via their video display monitors.

As previously mentioned in connection with FIG. 12, if provided for player tracking purposes, the card reader 58 may be used to read data from, and/or write data to, player tracking cards that are capable of storing data representing the identity of a player, the identity of a casino, the player's gaming habits, etc. Of course, the card reader 58 as well as any other biometric input device capable of identifying the player may be also used to identify a player participating in a gaming tournament for purposes of inclusion in any video and/or audio feed. Although a player may wish to be identified for awards purposes, he may wish, however, to remain anonymous for all other purposes. In such a case, the tournament host 47 will enable a tournament player's anonymity during the gaming tournament using a number of different techniques including, for example, by either disabling or prompting the player to disable the camera 63 mounted on the gaming unit 20.

The touch screen display 59 shown in FIG. 12 may be a resistive based touch screen, a capacitive based touch screen, a surface acoustic wave touch screen, or any other type touch screen capable of allowing a player to enter player information and navigate through the gaming unit services. The touch screen display may include alpha-numeric symbols, function keys and hand-writing recognition capabilities. The touch screen may be activated by a tournament player using a finger or stylus and use LED's or vacuum flourescent display (VFD) technology to display a alphanumerical text, however, a color LCD display screen may be preferable over an LED or VFD screen to allow for the display of symbols and images as well as alphanumeric characters. In addition to LEDs, VFDs and LCDs, a touch screen may be used with a plasma display screen, a CRT display as well as other conventional display technology. It should be noted, that although not shown in connection with FIG. 11A, a touchscreen may also be provided to the tournament host 47 at host computer 46.

Recently, advances in player tracking units which are used to identify and reward players based upon their previous game play history, have provided an option to the addition of a separate speaker/microphone assembly and a separate touch screen to a conventional gaming unit. Details of player tracking units which may be utilized to provide a touch screen similar to the touch screen described above are detailed in a U.S. Pat. No. 6,712,698, filed Sep. 20, 2001, by Paulsen, et al., titled "Game Service Interfaces for Player Tracking Touch Screen Display," which is incorporated in its entirety and for all purposes. Details of player tracking units which may provide a speaker/microphone similar to the speaker/microphone described above as well as a touch screen similar to the touch screen described above are detailed in a U.S. Pat. No. 6,908,387 filed Aug. 3, 2001, by Hedrick, et al., titled "Player Tracking Communication Mechanisms in a Gaming Machine," which is incorporated in its entirety and for all purposes.

It should be understood that gaming unit 20 is but one example from a wide range of gaming unit designs that may be used. For example, some gaming machines are configured with a top box, which sits on top of the cabinet 50. The box top may house a number of devices which may be used to add features to a game being played on the gaming unit 20 including additional speakers, a ticket printer, an additional touch screen, and the like. Some gaming units have two or more game displays-mechanical and/or video, some gaming units are designed for bar tables and have displays that face upwards. Further, some gaming machines may be designed for cashless systems and may not include features such as bill validators, coin acceptors and tray coins. Instead, they may only have ticket readers, card readers, and ticket dispensers.

Overall Operation of Gaming Unit

One manner in which one or more of the gaming units 20 (and one or more of the gaming units 30) may operate is described below in connection with a number of flowcharts which represent a number of portions or routines of one or more computer programs, which may be stored in one or more of the memories of the controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32 having a memory in which the computer program portions are stored. The computer program portions may be written in any high level language such as C, C++, C#, Java or the like or any low-level assembly or machine language. By storing the computer program portions therein, various portions of the memories 1002, 1006 are physically and/or structurally configured in accordance with computer program instructions.

Figure 15A:
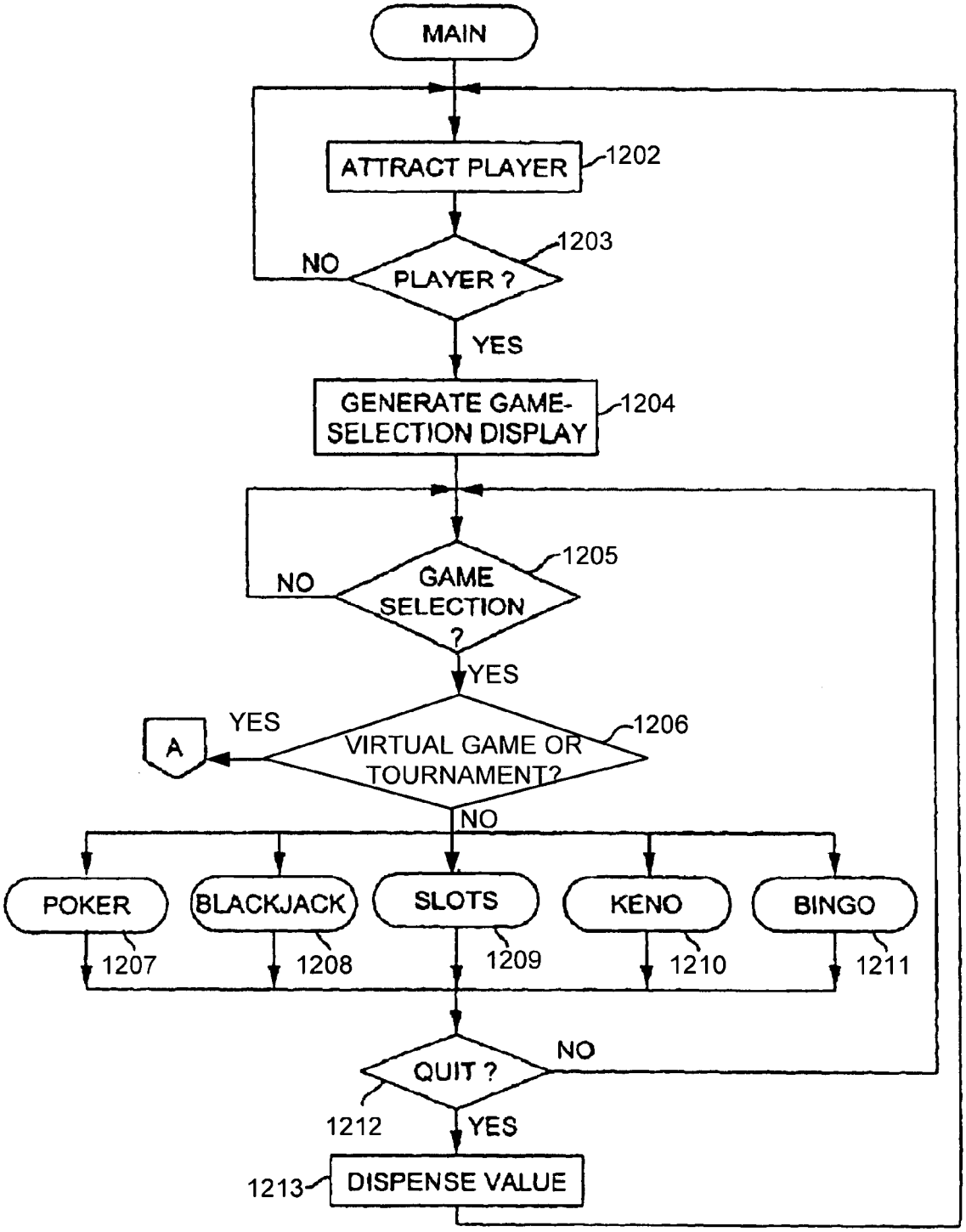
FIG. 15A-15F is a flowchart of an embodiment of a main routine that may be performed during operation of one or more of the gaming units.

FIG. 15A-15F is a flowchart of an embodiment of a main routine 1200 that may be stored in the memory of the controller 1000. Referring to FIG. 15A, the main routine 1200 may begin operation at block 1202 during which an attraction sequence may be performed in an attempt to induce a potential player in a casino to play the gaming unit 20. The attraction sequence may be performed by displaying one or more video images on the color video display unit 70 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, video pachinko games, video card games, video games of chance, and combinations thereof. The attraction sequence may also include an option for an individual player to participate in a gaming tournament, with or against other individual players.

During performance of the attraction sequence, if a potential player makes any input to the gaming unit 20 as determined at block 1203, the attraction sequence may be terminated and a game-selection display may be generated on the color video display unit 70 at block 1204 to allow the player to select a game available on the gaming unit 20. The gaming unit 20 may detect an input at block 1203 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit; the gaming unit 20 could determine if player has inserted a player card into the card reader 58; the gaming unit 20 could determine if player entered his player identification information via the touch screen display 59, etc.

The game-selection display generated at block 1204 may include, for example, a list of video games that may be played on the gaming unit 20 and/or a visual message to prompt the player to deposit value into the gaming unit 20. While the game-selection display is generated, the gaming unit 20 may wait for the player to make a game selection. Upon selection of a game by the player as determined at block 1205, the controller 1000 may cause an additional game selection option at block 1206, allowing the player the option to participate in a virtual game or tournament ("gaming tournament"). If the player chooses to participate in a gaming tournament, gaming tournament choices may be presented to the player by displaying one or more video images of tournament games on the color video display unit 70 and/or causing one or more sound segments, such as voice or music, to be generated via the speakers 62.

If the individual player selects the options to play the game individually, the controller 1000 may cause one of a number of game routines to be performed to allow the selected game to be played. For example, the game routines could include a video poker routine 1207, a video blackjack routine 1208, a slots routine 1209, a video keno routine 1210, and a video bingo routine 1211. At block 1205, if no game selection is made within a given period of time, the operation may branch back to block 1202.

After one of the routines 1207, 1208, 1209, 1210, 1211 has been performed to allow the player to individually play one of the games, block 1212 may be utilized to determine whether the player wishes to terminate play on the gaming unit 20 or to select another game. If the player wishes to stop playing the gaming unit 20, which wish may be expressed, for example, by selecting a "Cash Out" button, the controller 100 may dispense value to the player at block 1213 based on the outcome of the game(s) played by the player. The operation may then return to block 1202. If the player did not wish to quit as determined at block 1212, the routine may return to block 1205 where the game-selection display may again be generated to allow the player to select another game.

It should be noted that although five gaming routines are depicted in FIG. 15A, a different number of routines could be included to allow play of a different number of games. The gaming unit 20 may also be programmed to allow play of different games including, but not limited to, various tournament games, for example, games of chance, games of skills such as trivia games, or combinations of games of chance and skill, etc.

Figure 15B:
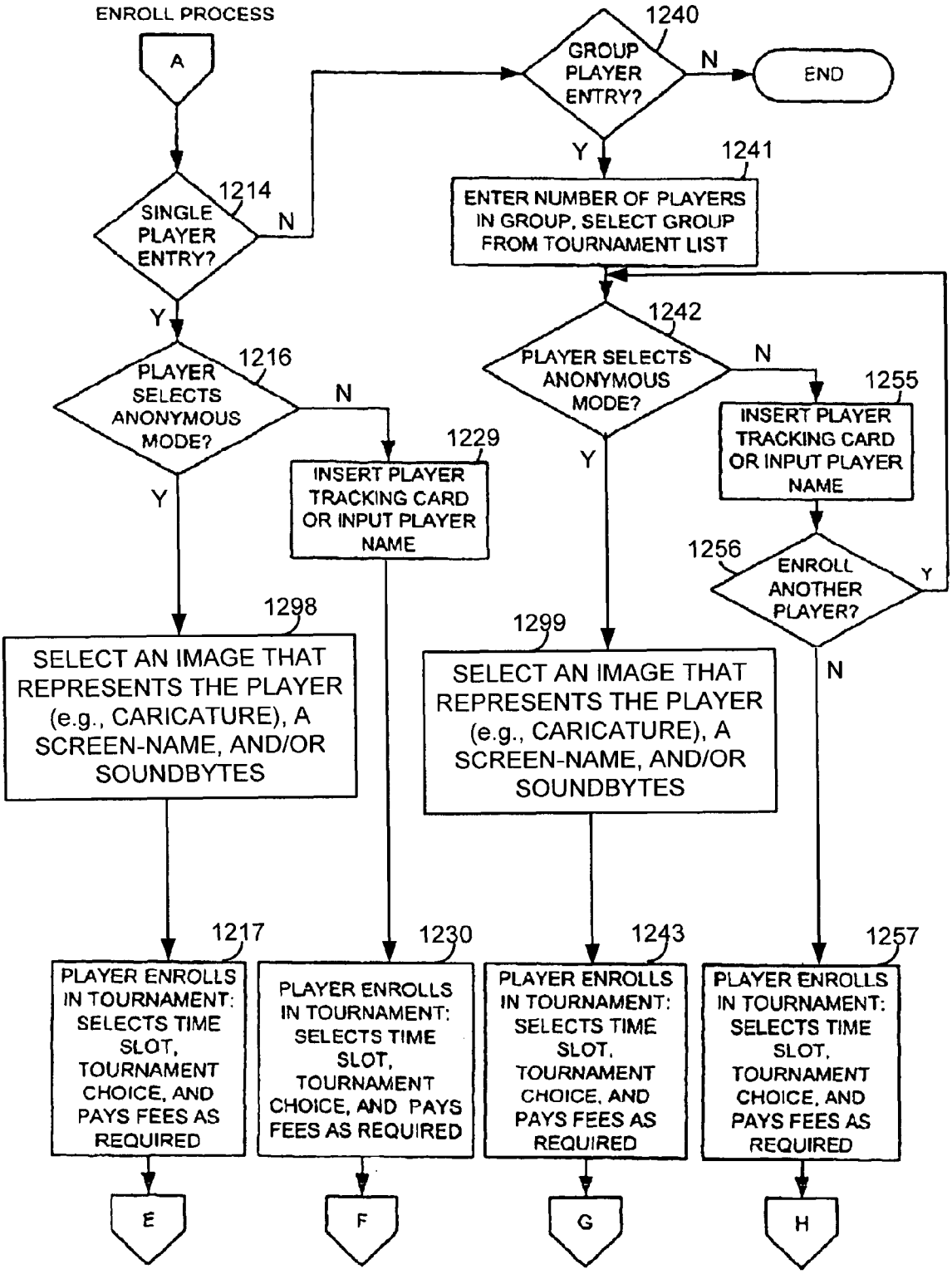
Figure 15C:
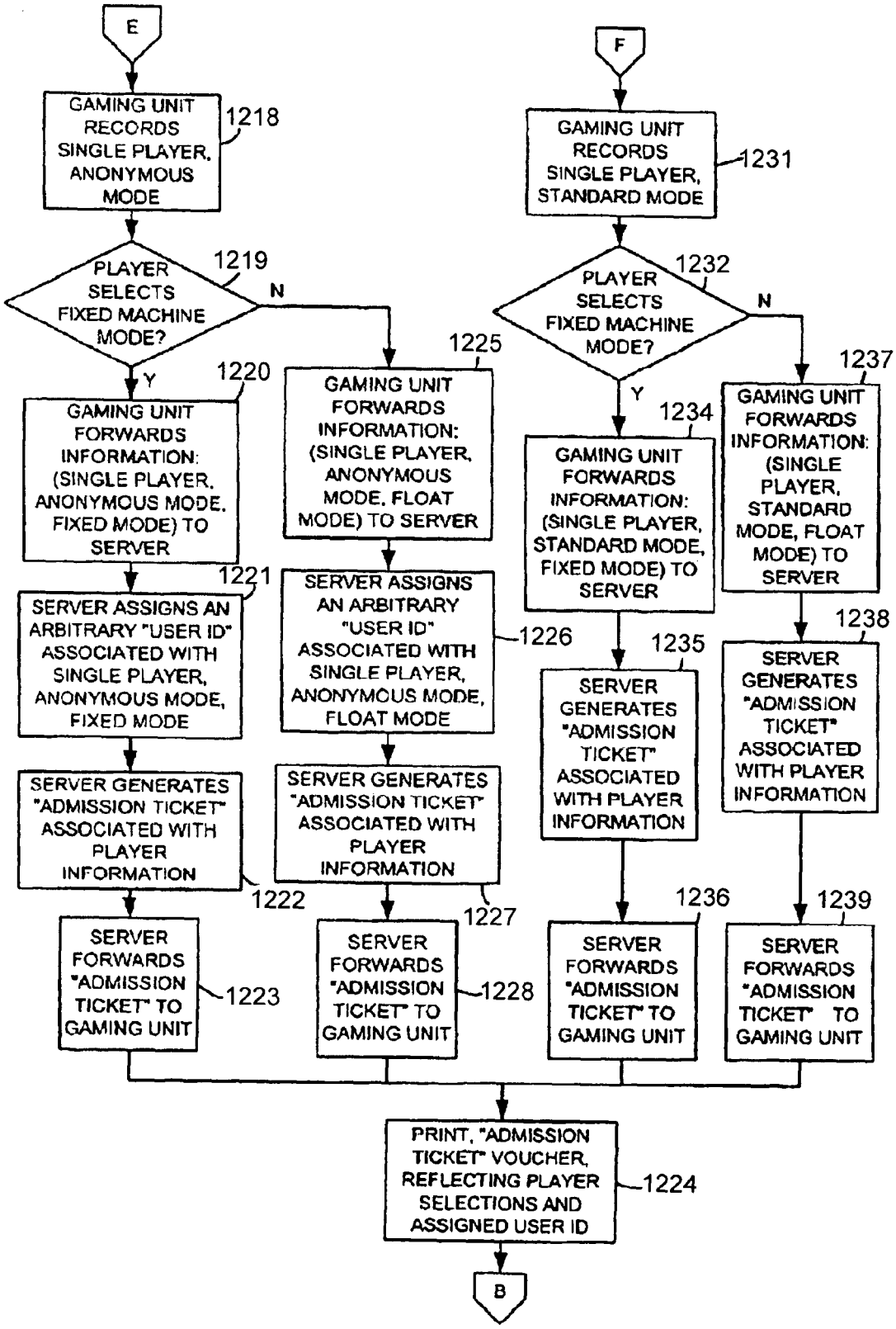

If the player selects to participate in a gaming tournament at block 1206, he may complete an enrollment process as shown in FIGS. 15B and 15C. The enrollment process begins at block 1214 where it is determined if the player is a single player entry at block 1214. Selection of the single player entry is appropriate where a player wishes to participate in a tournament but is not enrolling in the tournament as part of a group. Selection of the single player entry may also be appropriate in those cases where a single player intends to join group of players, for example, to join a group of female players to compete against a group of male players, to join a group of players from Chicago to compete against a group of players from Wisconsin, etc. If it is determined that the player has chosen to participate in the gaming tournament as a single player entry, the player determines whether he would like to remain anonymous throughout the gaming tournament at block 1216.

If the player chooses to remain anonymous at block 1216, an image, screen-name, and/or sound bytes are selected at block 1298 to effectively represent the player. Further, the player may enroll in the tournament via the touchscreen display 59 or the color video display unit 70 with touch screen capability, the video display monitor 61, the button operated control panel 66, or a combination thereof, depending on the configuration of the gaming unit 20. The player may enroll in the tournament at block 1217 by choosing a particular type of tournament, for example, a slots tournament where the winner among multiple players playing slots is determined by the number of points he accrues during a predetermined time period, by selecting a time slot which may or may not be within the hour, and by paying fees as required. The player may select a tournament time slot via a number of interfaces including, for example, the touch screen 59 or the color video display unit 70 with touch screen capability, the control panel 66 depicted as a button panel in FIG. 3, a scantron type form, a voice input, etc.

Referring to FIG. 15C, after the tournament type and time slot have been selected and the fees paid, the player may then enter his tournament preferences into the gaming unit 20, via the touchscreen display 59 or the color video display unit 70 with touch screen capability, the video display monitor 61, the button operated control panel 66, or a combination thereof, depending on the configuration of the gaming unit 20. The players tournament preferences may include participating in the tournament as a single player in an anonymous mode. The gaming unit 20 records the player's preference to participate in the tournament as an anonymous, single player, at block 1218. Next, at block 1219, it is determined whether the player has a preferred gaming unit he would like to use during the gaming tournament. If the player desires to reserve, or fix, a particular gaming unit for the tournament, he may select the "fixed machine mode" option at block 1219.

Upon player selection of the fixed mode option, at block 1220, the gaming unit forwards the player's selections (e.g. single player, anonymous mode, fixed machine mode, tournament type, tournament time, etc.) to a network computer server such as network computer 22. Due to the player's request for anonymity, a user identification number (User ID) associated with the player's selections is assigned at block 1221. In response, at block 1222, the network computer 22 assigns a session identification number (Session ID) associated with the player's selections, and generates an "admission ticket" displaying the players selections as well as other information, including a bar code, needed to allow player entry into the tournament. The network computer 22 then forwards the admission ticket to player via the gaming unit 20 at block 1223. At block 1224, the ticket printer 56 may then print the admission ticket, or tournament admission voucher, reflecting the player's selections and the assigned User ID.

FIG. 6A is an exemplary tournament admission voucher 1284 that may be printed at the gaming unit 20. The tournament admission voucher 1284 includes, among other things, a tournament date and time 1285, the time of the tournament enrollment 1286 by the player, the player, or User ID 1287, fixed mode notation 1288 including the reserved gaming unit machine number, and a session number 1289.

Returning to block 1219, if the player does not select the fixed gaming machine mode, indicating that he does not wish to reserve a gaming unit during tournament play, it may be assumed that the player has selected a "float machine mode" by default. The float machine mode allows a player to select any open tournament gaming machine of their choice at the time of the tournament. Upon a determination of the float machine mode option, the gaming unit forwards the player's selections (e.g. single player, anonymous mode, float machine mode, tournament type, tournament time, etc.) to the network computer 22. Due to the player's request for anonymity, a User ID associated with the player's selections is assigned at block 1226. In response, at block 1227, the network computer 22 assigns a Session ID associated with the player's selections, and generates an "admission ticket" displaying the players selections as well as other information, including a bar code, needed to allow player entry into the tournament. The network computer 22 then forwards the admission ticket to the player via the gaming unit 20 at block 1228. At block 1224, the ticket printer 56 may then be print tournament admission voucher, reflecting the player's selections and the assigned User ID.

FIG. 6C is an exemplary tournament admission voucher 1292 that may be printed at the gaming unit 20. The tournament admission voucher 1292 includes, among other things, a float mode notation 1293 indicating that the player may choose any suitable gaming unit for tournament play, and a bar code 1294 encoded with all necessary information associating the player with his tournament preferences, etc. In addition, the tournament admission voucher ticket includes machine the tournament date and time, the time of the tournament enrollment by the player, the player or User ID, the fee paid, and a session number.

If the player does not choose to remain anonymous at block 1216, the player may enroll in the tournament via inserting his/her player tracking card in the card reader 58 at block 1229. In the alternative, the player may input his/her player name via the touchscreen display 59 or the color video display unit 70 with touch screen capability, the video display monitor 61, the button operated control panel 66, or a combination thereof, depending on the configuration of the gaming unit 20. Use of the player tracking card allows fees for the gaming tournament to be transferred from the player account or allows credits to be transferred to the player account via the network computer 22. The player may continue to enroll in the tournament at block 1230 by choosing a particular type of tournament, for example, a slots tournament where the winner among multiple players playing slots is determined by the number of points he accrues during a predetermined time period, by selecting a time slot which may or may not be within the hour, and by paying fees as required.

Referring to FIG. 15C, after the tournament and time slot has been selected and the fees paid, the player may enter his tournament preferences into the gaming unit 20 via the touchscreen display 59 or the color video display unit 70 with touch screen capability, the button operated control panel 66, or a combination thereof, depending on the configuration of the gaming unit 20. The player's tournament preferences may include participating in the tournament as a single player playing in a standard mode. The gaming unit 20 records the player's preferences to participate in the tournament as a standard, single player, at block 1231. Next, at block 1232, it is determined whether the player has a preferred gaming unit he would like to use during the gaming tournament. If the player desires to reserve, or fix, a particular gaming unit for the tournament, he may select the "fixed machine mode" option at block 1232.

Upon player selection of the fixed mode option, the gaming unit forwards the player's selections (e.g. single player, standard mode, fixed machine mode, tournament type, tournament time, etc.) to the network computer 22. In response, at block 1235, the network computer 22 generates an "admission ticket" containing the players selections as well as other information needed to allow player entry into the tournament, including a Session ID associated with the player's selections. The network computer 22 then forwards the admission ticket to player via the gaming unit 20 at block 1236. At block 1224, the ticket printer 56 may then print the tournament admission voucher including the player's name and the Session ID, and reflecting the player's selections.

Figure 16A:
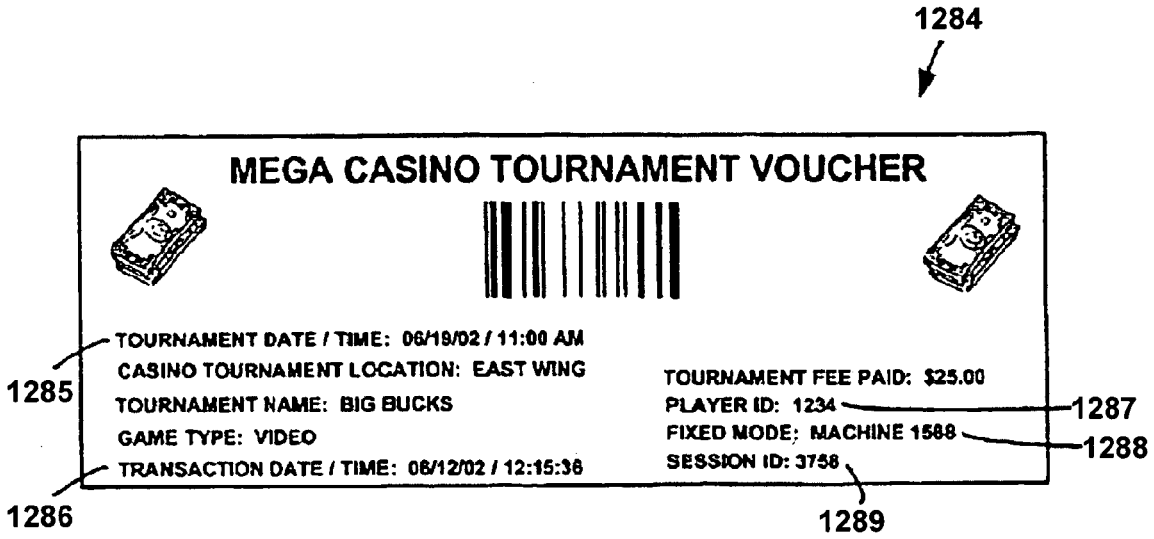
FIG. 16A is an exemplary tournament voucher ticket that may be used by an anonymous single player enrolled in a gaming tournament while located at a reserved gaming unit during performance of the main routine.
Figure 16B:
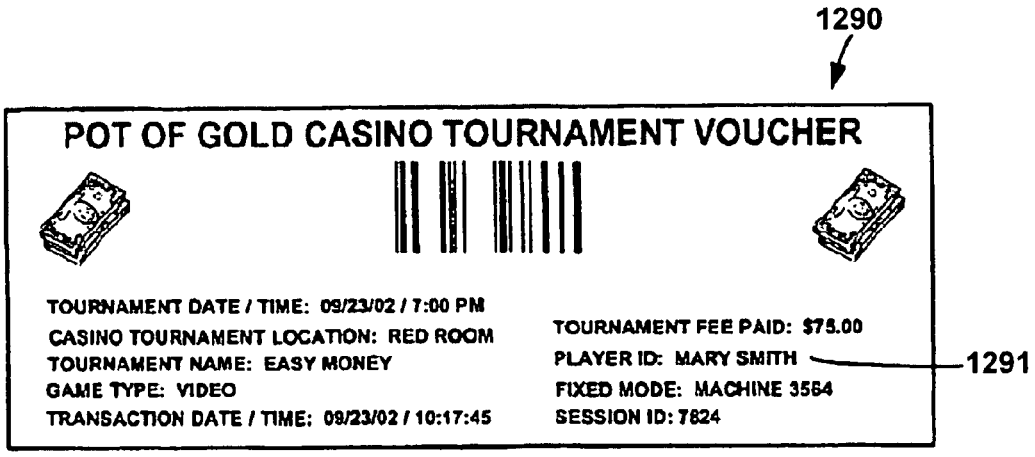
FIG. 16B is an exemplary tournament voucher ticket that may be used by a non-anonymous single player enrolled in a gaming tournament while located at a reserved gaming unit during performance of the main routine.

FIG. 16B is an exemplary tournament admission voucher 1290 that may be printed at the gaming unit 20. The tournament admission voucher 1290 includes, among other things, a player identification name 1291, indicating that the player either inserted his/her player tracking card, or manually entered their player name at block 1229. The tournament admission ticket voucher 1290 also includes the tournament date and time, the time of the tournament enrollment by the player, fixed mode notation including the reserved gaming unit machine number, and a session number.

Returning to block 1232, if the player does not select the fixed gaming machine mode, indicating that he does not wish to reserve a gaming unit during tournament play, it may be assumed that the player has selected a "float machine mode" by default. Upon a determination of the float machine mode option, at block 1237 the gaming unit forwards the player's selections (e.g. single player, standard mode, float machine mode, tournament type, tournament time, etc.) to the network computer 22. In response, at block 1238, the network computer 22 generates an "admission ticket" containing the players selections as well as other information needed to allow player entry into the tournament including a Session ID associated with the player's selections. The network computer 22 then forwards the admission ticket to player via the gaming unit 20 at block 1239. At block 1224, the ticket printer 56 may then print the admission ticket, or tournament admission voucher, reflecting the player's selections, the player's name and the associated Session ID.

FIG. 16D is an exemplary tournament admission voucher 1295 that may be printed at the gaming unit 20. The tournament admission voucher 1295 includes, among other things, a float mode notation, the tournament date and time, the time of the tournament enrollment by the player, the player identification name, the fee paid, and the session number.

Returning to block 1214 of FIG. 15B, if the player chooses not to participate in the gaming tournament as a single player entry, the player determines whether he would like to participate in the gaming tournament as a group player entry. The group player entry is appropriate where a player or a number of players wishes to join a group of players, for example, a group of female players, a group of players from Chicago, etc. If the group player entry is chosen at block 1241, the group player(s) selects a tournament group from a list of groups, and then enters the number of player(s) joining that particular group via the touchscreen display 59 or the color video display unit 70 with touch screen capability, the video display monitor 61, the button operated control panel 66, or a combination thereof, depending on the configuration of the gaming unit 20.

In the alternative, if the group player entry is chosen at block 1241, the group player(s) may select a group from a list of groups, may enter the number of player(s) joining that particular group, and may receive a group identification number associated with the group. and selects a tournament time slot via a number of interfaces including, for example, the touch screen 59 or the color video display unit 70 with touch screen capability, the control panel 66 depicted as a button panel in FIG. 13, a scantron type form, a voice input, etc. Next, if it is determined that a player has chosen to participate in the gaming tournament as a group player entry, the player determines whether he would like to remain anonymous throughout the gaming tournament at block 1242.

If the player chooses to remain anonymous at block 1242, an image, screen-name, and/or sound bytes are selected at block 1299 to effectively represent the player. Further, the player may enroll in the tournament via the touchscreen display 59 or the color video display unit 70 with touch screen capability, the video display monitor 61, the button operated control panel 66, or a combination thereof, depending on the configuration of the gaming unit 20. The player may enroll in the tournament at block 1243 by choosing a particular type of tournament, by selecting a time slot which may or may not be within the hour, and by paying fees as required.

Figure 15D:
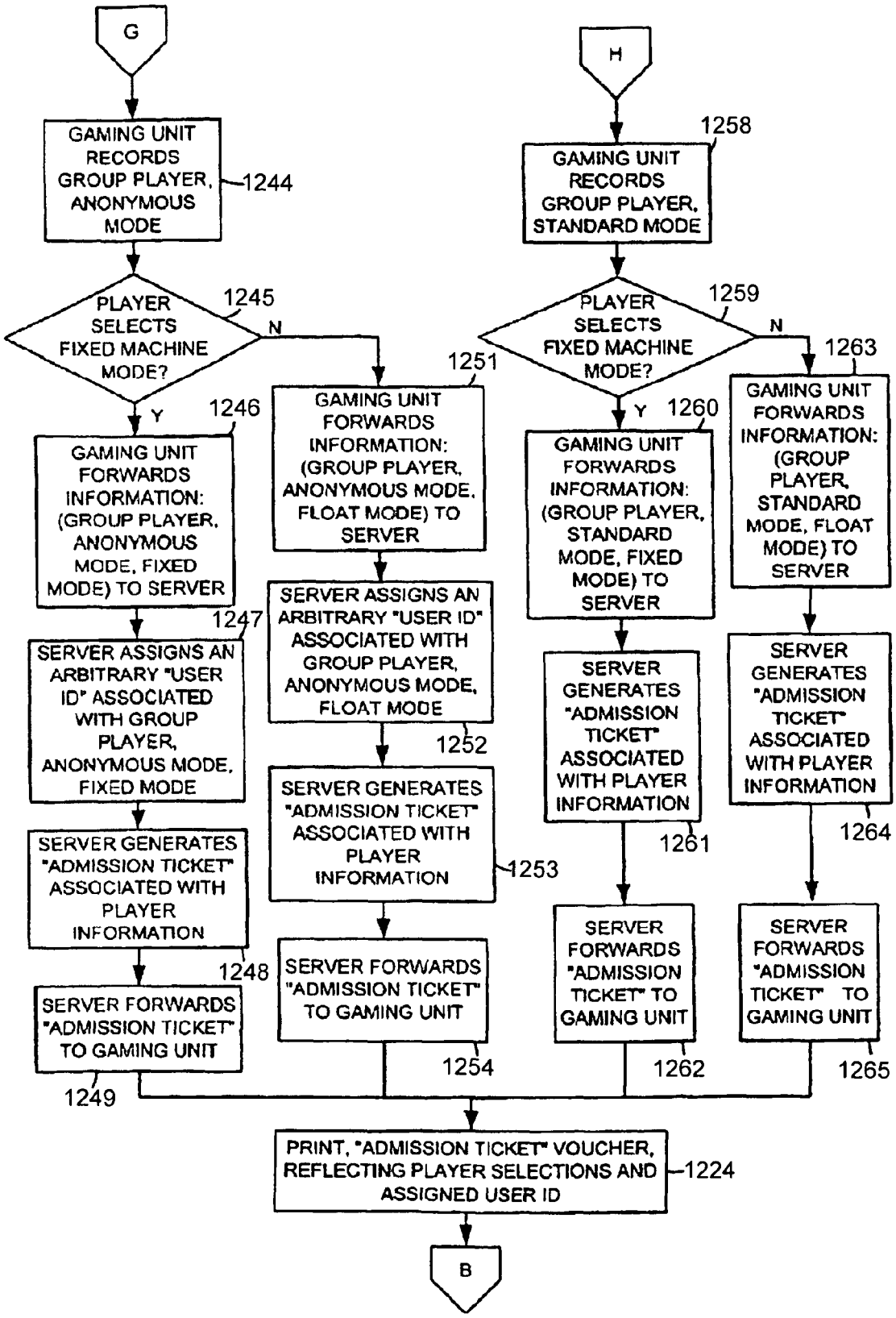

Referring to FIG. 15D, after the tournament type and time slot have been selected and the fees paid, the player may enter his tournament preferences into the gaming unit 20 via the touchscreen display 59 or the color video display unit 70 with touch screen capability, the video display monitor 61, the button operated control panel 66, or a combination thereof, depending on the configuration of the gaming unit 20. The player's tournament preferences may include participating in the tournament as a group player entry playing in an anonymous mode. The gaming unit 20 records the player's preferences to participate in the tournament as an anonymous, group player, at block 1244. Next, at block 1245, it is determined whether the player has a preferred gaming unit he would like to use during the gaming tournament. If the player desires to reserve a particular gaming unit for the tournament, he may select the "fixed machine mode" option at block 1245.

Upon player selection of the fixed mode option, the gaming unit forwards, at block 1246, the player's selections (e.g. group player, anonymous mode, fixed machine mode, tournament type, tournament time, etc.) to a network computer server such as network computer 22. Due to the player's request for anonymity, a User ID associated with the player's selections is assigned at block 1247. In response, at block 1248, the network computer 22 assigns a Session ID, and generates an "admission ticket" containing the players selections as well as other information needed to allow player entry into the tournament. The network computer 22 then forwards the admission ticket to player via the gaming unit 20 at block 1249. At block 1224, the ticket printer 56 may then print the admission ticket, or tournament admission voucher, reflecting the player's selections and the assigned User ID.

Returning to block 1245, if the player does not select the fixed gaming machine mode, indicating that he does not wish to reserve a gaming unit during tournament play, it may be assumed that the player has selected a "float machine mode" by default. Upon a determination of the float machine mode option, the gaming unit forwards the player's selections (e.g. group player, anonymous mode, float machine mode, tournament type, tournament time, etc.) to the network computer 22. Again, due to the player's request for anonymity, a User ID associated with the player's selections is assigned at block 1252. In response, at block 1253, the network computer 22 assigns a Session ID, and generates an "admission ticket" containing the players selections as well as other information needed to allow player entry into the tournament. The network computer 22 then forwards the admission ticket to player via the gaming unit 20 at block 254. At block 1224, the ticket printer 56 may then print the admission ticket, or tournament admission voucher, reflecting the player's selections and the assigned User ID.

If the player does not choose to remain anonymous at block 1242, the player may enroll in the tournament via inserting his player tracking card in the card reader 58 at block 1255. In the alternative, the player may input his player name via the touchscreen display 59 or the color video display unit 70 with touch screen capability, the video display monitor 61, the button operated control panel 66, or a combination thereof, depending on the configuration of the gaming unit 20. Use of the player tracking card allows fees for the gaming tournament to be transferred from the player account or allows credits to be transferred to the player account via the network computer 22. At this point, the player may wish to enroll additional players to form a group, at block 1256. At block 1255, the additional players may simply insert their player tracking cards, one by one, or may enter the player identification name, one by one, until their group is complete. Upon completion of entry of the group members identity, the player(s) may continue to enroll in the tournament at block 1257 by choosing a particular type of tournament, by selecting a time slot which may or may not be within the hour, and by paying fees as required.

Referring to FIG. 15D, after the tournament type and time slot has been selected and the fees paid, the player(s) may enter his tournament preferences into the gaming unit 20 via the touchscreen display 59 or the color video display unit 70 with touch screen capability, the video display monitor 61, the button operated control panel 66, or a combination thereof, depending on the configuration of the gaming unit 20. The tournament preferences may include participating in the tournament as a group player in a standard mode. The gaming unit 20 records then the player(s) wishes to participate in the tournament as a standard, group player, at block 1258. Next, at block 1259, it is determined whether the player has a preferred gaming unit he would like to use during the gaming tournament. If the player desires to reserve, or fix, a particular gaming unit for the tournament, he may select the "fixed machine mode" option at block 1259.

Upon player selection of the fixed mode option, the gaming unit forwards the player's selections (e.g. group player, standard mode, fixed machine mode, tournament type, tournament time, etc.) to the network computer 22. In response, at block 1261, the network computer 22 generates an "admission ticket" containing the players selections as well as other information needed to allow player entry into the tournament, including a Session ID associated with the player's selections. The network computer 22 then forwards the admission ticket to player via the gaming unit 20 at block 1262. At block 1224, the ticket printer 56 may then print the tournament admission voucher including the player's name, the Session ID, and reflecting the player's selections.

Returning to block 1259, if the player does not select the fixed gaming machine mode, indicating that he does not wish to reserve a gaming unit during tournament play, it may be assumed that the player has selected a "float machine mode" by default. Upon a determination of the float machine mode option, at block 1263, the gaming unit forwards the player's selections (e.g., group player, anonymous mode, float machine mode, tournament type, tournament time, etc.) to the network computer 22. In response, at block 1264, the network computer 22 generates an "admission ticket" containing the players selections as well as other information needed to allow player entry into the tournament including a Session ID associated with the player's selections. The network computer 22 then forwards the admission ticket to player via the gaming unit 20 at block 1265. At block 1224, the ticket printer 56 may then print tournament admission voucher, At block 1224, the ticket printer 56 may then print the tournament admission voucher including the player's name, the Session ID, and reflecting the player's selections.

Figure 15E:
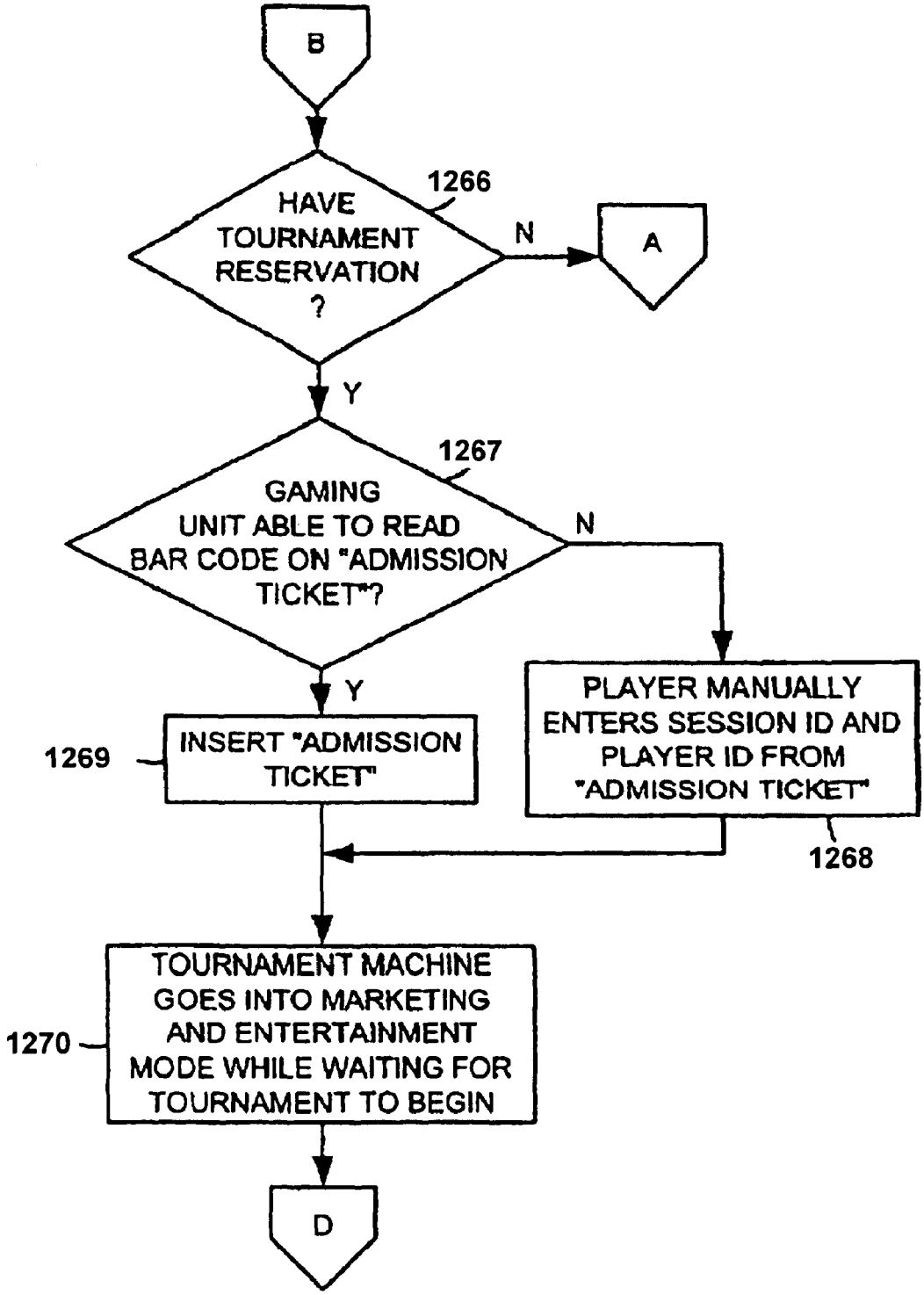
Figure 15F:
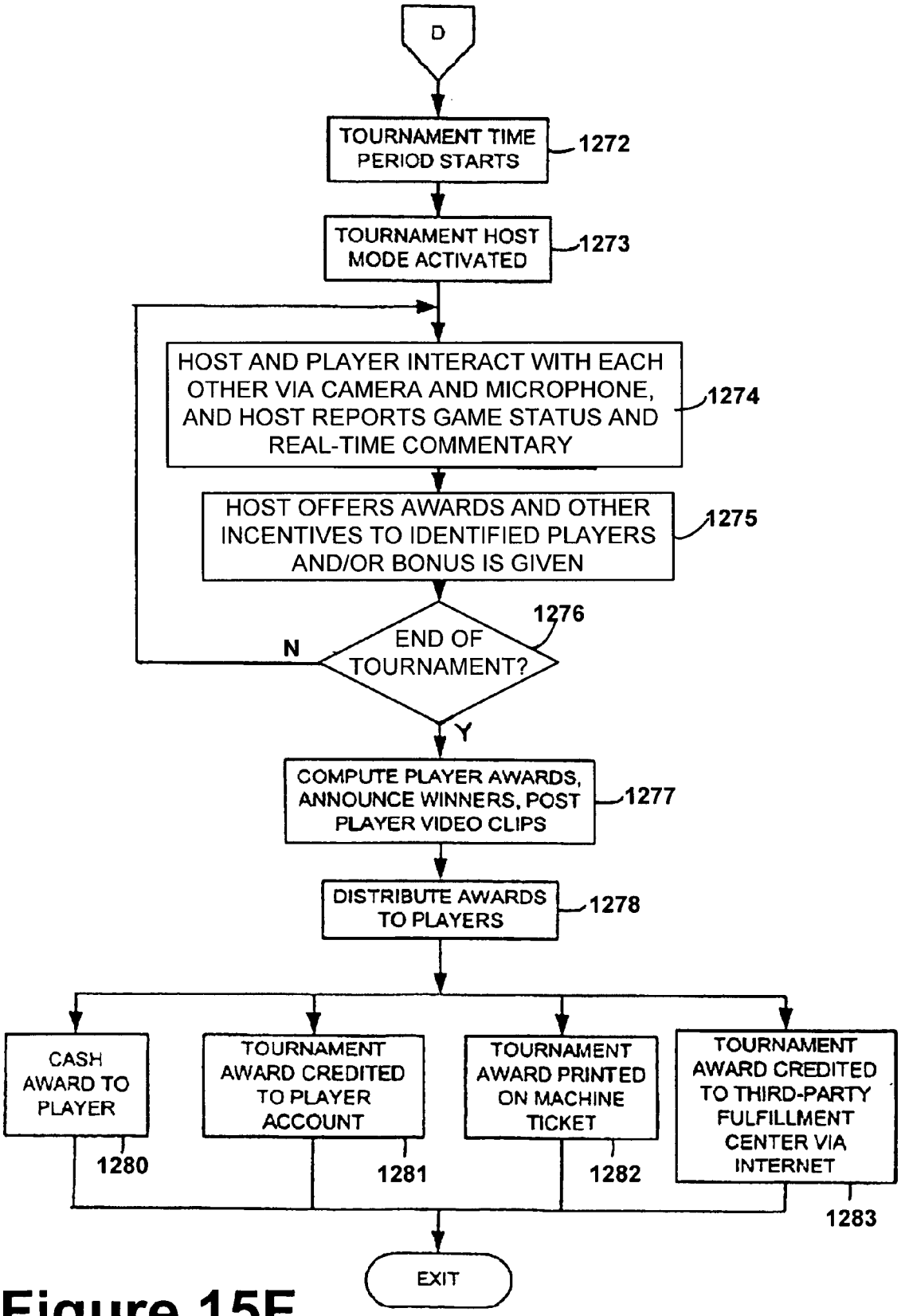

Referring to FIG. 15E, a tournament player may be required to have a tournament ticket voucher indicating that the player has made a tournament reservation, at block 1266. If the player is required to have a tournament reservation, and does not, he may enroll in the tournament as described in connection with FIGS. 15B-15D. If the player does have a tournament reservation, he may confirm his reservation at the gaming unit he intends to use during the gaming tournament. If the player has a tournament ticket voucher indicating a fixed mode selection, he may confirm his tournament reservation at the gaming unit indicated on the tournament ticket voucher. If, however, the player has a tournament ticket voucher indicating a float mode selection, he may confirm his tournament reservation at any appropriate gaming unit.

Once at the gaming unit to be used during the tournament, the player may confirm his reservation in a number of ways, depending on the configuration of the gaming machine. If the gaming unit is able to read the bar code imprinted on the tournament ticket voucher, the player may simply confirm his reservation via inserting the tournament ticket voucher into the appropriate slot on the gaming unit, at block 1269. If the gaming unit 20 is an older model that is not configured to the read bar code printed on the tournament ticket voucher, the player may be required to confirm his reservation at block 1268 by manually entering the (i) session ID and (ii) player ID printed on the tournament ticket voucher. Upon completion of tournament reservation verification at either block 1269 or block 1268, the gaming unit 20 goes into a marketing and/or entertaining mode while awaiting the tournament start time, at block 1270.

As the start time for the tournament draws near, the player is notified, for example, in a count-down fashion, to prepare to begin tournament play. The player is given instructions via text appearing on a visual display of the selected gaming unit, or via demonstration games presented to the player during enrollment. The tournament players are given an indication when the preselected tournament start time begins, at block 1272. The tournament host mode is then activated at block 1273. Once activated, the tournament host mode allows audio and/or visual communication between the players and the host. Audio and/or visual communication can be input by a tournament player at the gaming unit 20 and sent to the host computer 46 and the gaming host 47 at block 1274. Likewise, at block 1274, the tournament host mode allows audio and/or visual communication from the gaming host 47 at the host computer 46, to the tournament player at gaming unit 20. It should be noted that one or more players can interact with each other and the host in a "full-duplex" mode where audio and video is effectively provided in a "live" manner in order to simulate a real gaming environment. If a player has chosen to remain anonymous during the gaming tournament, however, he may abstain from sending audio and/or visual communication with the tournament host 47. In this way, the gaming system 10 utilizes the bidirectional audio and/or visual and/or data communication between the tournament host 47 and the tournament players to provide tournament players with an interactive and therefore, an enhanced gaming experience as described above.

In addition, due to the two-way audio and/or visual and/or data nature of the communication between the tournament host 47 and the tournament players, at block 1274, the tournament host 47 is able to offer awards and incentives throughout the gaming tournament rather than wait until the end of the tournament to award the final prizes, at block 1275. This ability to offer "event-driven" prizes, synchronized to specific events, further enhances the gaming experience. For example, the tournament host may offer to give 500 credit points to the next the tournament player who hits all cherries during a slot tournament. In another example, the tournament host 47 may award an extra five minutes of play time to the players at a particular casino site if any team member hits a jackpot. In addition, a bonus may be given to the players. The bonus can, for example, be based on a random event such as a virtual camera rotating to a player chosen at random. As another example, the bonus may be based on a game specific event (e.g., who ever gets a full-house). The bonus may also be given, for example, to persons that provide a live image.

When the gaming tournament is over at decision block 1276, the awards are computed, the winners may be announced, and video feed of the winners may be broadcast to the tournament players at block 1277. The awards are then distributed to the winners at block 1278 using a variety of award means. The award means may include dispensing cash to the player at block 1280, or may include adding credits to the player tracking cards associated with tournament player winners who registered for the gaming tournament via their player tracking cards, at block 1281. The award means may also include dispensing a machine ticket printed from a gaming machine printer and indicating the nature or amount of the award at block 1282. In addition, at block 1283, the tournament award may be credited to a third party fulfillment center where the winner can redeem points for a variety of merchandise awards from merchants, for example, Amazon.com, Macy.com, etc.

Figure 17:
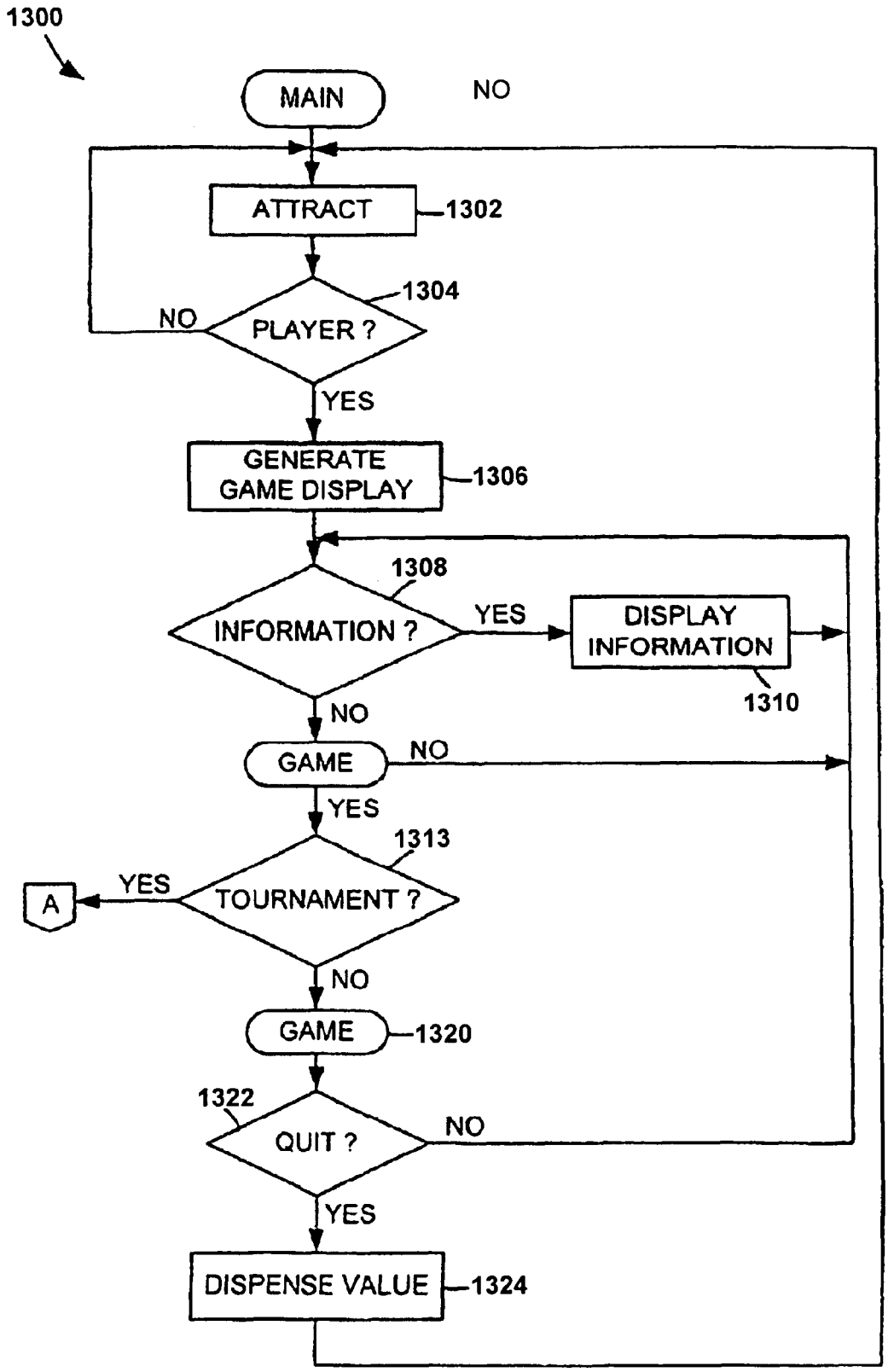
FIG. 17 is a flowchart of an alternative embodiment of a main routine that may be performed during operation of one or more of the gaming units.

FIG. 17 is a flowchart of an alternative main operating routine 1300 that may be stored in the memory of the controller 1000. The main routine 1300 may be utilized for gaming units 20 that are designed to allow play of a single game or a tournament game. Referring to FIG. 7, the main routine 1300 may begin operation at block 1302 during which an attraction sequence may be performed in an attempt to induce a potential player in a casino to play the gaming unit 20. The attraction sequence may be performed by displaying one or more video images on the color video display unit 70 and/or causing one or more sound segments, such as voice or music, to be generated via the speakers 62.

During performance of the attraction sequence, if a potential player makes any input to the gaming unit 20 as determined at block 1304, the attraction sequence may be terminated and a game display may be generated on the color video display unit 70 at block 1306. The game display generated at block 1306 may include, for example, an image of the casino game that may be played on the gaming unit 20 and/or a visual message to prompt the player to deposit value into the gaming unit 20. At block 1308, the gaming unit 20 may determine if the player requested information concerning the game, in which case the requested information may be displayed at block 1310. At block 1312, it is determined whether the player requested initiation of a game, in which case, the controller 100 may cause an additional game selection option at block 1313. At block 1313, it is determined whether the player wishes to play the game individually or wishes to participate in a gaming tournament, thereby competing with other tournament players located at other gaming machines.

If the individual player selects the option to play the game individually, the controller 1000 may cause one of a number of game routines 1320 may be performed. The game routine 1320 could be any one of the game routines disclosed herein, such as one of the five game routines 1207, 1208, 1209, 1210, 1211, or another game routine.

After the routine 1320 has been performed to allow the player to play the game, block 1322 may be utilized to determine whether the player wishes to terminate play on the gaming unit 20. If the player wishes to stop playing the gaming unit 20, which wish may be expressed, for example, by selecting a "Cash Out" button, the controller 1000 may dispense value to the player at block 1324 based on the outcome of the game(s) played by the player. The operation may then return to block 1302. If the player did not wish to quit as determined at block 1322, the operation may return to block 308.

If the player selects to participate in a gaming tournament at block 1313, the routine 1300 branches to block 1214 shown on FIG. 15B where it is determined if the player prefers to participate as a single player entry or a group player entry. The player selecting tournament play may then enroll, make player selections, verify tournament reservations, and play in the tournament as described in connection with FIGS. 15B-15F.

Video Poker

Figure 18:
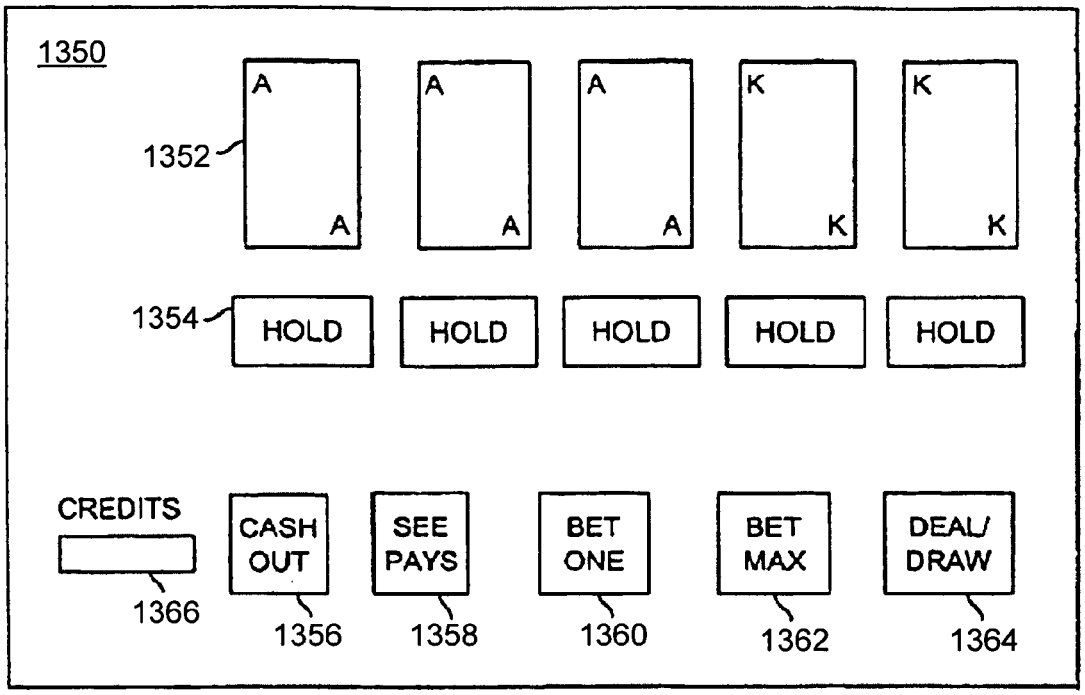
FIG. 18 is an illustration of an embodiment of a visual display that may be displayed during performance of the video poker routine of FIG. 20.

FIG. 18 is an exemplary display 1350 that may be shown on the color video display unit 70 during performance of the video poker routine 1207 shown schematically in FIG. 15A. Referring to FIG. 18, the display 1350 may include video images 1352 of a plurality of playing cards representing the player's hand, such as five cards. To allow the player to control the play of the video poker game, a plurality of player-selectable buttons may be displayed. The buttons may include a "Hold" button 1354 disposed directly below each of the playing card images 1352, a "Cash Out" button 1356, a "See Pays" button 1358, a "Bet One Credit" button 1360, a "Bet Max Credits" button 1362, and a "Deal/Draw" button 1364. The display 1350 may also include an area 1366 in which the number of remaining credits or value is displayed. If the color video display unit 70 is provided with a touch-sensitive screen, the buttons 1354, 1356, 1358, 1360, 1362, 1364 may form part of the video display 1350. Alternatively, one or more of those buttons may be provided as part of a control panel that is provided separately from the color video display unit 70.

Figure 20:
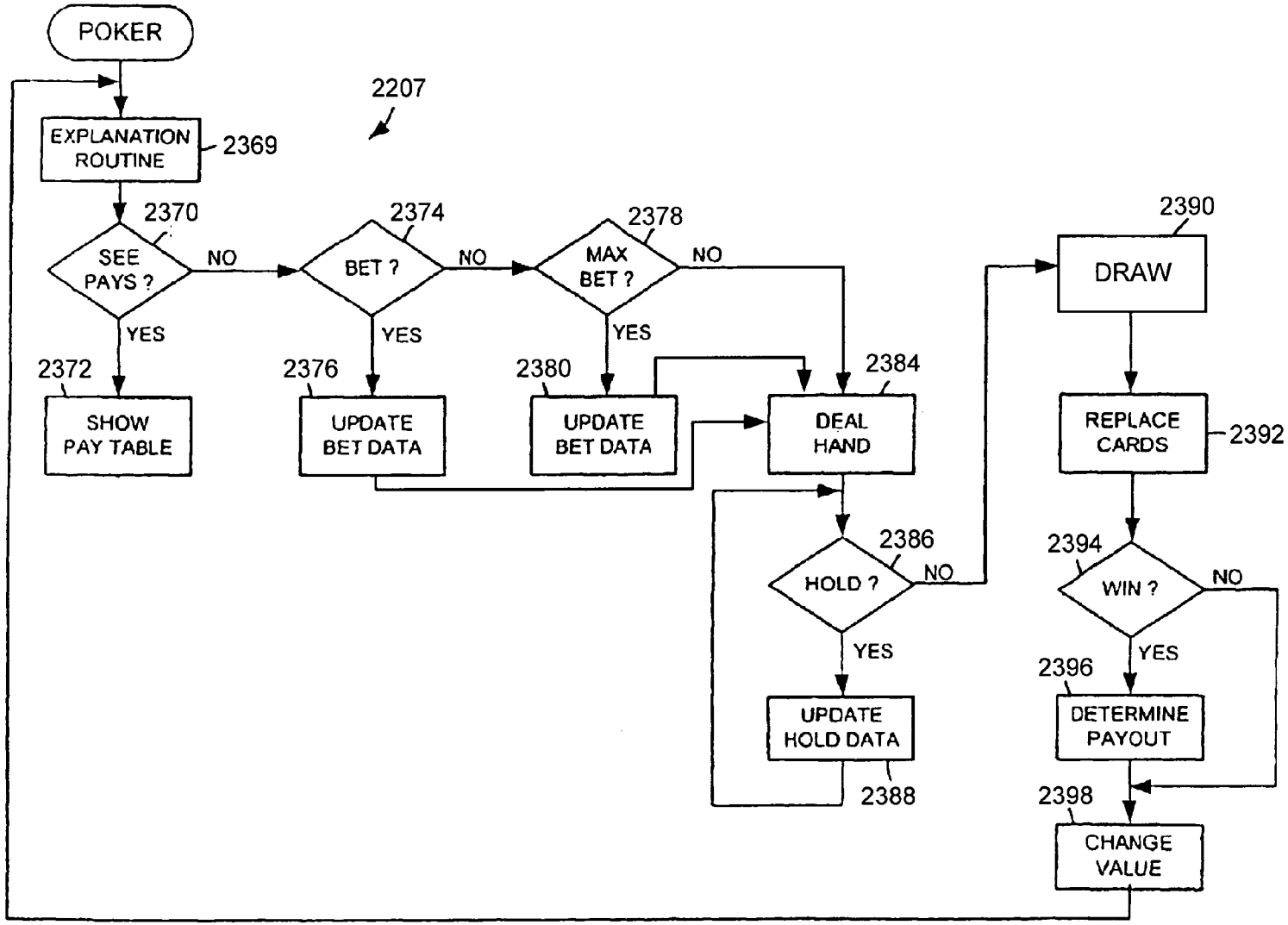
FIG. 20 is a flowchart of an embodiment of a video poker routine that may be performed by one or more of the gaming units.

FIG. 20 is a flowchart of the video poker routine 2207 shown schematically in FIG. 15A. Referring to FIG. 10, after an explanation routine (2369), at block 2370, the routine may determine whether the player has requested payout information, such as by activating the "See Pays" button 2358, in which case at block 2372 the routine may cause one or more pay tables to be displayed on the color video display unit 70. At block 2374, the routine may determine whether the player has made a bet, such as by pressing the "Bet One Credit" button 2360, in which case at block 2376 bet data corresponding to the bet made by the player may be stored in the memory of the controller 1000. At block 2378, the routine may determine whether the player has pressed the "Bet Max Credits" button 2362, in which case at block 2380 bet data corresponding to the maximum allowable bet may be stored in the memory of the controller 100.

, Subsequently, at block 2384 a video poker hand may be "dealt" by causing the color video display unit 70 to generate the playing card images 2352. After the hand is dealt, at block 2386 the routine may determine if any of the "Hold" buttons 2354 have been activated by the player, in which case data regarding which of the playing card images 2352 are to be "held" may be stored in the controller 100 at block 2388. If the "Deal/Draw" button 2364 is activated again at block 2390, each of the playing card images 2352 that was not "held" may be caused to disappear from the video display 2350 and to be replaced by a new, randomly selected, playing card image 2352 at block 2392.

At block 2394, the routine may determine whether the poker hand represented by the playing card images 2352 currently displayed is a winner. That determination may be made by comparing data representing the currently displayed poker hand with data representing all possible winning hands, which may be stored in the memory of the controller 1000. If there is a winning hand, a payout value corresponding to the winning hand may be determined at block 2396. At block 2398, the player's cumulative value or number of credits may be updated by subtracting the bet made by the player and adding, if the hand was a winner, the payout value determined at block 2396. The cumulative value or number of credits may also be displayed in the display area 2366 (FIG. 18).

Although the video poker routine 2207 is described above in connection with a single poker hand of five cards, the routine 2207 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Video Blackjack

Figure 19:
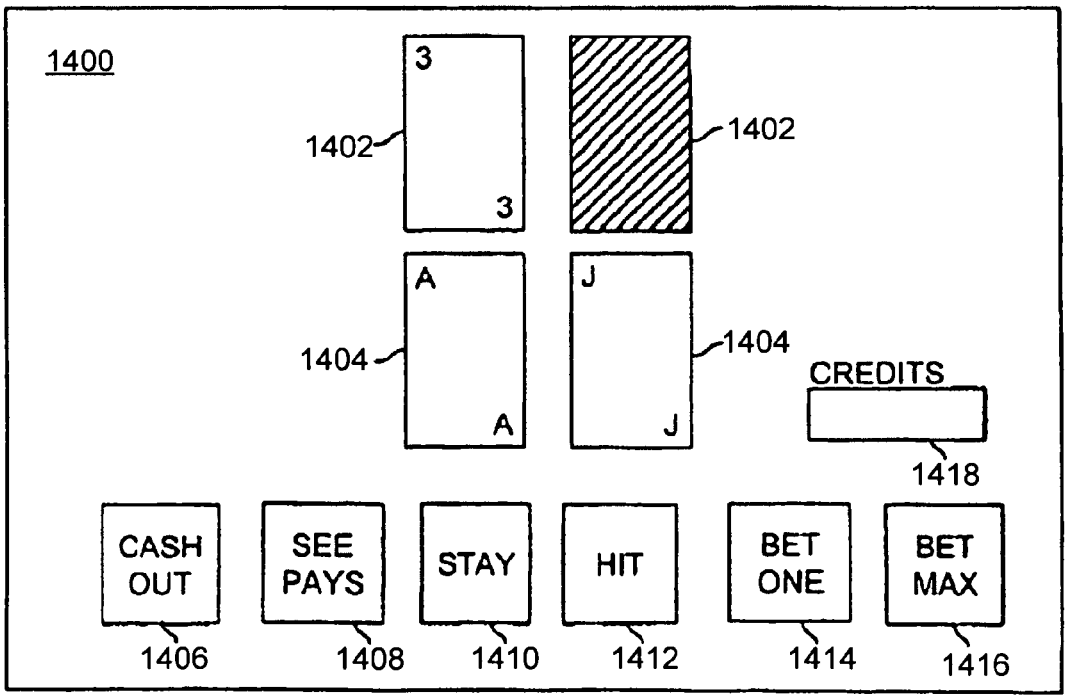
FIG. 19 is an illustration of an embodiment of a visual display that may be displayed during performance of the video blackjack routine of FIG. 21.

FIG. 19 is an exemplary display 1400 that may be shown on the color video display unit 70 during performance of the video blackjack routine 1208 shown schematically in FIG. 15A. Referring to FIG. 19, the display 1400 may include video images 1402 of a pair of playing cards representing a dealer's hand, with one of the cards shown face up and the other card being shown face down, and video images 1404 of a pair of playing cards representing a player's hand, with both the cards shown face up. The "dealer" may be the gaming unit 20.

To allow the player to control the play of the video blackjack game, a plurality of player-selectable buttons may be displayed. The buttons may include a "Cash Out" button 406, a "See Pays" button 1408, a "Stay" button 1410, a "Hit" button 1412, a "Bet One Credit" button 1414, and a "Bet Max Credits" button 1416. The display 1400 may also include an area 1418 in which the number of remaining credits or value is displayed. If the color video display unit 70 is provided with a touch-sensitive screen, the buttons 1406, 1408, 1410, 1412, 1414, 1416 may form part of the video display 1400. Alternatively, one or more of those buttons may be provided as part of a control panel that is provided separately from the color video display unit 70.

Figure 21:
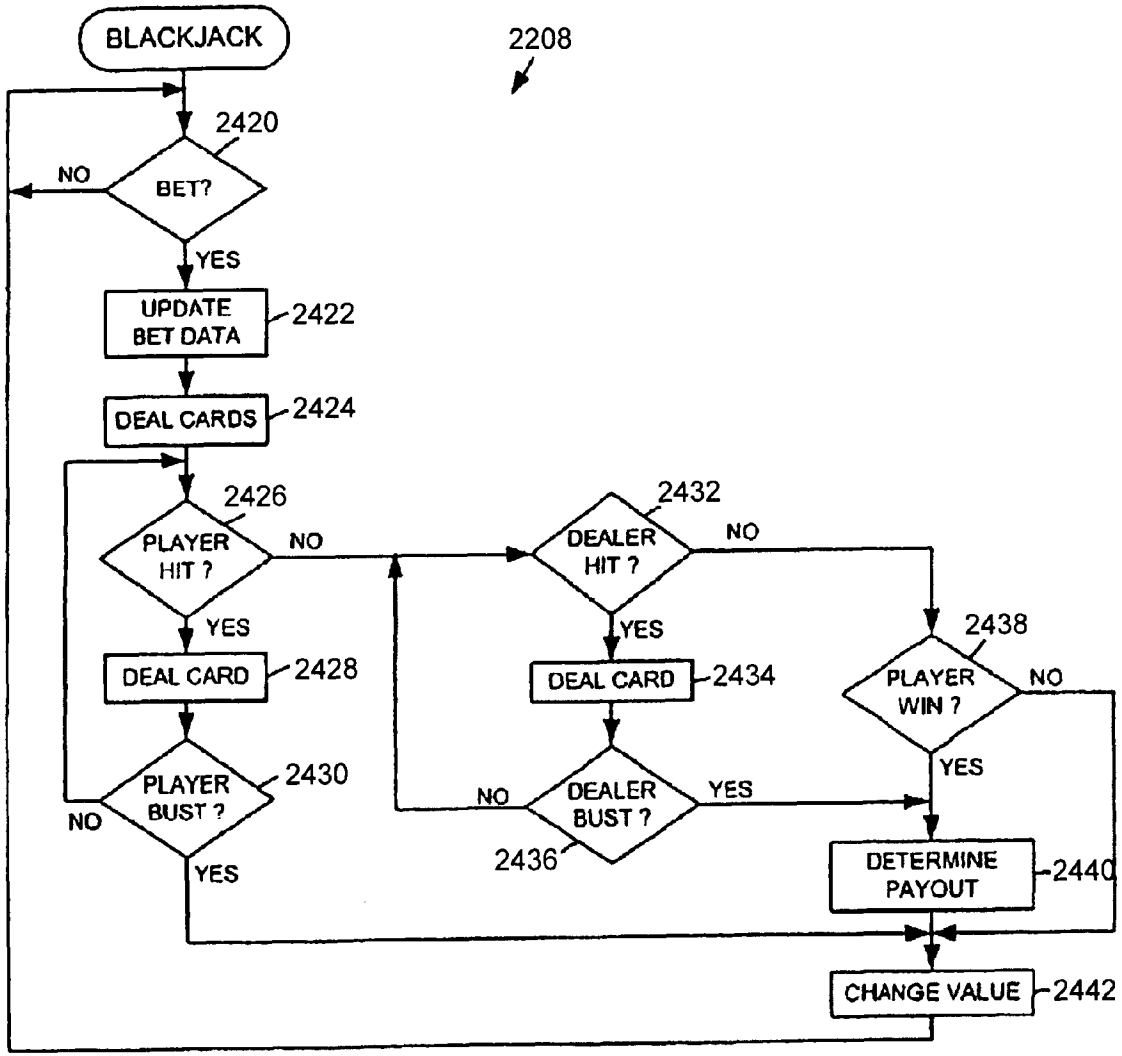
FIG. 21 is a flowchart of an embodiment of a video blackjack routine that may be performed by one or more of the gaming units.

FIG. 21 is a flowchart of the video blackjack routine 2208 shown schematically in FIG. 15A. Referring to FIG. 21, the video blackjack routine 2208 may begin at block 2420 where it may determine whether a bet has been made by the player. That may be determined, for example, by detecting the activation of either the "Bet One Credit" button 2414 or the "Bet Max Credits" button 2416. At block 2422, bet data corresponding to the bet made at block 2420 may be stored in the memory of the controller 1000. At block 2424, a dealer's hand and a player's hand may be "dealt" by making the playing card images 2402, 2404 appear on the color video display unit 70.

At block 2426, the player may be allowed to be "hit," in which case at block 2428 another card will be dealt to the player's hand by making another playing card image 1404 appear in the display 1400. If the player is hit, block 2430 may determine if the player has "bust," or exceeded 21. If the player has not busted, blocks 2426 and 2428 may be performed again to allow the player to be hit again.

If the player decides not to hit, at block 2432 the routine may determine whether the dealer should be hit. Whether the dealer hits may be determined in accordance with predetermined rules, such as the dealer always hit if the dealer's hand totals 15 or less. If the dealer hits, at block 2434 the dealer's hand may be dealt another card by making another playing card image 1402 appear in the display 1400. At block 2436 the routine may determine whether the dealer has bust. If the dealer has not bust, blocks 2432, 2434 may be performed again to allow the dealer to be hit again.

If the dealer does not hit, at block 2436 the outcome of the blackjack game and a corresponding payout may be determined based on, for example, whether the player or the dealer has the higher hand that does not exceed 21. If the player has a winning hand, a payout value corresponding to the winning hand may be determined at block 2440. At block 2442, the player's cumulative value or number of credits may be updated by subtracting the bet made by the player and adding, if the player won, the payout value determined at block 2440. The cumulative value or number of credits may also be displayed in the display area 1418 (FIG. 19).

Slots

Figure 22:
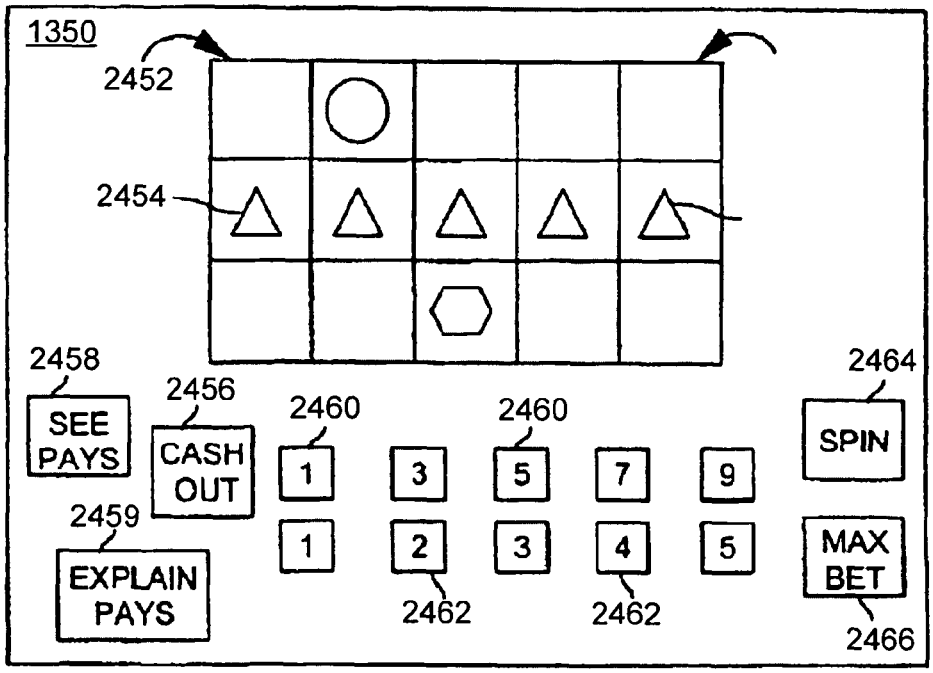
FIG. 22 is an illustration of an embodiment of a visual display that may be displayed during performance of the slots routine of FIG. 24.

FIG. 22 is an exemplary display 2450 that may be shown on the color video display unit 70 during performance of the slots routine 1209 shown schematically in FIG. 15A. Referring to FIG. 22, the display 2450 may include video images 2452 of a plurality of slot machine reels, each of the reels having a plurality of reel symbols 2454 associated therewith. Although the display 2450 shows five reel images 2452, each of which may have three reel symbols 2454 that are visible at a time, other reel configurations could be utilized.

To allow the player to control the play of the slots game, a plurality of player-selectable buttons may be displayed. The buttons may include a "Cash Out" button 2456, a "See Pays" button 2458, a plurality of payline-selection buttons 2460 each of which allows the player to select a different number of paylines prior to "spinning" the reels, a plurality of bet-selection buttons 2462 each of which allows a player to specify a wager amount for each payline selected, a "Spin" button 2464, and a "Max Bet" button 2466 to allow a player to make the maximum wager allowable.

Figure 24:
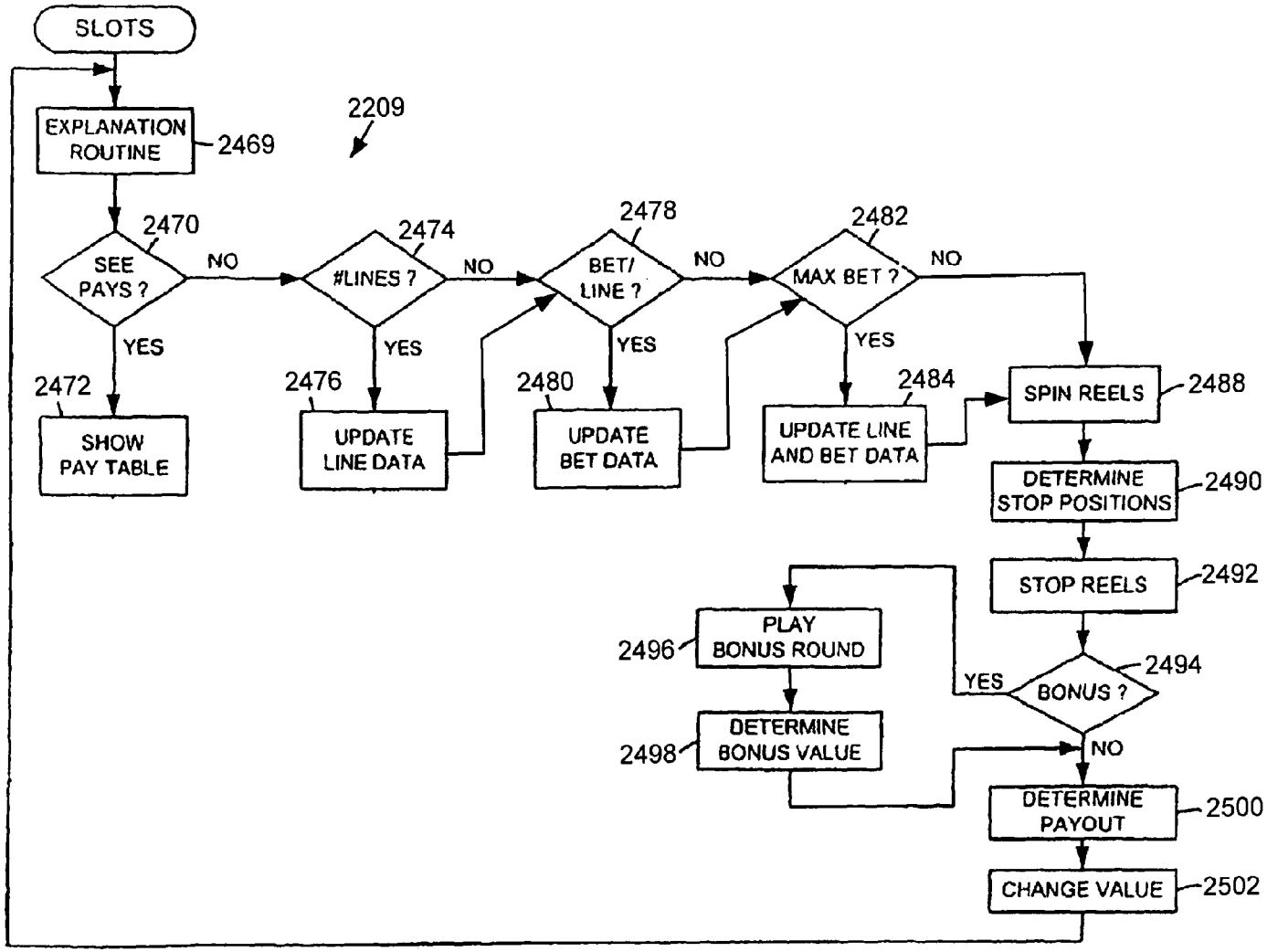
FIG. 24 is a flowchart of an embodiment of a slots routine that may be performed by one or more of the gaming units.

FIG. 24 is a flowchart of the slots routine 2209 shown schematically in FIG. 22. Referring to FIG. 24, at block 2470, the routine may determine whether the player has requested payout information, such as by activating the "See Pays" button 2458, in which case at block 2472 the routine may cause one or more pay tables to be displayed on the color video display unit 70. At block 2474, the routine may determine whether the player has pressed one of the payline-selection buttons 2460, in which case at block 2476 data corresponding to the number of paylines selected by the player may be stored in the memory of the controller 1000. At block 2478, the routine may determine whether the player has pressed one of the bet-selection buttons 2462, in which case at block 2480 data corresponding to the amount bet per payline may be stored in the memory of the controller 1000. At block 2482, the routine may determine whether the player has pressed the "Max Bet" button 2466, in which case at block 2484 bet data (which may include both payline data and bet-per-payline data) corresponding to the maximum allowable bet may be stored in the memory of the controller 1000.

If the "Spin" button 2464 has been activated by the player as determined at block 2486, at block 2488 the routine may cause the slot machine reel images 2452 to begin "spinning" so as to simulate the appearance of a plurality of spinning mechanical slot machine reels. At block 2490, the routine may determine the positions at which the slot machine reel images will stop, or the particular symbol images 2454 that will be displayed when the reel images 2452 stop spinning. At block 2492, the routine may stop the reel images 2452 from spinning by displaying stationary reel images 2452 and images of three symbols 2454 for each stopped reel image 2452. The virtual reels may be stopped from left to right, from the perspective of the player, or in any other manner or sequence.

The routine may provide for the possibility of a bonus game or round if certain conditions are met, such as the display in the stopped reel images 2452 of a particular symbol 2454. If there is such a bonus condition as determined at block 494, the routine may proceed to block 2496 where a bonus round may be played. The bonus round may be a different game than slots, and many other types of bonus games could be provided. If the player wins the bonus round, or receives additional credits or points in the bonus round, a bonus value may be determined at block 2498. A payout value corresponding to outcome of the slots game and/or the bonus round may be determined at block 2500. At block 2502, the player's cumulative value or number of credits may be updated by subtracting the bet made by the player and adding, if the slot game and/or bonus round was a winner, the payout value determined at block 2500.

Although the above routine has been described as a virtual slot machine routine in which slot machine reels are represented as images on the color video display unit 70, actual slot machine reels that are capable of being spun may be utilized instead.

Video Keno

Figure 23:
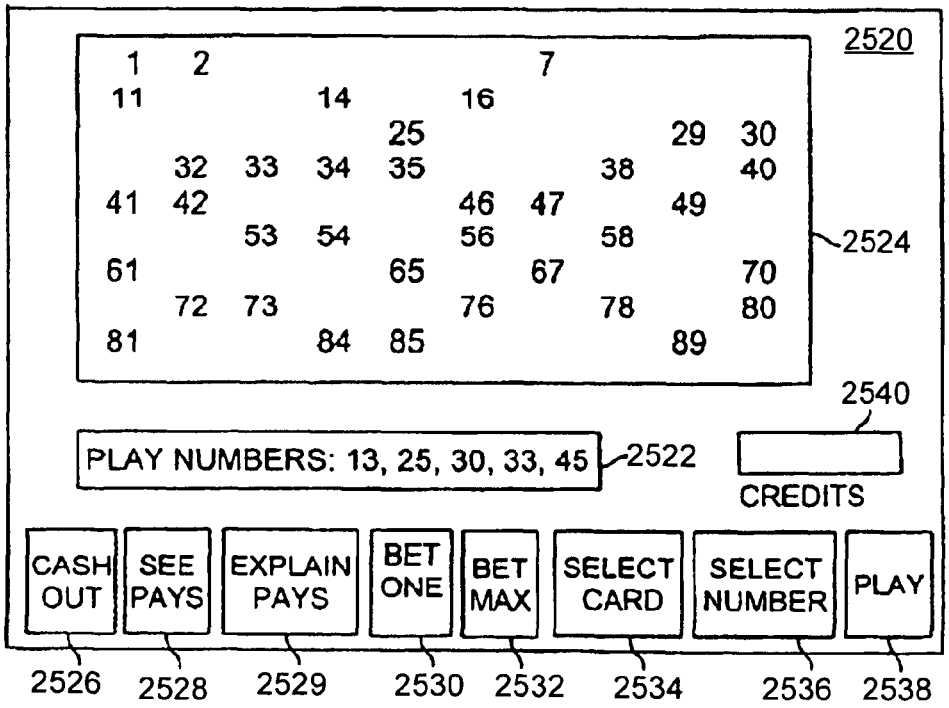
FIG. 23 is an illustration of an embodiment of a visual display that may be displayed during performance of the video keno routine of FIG. 25.

FIG. 23 is an exemplary display 2520 that may be shown on the color video display unit 70 during performance of the video keno routine 1210 shown schematically in FIG. 05A. Referring to FIG. 23, the display 2520 may include a video image 2522 of a plurality of numbers that were selected by the player prior to the start of a keno game and a video image 2524 of a plurality of numbers randomly selected during the keno game. The randomly selected numbers may be displayed in a grid pattern.

To allow the player to control the play of the keno game, a plurality of player-selectable buttons may be displayed. The buttons may include a "Cash Out" button 2526, a "See Pays" button 2528, a "Bet One Credit" button 2530, a "Bet Max Credits" button 2532, a "Select Ticket" button 2534, a "Select Number" button 2536, and a "Play" button 2538. The display 2520 may also include an area 2540 in which the number of remaining credits or value is displayed. If the color video display unit 70 is provided with a touch-sensitive screen, the buttons may form part of the video display 2520. Alternatively, one or more of those buttons may be provided as part of a control panel that is provided separately from the color video display unit 70.

Figure 25:
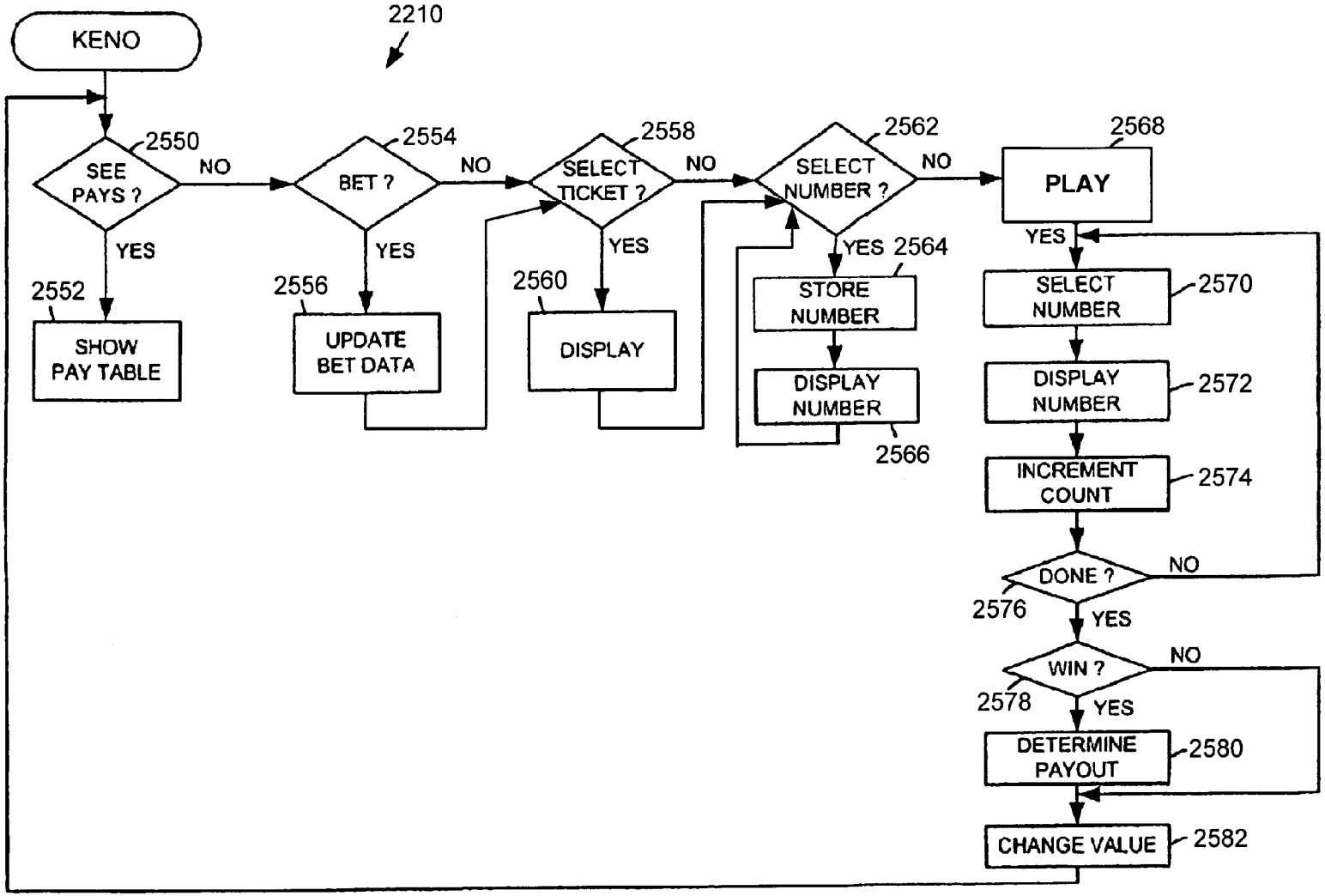
FIG. 25 is a flowchart of an embodiment of a video keno routine that may be performed by one or more of the gaming units.

FIG. 25 is a flowchart of the video keno routine 1210 shown schematically in FIG. 15A. The keno routine 1210 may be utilized in connection with a single gaming unit 20 where a single player is playing a keno game, or the keno routine 1210 may be utilized in connection with multiple gaming units 20 where multiple players are playing a single keno game. In the latter case, one or more of the acts described below may be performed either by the controller 1000 in each gaming unit or by one of the network computer 22, 32 to which multiple gaming units 20 are operatively connected.

Referring to FIG. 25, at block 2550, the routine may determine whether the player has requested payout information, such as by activating the "See Pays" button 2528, in which case at block 2552 the routine may cause one or more pay tables to be displayed on the color video display unit 70. At block 2554, the routine may determine whether the player has made a bet, such as by having pressed the "Bet One Credit" button 2530 or the "Bet Max Credits" button 2532, in which case at block 2556 bet data corresponding to the bet made by the player may be stored in the memory of the controller 1000. After the player has made a wager, at block 2558 the player may select a keno ticket, and at block 2560 the ticket may be displayed on the display 2520. At block 2562, the player may select one or more game numbers, which may be within a range set by the casino. After being selected, the player's game numbers may be stored in the memory of the controller 1000 at block 564 and may be included in the image 2522 on the display 2520 at block 2566. After a certain amount of time, the keno game may be closed to additional players (where a number of players are playing a single keno game using multiple gambling units 20).

If play of the keno game is to begin as determined at block 2568, at block 2570 a game number within a range set by the casino may be randomly selected either by the controller 1000 or a central computer operatively connected to the controller, such as one of the network computers 22, 32. At block 2572, the randomly selected game number may be displayed on the color video display unit 70 and the display units 70 of other gaming units 20 (if any) which are involved in the same keno game. At block 2574, the controller 1000 (or the central computer noted above) may increment a count which keeps track of how many game numbers have been selected at block 2570.

At block 2576, the controller 1000 (or one of the network computers 22, 32) may determine whether a maximum number of game numbers within the range have been randomly selected. If not, another game number may be randomly selected at block 2570. If the maximum number of game numbers has been selected, at block 2578 the controller 1000 (or a central computer) may determine whether there are a sufficient number of matches between the game numbers selected by the player and the game numbers selected at block 2570 to cause the player to win. The number of matches may depend on how many numbers the player selected and the particular keno rules being used.

If there are a sufficient number of matches, a payout may be determined at block 2580 to compensate the player for winning the game. The payout may depend on the number of matches between the game numbers selected by the player and the game numbers randomly selected at block 2570. At block 2582, the player's cumulative value or number of credits may be updated by subtracting the bet made by the player and adding, if the keno game was won, the payout value determined at block 2580. The cumulative value or number of credits may also be displayed in the display area 2540 (FIG. 23).

Video Bingo

Figure 26:
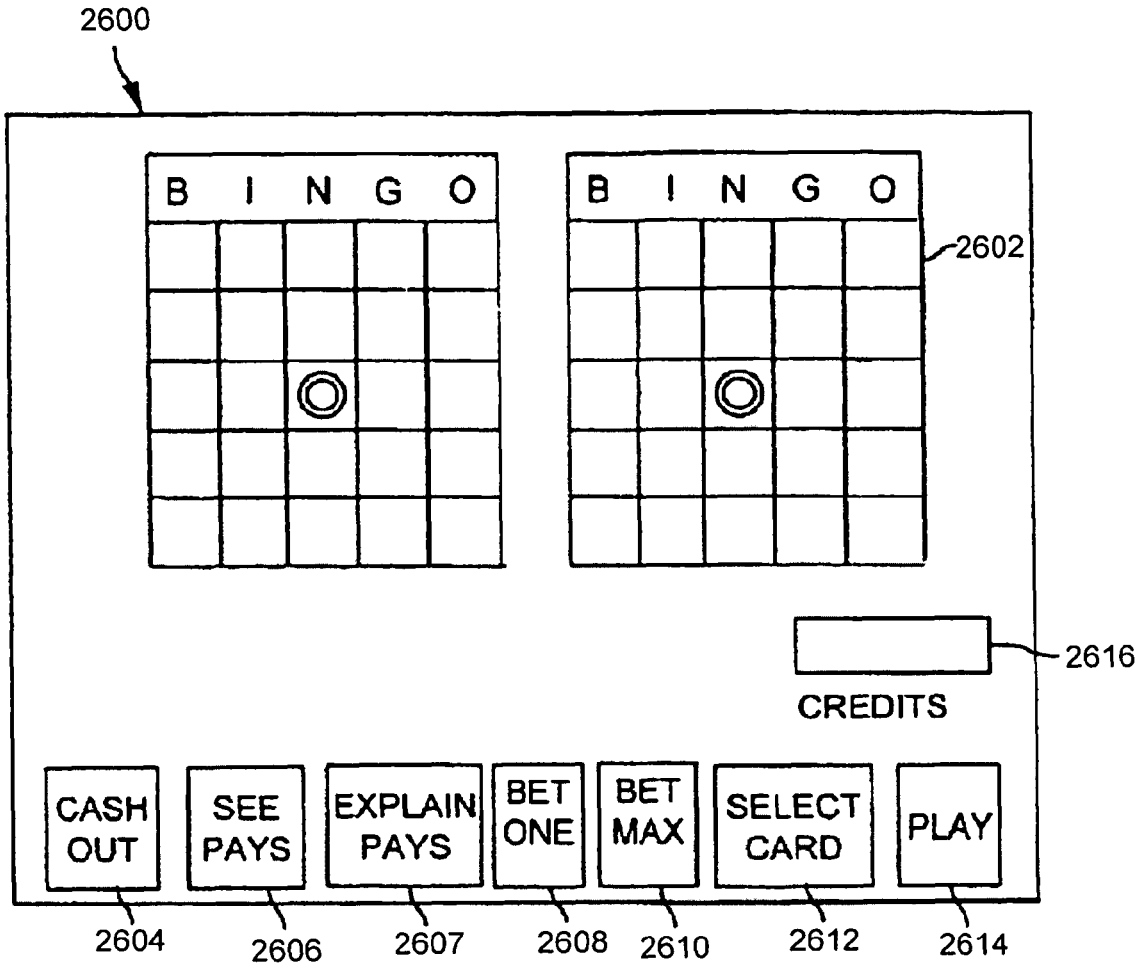
FIG. 26 is an illustration of an embodiment of a visual display that may be displayed during performance of the video bingo routine of FIG. 27.

FIG. 26 is an exemplary display 2600 that may be shown on the color video display unit 70 during performance of the video bingo routine 1211 shown schematically in FIG. 15A. Referring to FIG. 26, the display 2600 may include one or more video images 2602 of a bingo card and images of the bingo numbers selected during the game. The bingo card images 2602 may have a grid pattern.

To allow the player to control the play of the bingo game, a plurality of player-selectable buttons may be displayed. The buttons may include a "Cash Out" button 2604, a "See Pays" button 2606, a "Bet One Credit" button 2608, a "Bet Max Credits" button 2610, a "Select Card" button 2612, and a "Play" button 2614. The display 2600 may also include an area 2616 in which the number of remaining credits or value is displayed. If the color video display unit 70 is provided with a touch-sensitive screen, the buttons may form part of the video display 2600. Alternatively, one or more of those buttons may be provided as part of a control panel that is provided separately from the color video display unit 70.

Figure 27:
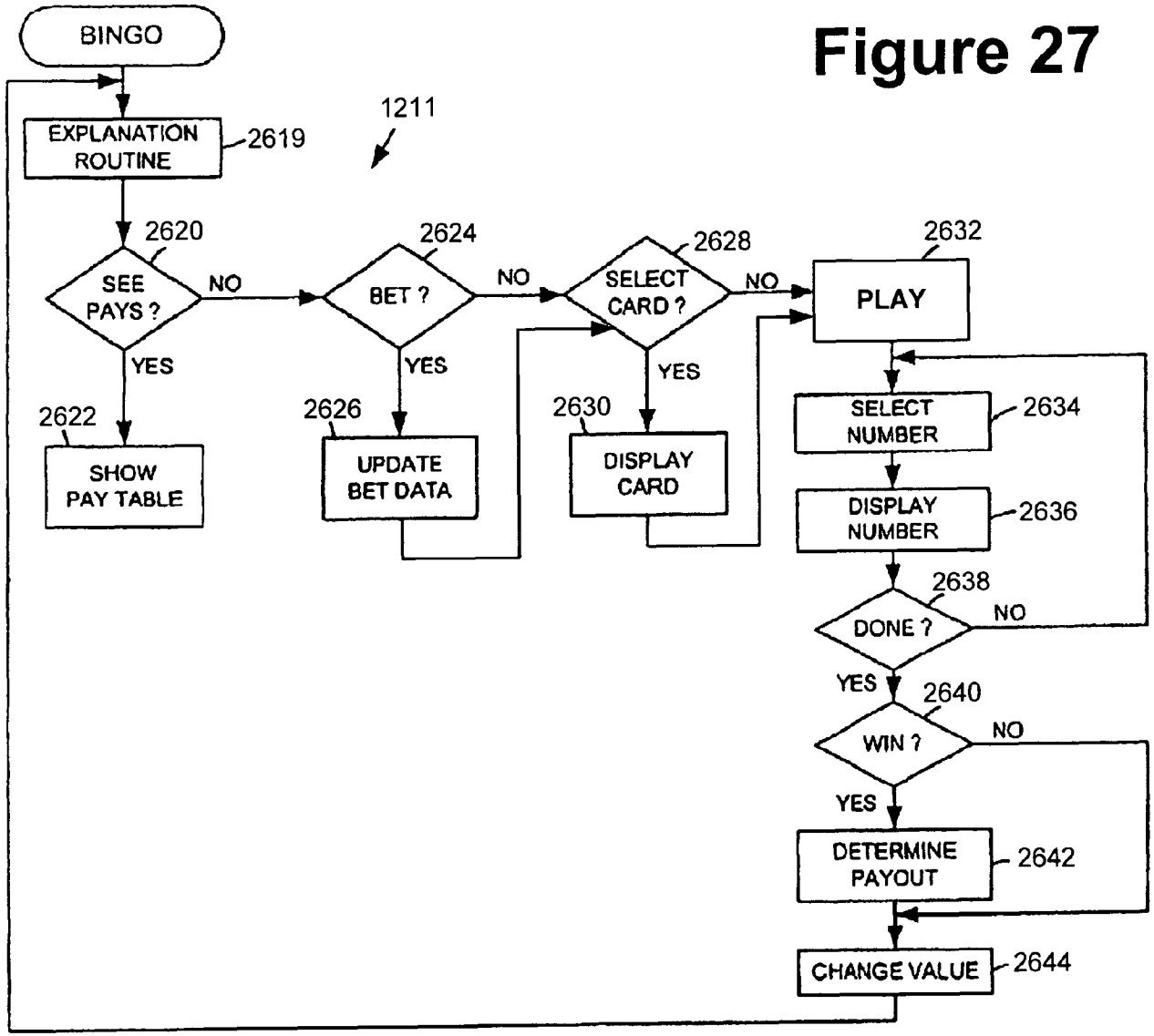
FIG. 27 is a flowchart of an embodiment of a video bingo routine that may be performed by one or more of the gaming units.

FIG. 27 is a flowchart of the video bingo routine 1211 shown schematically in FIG. 15A. The bingo routine 1211 may be utilized in connection with a single gaming unit 20 where a single player is playing a bingo game, or the bingo routine 1211 may be utilized in connection with multiple gaming units 20 where multiple players are playing a single bingo game. In the latter case, one or more of the acts described below may be performed either by the controller 100 in each gaming unit 20 or by one of the network computers 22, 32 to which multiple gaming units 20 are operatively connected.

Referring to FIG. 27, at block 2620, the routine may determine whether the player has requested payout information, such as by activating the "See Pays" button 2606, in which case at block 2622 the routine may cause one or more pay tables to be displayed on the color video display unit 70. At block 2624, the routine may determine whether the player has made a bet, such as by having pressed the "Bet One Credit" button 2608 or the "Bet Max Credits" button 2610, in which case at block 2626 bet data corresponding to the bet made by the player may be stored in the memory of the controller 1000.

After the player has made a wager, at block 2628 the player may select a bingo card, which may be generated randomly. The player may select more than one bingo card, and there may be a maximum number of bingo cards that a player may select. After play is to commence as determined at block 2632, at block 2634 a bingo number may be randomly generated by the controller 100 or a central computer such as one of the network computers 22, 32. At block 2636, the bingo number may be displayed on the color video display unit 70 and the display units 70 of any other gaming units 20 involved in the bingo game.

At block 638, the controller 1000 (or a central computer) may determine whether any player has won the bingo game. If no player has won, another bingo number may be randomly selected at block 2634. If any player has bingo as determined at block 2638, the routine may determine at block 2640 whether the player playing that gaming unit 20 was the winner. If so, at block 2642 a payout for the player may be determined. The payout may depend on the number of random numbers that were drawn before there was a winner, the total number of winners (if there was more than one player), and the amount of money that was wagered on the game. At block 2644, the player's cumulative value or number of credits may be updated by subtracting the bet made by the player and adding, if the bingo game was won, the payout value determined at block 2642. The cumulative value or number of credits may also be displayed in the display area 2616 (FIG. 16).

The many features and advantages of the present invention are apparent from the written description, and thus, it is intended by the appended claims to cover all such features and advantages of the invention. Further, since numerous modifications and changes will readily occur to those skilled.

What is claimed is:

1. A gaming machine comprising:

a display device; and a gaming controller, wherein said gaming controller is configured to:

receive data, said data including visual data associated with a person;

provide a virtual gaming environment, wherein said virtual gaming environment is configured to facilitate playing a wagering game with said person in said virtual gaming environment, simulate a real gaming environment with said virtual gaming environment, wherein said virtual gaming environment includes a representation of said person based on said visual data, and control said display device to:

display a view of said virtual gaming environment which is movable between a plurality of viewpoints, said plurality of viewpoints including a first viewpoint and a second viewpoint, zoom said view to said representation of said person when said view is from said first viewpoint, zoom said view elsewhere than said representation of said person when said view is from said second viewpoint, and present said visual data used in said representation of said person in said virtual gaming environment with a higher frame rate or higher resolution when said view is from said first viewpoint than when said view is from said second viewpoint.

2. A gaming machine as recited in claim 1, wherein said virtual gaming environment includes a virtual gaming table for playing a table game.

3. A gaming machine as recited in claim 1, wherein said table game is one or a combination of the following games: a poker game, a blackjack game, a roulette game, and craps game.

4. A method comprising:

providing a virtual gaming environment on a computing system, wherein said virtual gaming environment is configured for playing a wagering game, wherein said virtual gaming environment represents a real gaming environment where a host conducts or oversees said wagering game;

receiving player data, said player data including player visual data associated with a player using said computing system;

providing said wagering game to said player using said virtual gaming environment;

receiving first data, said first data including first visual data associated with a first person, wherein said first person plays in said wagering game with said player;

receiving second data, said second data including second visual data associated with a second person;

receiving host input data, said host input data including host visual data associated with said host; and controlling a display device to:

provide a view of said virtual gaming environment which is movable between a plurality of viewpoints, the plurality of viewpoints including a first viewpoint and a second viewpoint, wherein said virtual gaming environment includes a representation of said first person and wherein said representation of said first person uses said first visual data, wherein said virtual gaming environment includes a representation of said second person and wherein said representation of said second person uses said second visual data, and wherein said virtual gaming environment includes a representation of said host and wherein said representation of said host uses said host visual data, zoom said view to said representation of said first person when said view is from said first viewpoint, zoom said view elsewhere than said representation of said first person when said view is from said second viewpoint, and present said first visual data used in said representation of said first person in said virtual gaming environment with a higher frame rate or higher resolution when said view is from said first viewpoint than when said view is from said second viewpoint.

5. A method as recited in claim 4, wherein said method further comprises:

determining how many participants are to participate in said wagering game; and providing said virtual gaming environment based on said number of participants.

6. A method as recited in claim 4, further comprising controlling said display device to:

zoom said view to said representation of said second person when said view is from said second viewpoint, and present said second visual data used in said representation of said second person in said virtual gaming environment with a higher frame rate or higher resolution when said view is from said second viewpoint than when said view is from said first viewpoint, wherein said view does not zoom to said representation of said second person when said view is from said first viewpoint and wherein said view does not zoom to said representation of said first person when said view is from said second viewpoint.

7. A method as recited in claim 4, further comprising controlling said display device to:

zoom said view to said representation of said host when said view is from a third viewpoint, and present said host visual data used in said representation of said host in said virtual gaming environment with a higher frame rate or higher resolution when said view is from said third viewpoint than when said view is from said first viewpoint or said second viewpoint.

8. A method as recited in claim 7, wherein said first visual data includes data describing one or more of the following:

a live video feed of one or more persons;

a still picture of one or more persons; and an icon or caricature representing one or more persons.

9. A method as recited in claim 4, wherein said method further comprises:

receiving audio input from said host; and providing audio output of said audio input from said host to said player.

10. A method as recited in claim 9, wherein said audio input from said host includes one or more of the following:

commentary on said wagering game;

incentive for playing said wagering game;

simulated sound of a gaming environment;

live sound;

pre-recorded sound;

live or prerecorded sound of a gaming environment;

live or prerecorded sound of a casino;

live or prerecorded background sound of a gaming environment; and live or prerecorded background sound of a casino.

11. A method as recited in claim 4, further comprising:

receiving audio input from said player, providing audio output of said audio input from said player in real-time to one or more of said host, said first person, and said second person.

12. A method as recited in claim 11, wherein audio input received from one or more of said first person, said second person, and said host is provided to one or more of said player, said first person, said second person, and said host in real-time.

13. A method as recited in claim 4, further comprising:

receiving audio input from said first person; and providing audio output of said audio input from said first person to said player at a higher audio volume when said view is from said first viewpoint than when said view is from said second viewpoint.

14. A method as recited in claim 4, wherein said second person plays in said wagering game with said player and said first person.

15. A method as recited in claim 4, wherein said second person passively participates in said wagering game.

16. A method as recited in claim 4, wherein said second person observes said wagering game.

17. A method as recited in claim 4, wherein one or more software agents actively participate in said wagering game.

18. A method as recited in claim 4, wherein one or more software agents passively participate in said wagering game.

19. A method as recited in claim 4, wherein one or more software agents observe said wagering game.

20. A method as recited in claim 4, wherein a software agent represents said first person or said second person.

21. A method as recited in claim 15, wherein said second person participates in back-betting with a third person passively participating in said wagering game when said player and said first person are playing said wagering game.

22. A method as recited in claim 4, wherein said method comprises:

moving said view from said first viewpoint to said second viewpoint by virtually panning across said virtual gaming environment.

23. A method as recited in claim 22, wherein said plurality of viewpoints includes viewpoints with different fields of view.

24. A method as recited in claim 22, wherein said method further comprises:

receiving a request from said player to move said view from said second viewpoint to said first viewpoint;

moving said view from said second viewpoint to said first viewpoint responsive to said request.

25. A method as recited in claim 4, wherein said computing system is one of the following:

a gaming machine;

a personal digital assistant;

a mobile wireless phone;

a laptop computer;

a desktop computer; and an interactive TV.

26. A method as recited in claim 4, wherein said computing system is a gaming machine capable of independently determining an outcome of said wagering game.

27. A method as recited in claim 4, wherein said computing system is a portable or a handheld device.

28. A method as recited in claim 4, wherein said first visual data does not include an image captured from said first person.

29. A method as recited in claim 4, wherein said method comprises:

converting audio input from said first person to text; and displaying said text on said display device.

30. A method as recited in claim 29, wherein said converting of audio input is at least partly performed by a speech recognition program.

31. A method as recited in claim 4, wherein said host is a live person.

32. A method as recited in claim 4, wherein said host is a software agent.

33. A method as recited in claim 12, wherein said audio input is received and provided in a full-duplex mode to.

34. A computing system configured to:

provide a wagering game for play using a virtual gaming environment, wherein said virtual gaming environment represents a real gaming environment where a host conducts or oversees said wagering game;

receive player data, said player data including player visual data associated with a player of said wagering game;

receive first data, said first data including first visual data associated with a first person, wherein said first person plays in said wagering game with said player;

receive second data, said second data including second visual data associated with a second person;

receive host input data, said host input data including host visual data associated with said host;

provide, on a display device, a view of said virtual gaming environment which is movable between a plurality of viewpoints, the plurality of viewpoints including a first viewpoint and a second viewpoint, wherein said virtual gaming environment includes a representation of said first person and wherein said representation of said first person uses said first visual data, wherein said virtual gaming environment includes a representation of said second person and wherein said representation of said second person uses said second visual data, and wherein said virtual gaming environment includes a representation of said host and wherein said representation of said host uses said host visual data;

zoom said view to said representation of said first person when said view is from said first viewpoint;

zoom said view elsewhere than said representation of said first person when said view is from said second viewpoint; and present said first visual data used in said representation of said first person in said virtual gaming environment with a higher frame rate or higher resolution when said view is from said first viewpoint than when said view is from said second viewpoint.

35. A computing system as recited in claim 34, wherein said computing system acts as a host or server that is connected to one or more remote computing systems that are used by one or more of said player, said first person, said second person, and said host to participate in said wagering game.

36. A computing system as recited in claim 34, wherein said host said is a live person who interacts with said computing system.

37. A computing system as recited in claim 36, wherein said computing system provides said host using a software agent.

38. A computing system as recited in claim 34, wherein said computer system is a gaming machine.

39. A computing system as recited in claim 35, wherein said remote computing systems are selected from:

a gaming machine;

a personal digital assistant;

a cellular phone;

a laptop computer;

a desktop computer; and an interactive television.

40. A non-transitory, computer-readable medium including computer program code including instructions for causing a computing system to:

provide a wagering game for play using a virtual gaming environment, wherein said virtual gaming environment represents a real gaming environment where a host conducts or oversees said wagering game;

receive player data, said player data including player visual data associated with a player of said wagering game;

receive first data, said first data including first visual data associated with a first person, wherein said first person plays in said wagering game with said player;

receive second data, said second data including second visual data associated with a second person;

receive host input data, said host input data including host visual data associated with said host;

provide, on a display device, a view of said virtual gaming environment which is movable between a plurality of viewpoints, the plurality of viewpoints including a first viewpoint and a second viewpoint, wherein said virtual gaming environment includes a representation of said first person and wherein said representation of said first person uses said first visual data, wherein said virtual gaming environment includes a representation of said second person and wherein said representation of said second person uses said second visual data, and wherein said virtual gaming environment includes a representation of said host and wherein said representation of said host uses said host visual data;

zoom said view to said representation of said first person when said view is from said first viewpoint;

zoom said view elsewhere than said representation of said first person when said view is from said second viewpoint; and present said first visual data used in said representation of said first person in said virtual gaming environment with a higher frame rate or higher resolution when said view is from said first viewpoint than when said view is from said second viewpoint.

* * * * *